US009346296B2

(12) United States Patent
Yamaguchi et al.

(10) Patent No.: US 9,346,296 B2
(45) **Date of Patent: *May 24, 2016**

(54) TAPE CASSETTE

(75) Inventors: Koshiro Yamaguchi, Kakamigahara (JP); Akira Sago, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/431,371

(22) Filed: Mar. 27, 2012

(65) Prior Publication Data

US 2012/0189366 A1 Jul. 26, 2012

Related U.S. Application Data

(62) Division of application No. 12/732,404, filed on Mar. 26, 2010.

(30) Foreign Application Priority Data

Mar. 31, 2009 (JP) ..... 2009-086172
Mar. 31, 2009 (JP) ..... 2009-086184
Mar. 31, 2009 (JP) ..... 2009-086201
Mar. 31, 2009 (JP) ..... 2009-086222

(51) Int. Cl.
*B41J 35/28* (2006.01)
*B41J 15/04* (2006.01)

(52) U.S. Cl.
CPC ..... *B41J 15/044* (2013.01)

(58) Field of Classification Search
CPC ..... B41J 15/044; B41J 15/042; B41J 15/04
USPC ..... 400/207, 208, 208.1, 120.02, 201; 347/214
See application file for complete search history.

(56) References Cited

U.S. PATENT DOCUMENTS 372,044 A 10/1887 Rose et al.
3,901,372 A 8/1975 Denley
4,127,883 A 11/1978 Mestdagh
(Continued)

FOREIGN PATENT DOCUMENTS

AU 2003294971 A1 7/2004
CA 2108332 A1 4/1994
(Continued)

OTHER PUBLICATIONS

European Communication of EP 10711477.9 dated Sep. 6, 2012.
(Continued)

*Primary Examiner* — David Banh
(74) *Attorney, Agent, or Firm* — Banner & Witcoff, Ltd.

(57) ABSTRACT

A tape cassette that includes a generally rectangular box-like housing having a top wall, a bottom wall, and a side wall defining a periphery of the housing, a first and second cavities extending from the bottom wall and disposed between a tape containing area and the periphery at opposite ends of a diagonal of the generally rectangular box-like housing, at least one tape wound and mounted within the housing in the tape containing area, the at least one tape including a first tape disposed in a first area, the first tape having a hole at a center of winding, and the first area being one of two areas formed by dividing the housing with respect to a line connecting the first and second cavities, and a third cavity that extends in the hole of the first tape from the bottom wall.

9 Claims, 57 Drawing Sheets

(56) References Cited

U.S. PATENT DOCUMENTS

| | | | |
|---|---|---|---|
| 4,226,547 | A | 10/1980 | Bradshaw et al. |
| 4,360,278 | A | 11/1982 | Paque |
| D267,330 | S | 12/1982 | Worrell |
| 4,391,539 | A | 7/1983 | Connoy |
| 4,402,619 | A | 9/1983 | Paque et al. |
| 4,557,617 | A | 12/1985 | Richardson et al. |
| 4,567,488 | A | 1/1986 | Moriguchi et al. |
| 4,678,353 | A | 7/1987 | Richardson et al. |
| 4,725,155 | A | 2/1988 | Kittel et al. |
| 4,773,775 | A | 9/1988 | Bradshaw et al. |
| 4,815,871 | A | 3/1989 | McGourty et al. |
| 4,815,874 | A | 3/1989 | Richardson et al. |
| 4,815,875 | A | 3/1989 | Richardson et al. |
| 4,832,514 | A | 5/1989 | Basile |
| 4,844,636 | A | 7/1989 | Paque |
| 4,880,325 | A | 11/1989 | Ueda et al. |
| 4,892,425 | A | 1/1990 | Shimizu et al. |
| D307,296 | S | 4/1990 | Ivarson et al. |
| 4,915,516 | A | 4/1990 | Shimizu et al. |
| 4,917,514 | A | 4/1990 | Richardson et al. |
| D307,918 | S | 5/1990 | Goda |
| 4,927,278 | A | 5/1990 | Kuzuya et al. |
| 4,930,913 | A | 6/1990 | Basile |
| D311,416 | S | 10/1990 | Richardson et al. |
| 4,966,476 | A | 10/1990 | Kuzuya et al. |
| 4,983,058 | A | 1/1991 | Nagae |
| 5,022,771 | A | 6/1991 | Paque |
| D319,070 | S | 8/1991 | Lavander |
| D320,391 | S | 10/1991 | Paque |
| 5,056,940 | A | 10/1991 | Basile |
| 5,078,523 | A | 1/1992 | McGourty et al. |
| 5,104,247 | A | 4/1992 | Ohshima |
| 5,111,216 | A | 5/1992 | Richardson et al. |
| 5,188,469 | A | 2/1993 | Nagao et al. |
| 5,193,919 | A | 3/1993 | Godo et al. |
| 5,195,835 | A | 3/1993 | Collins |
| 5,203,951 | A | 4/1993 | Hattori et al. |
| 5,223,939 | A | 6/1993 | Imaizumi et al. |
| 5,239,437 | A | 8/1993 | Hoge et al. |
| D342,275 | S | 12/1993 | Cooper |
| RE34,521 | E | 1/1994 | Shimizu et al. |
| 5,277,503 | A | 1/1994 | Nagao |
| 5,318,370 | A | 6/1994 | Nehowig |
| 5,348,406 | A | 9/1994 | Yoshiaki et al. |
| 5,350,243 | A | 9/1994 | Ichinomiya et al. |
| D352,305 | S | 11/1994 | Cooper |
| 5,374,132 | A | 12/1994 | Kimura |
| D356,333 | S | 3/1995 | Pearce et al. |
| 5,395,173 | A | 3/1995 | Ueno et al. |
| 5,399,033 | A | 3/1995 | Putman |
| D357,497 | S | 4/1995 | Gray et al. |
| 5,411,339 | A | 5/1995 | Bahrabadi et al. |
| 5,419,648 | A | 5/1995 | Nagao et al. |
| D359,303 | S | 6/1995 | Gray et al. |
| 5,424,757 | A | 6/1995 | Thom |
| 5,429,443 | A | 7/1995 | Kobayashi et al. |
| 5,431,504 | A | 7/1995 | Beadman et al. |
| 5,435,657 | A | 7/1995 | Pearce et al. |
| 5,466,076 | A | 11/1995 | Kobayashi et al. |
| 5,492,282 | A | 2/1996 | Okuchi et al. |
| 5,492,420 | A | 2/1996 | Nunokawa et al. |
| 5,494,362 | A | 2/1996 | Kobayashi et al. |
| 5,506,736 | A | 4/1996 | Ota |
| 5,511,891 | A | 4/1996 | Nehowig et al. |
| 5,518,328 | A | 5/1996 | Okuchi et al. |
| 5,533,818 | A | 7/1996 | Bahrabadi |
| 5,538,352 | A | 7/1996 | Sugiura |
| 5,540,510 | A | 7/1996 | Sims et al. |
| 5,541,796 | A | 7/1996 | Sawada |
| 5,553,952 | A | 9/1996 | Umbach |
| 5,564,843 | A | 10/1996 | Kawaguchi |
| 5,593,237 | A | 1/1997 | Nozaki et al. |
| 5,595,447 | A | 1/1997 | Takayama et al. |
| 5,599,119 | A | 2/1997 | Nunokawa et al. |
| 5,605,404 | A | 2/1997 | Nunokawa et al. |
| 5,620,268 | A | 4/1997 | Yamaguchi et al. |
| 5,634,728 | A | 6/1997 | Nunokawa et al. |
| 5,653,542 | A | 8/1997 | Sugimoto et al. |
| 5,658,083 | A | 8/1997 | Day et al. |
| 5,659,441 | A | 8/1997 | Eckberg et al. |
| 5,709,486 | A | 1/1998 | Day |
| 5,727,888 | A | 3/1998 | Sugimoto et al. |
| 5,730,536 | A | 3/1998 | Yamaguchi |
| 5,739,839 | A | 4/1998 | Iwai et al. |
| 5,752,777 | A | 5/1998 | Nunokawa et al. |
| 5,765,954 | A | 6/1998 | Nunokawa et al. |
| 5,771,803 | A | 6/1998 | Takami |
| 5,788,387 | A | 8/1998 | Takayama et al. |
| 5,795,086 | A | 8/1998 | Watanabe et al. |
| 5,813,773 | A | 9/1998 | Kawai |
| 5,813,779 | A | 9/1998 | Palmer et al. |
| 5,823,689 | A | 10/1998 | Nehowig et al. |
| 5,825,724 | A | 10/1998 | Matsumoto et al. |
| 5,826,995 | A | 10/1998 | Day et al. |
| 5,857,788 | A | 1/1999 | Gutsell et al. |
| 5,860,752 | A | 1/1999 | Watanabe et al. |
| 5,887,993 | A | 3/1999 | Nunokawa et al. |
| 5,961,225 | A | 10/1999 | Nunokawa et al. |
| 5,964,539 | A | 10/1999 | Yamaguchi et al. |
| 5,967,678 | A | 10/1999 | Nunokawa et al. |
| 5,997,194 | A | 12/1999 | Nunokawa et al. |
| 6,012,860 | A | 1/2000 | Nunokawa et al. |
| 6,042,280 | A | 3/2000 | Yamaguchi et al. |
| 6,048,118 | A | 4/2000 | Martinez et al. |
| 6,050,672 | A | 4/2000 | Matsuhashi |
| 6,050,734 | A | 4/2000 | Watanabe et al. |
| 6,059,469 | A | 5/2000 | Hirumi |
| 6,106,171 | A | 8/2000 | Nunokawa et al. |
| 6,116,796 | A | 9/2000 | Yamaguchi et al. |
| 6,126,344 | A | 10/2000 | Takayama et al. |
| 6,132,120 | A | 10/2000 | Yamaguchi et al. |
| 6,146,034 | A | 11/2000 | Watanabe et al. |
| 6,149,325 | A | 11/2000 | Nunokawa et al. |
| 6,160,679 | A | 12/2000 | Maekawa et al. |
| 6,168,328 | B1 | 1/2001 | Ueda et al. |
| 6,190,065 | B1 | 2/2001 | Brzuskiewicz |
| 6,190,069 | B1 | 2/2001 | Yamaguchi et al. |
| 6,196,740 | B1 | 3/2001 | Yamaguchi et al. |
| 6,227,477 | B1 | 5/2001 | Komatsuzaki et al. |
| 6,232,993 | B1 | 5/2001 | Kobayashi et al. |
| 6,270,269 | B1 | 8/2001 | Watanabe et al. |
| 6,317,156 | B1 | 11/2001 | Nagasaki et al. |
| 6,334,724 | B2 | 1/2002 | Yamaguchi et al. |
| 6,386,774 | B1 | 5/2002 | Takayama et al. |
| 6,406,202 | B1 | 6/2002 | Unno et al. |
| 6,435,744 | B1 | 8/2002 | Dunn et al. |
| 6,476,838 | B1 | 11/2002 | Italiano |
| 6,485,206 | B1 | 11/2002 | Takahashi |
| 6,520,696 | B2 | 2/2003 | Huss et al. |
| 6,644,876 | B2 | 11/2003 | Carriere et al. |
| D486,853 | S | 2/2004 | Wilken et al. |
| 6,709,179 | B2 | 3/2004 | Yamaguchi et al. |
| 6,910,819 | B2 | 6/2005 | Carriere et al. |
| 6,929,415 | B2 | 8/2005 | Wilken |
| 6,955,318 | B2 | 10/2005 | Nonomura |
| D519,522 | S | 4/2006 | Lee |
| 7,070,347 | B2 | 7/2006 | Carriere et al. |
| 7,070,348 | B2 | 7/2006 | Sugimoto et al. |
| 7,097,372 | B1 | 8/2006 | Heyse et al. |
| 7,121,751 | B2 | 10/2006 | Harada et al. |
| 7,128,483 | B2 | 10/2006 | Harada et al. |
| D534,203 | S | 12/2006 | Harada et al. |
| 7,201,522 | B2 | 4/2007 | Bandholz et al. |
| D542,334 | S | 5/2007 | Harada et al. |
| 7,232,268 | B2 | 6/2007 | Sugimoto et al. |
| 7,287,715 | B2 | 10/2007 | Ban |
| 7,357,585 | B2 | 4/2008 | Kurashina |
| 7,404,684 | B2 | 7/2008 | Sugimoto et al. |
| D579,942 | S | 11/2008 | Terry et al. |
| 7,503,714 | B2 | 3/2009 | Yamamoto et al. |
| 7,841,790 | B2 | 11/2010 | Yamaguchi et al. |
| 7,942,594 | B2 | 5/2011 | Kumazaki et al. |
| 7,965,308 | B2 | 6/2011 | Jauert et al. |
| 8,045,288 | B2 | 10/2011 | Ota et al. |

(56) References Cited

U.S. PATENT DOCUMENTS

| | | | |
|---|---|---|---|
| 8,109,684 | B2 | 2/2012 | Yamaguchi |
| 8,162,553 | B2 | 4/2012 | Vandermeulen |
| 8,164,609 | B2 | 4/2012 | Liu et al. |
| 8,382,389 | B2 | 2/2013 | Yamaguchi et al. |
| D681,727 | S | 5/2013 | Van Den Broecke |
| 8,529,142 | B2 | 9/2013 | Tanaka |
| 8,540,444 | B2 | 9/2013 | Vandermeulen et al. |
| 8,562,228 | B2 | 10/2013 | Yamaguchi et al. |
| 8,641,304 | B2 | 2/2014 | Yamaguchi et al. |
| 8,734,035 | B2 | 5/2014 | Suva et al. |
| 8,740,482 | B2 | 6/2014 | Yamaguchi et al. |
| 8,757,907 | B2 | 6/2014 | Yamaguchi et al. |
| 8,764,326 | B2 | 7/2014 | Yamaguchi et al. |
| 8,770,877 | B2 | 7/2014 | Yamaguchi et al. |
| 2002/0006303 | A1 | 1/2002 | Yamaguchi et al. |
| 2002/0012558 | A1 | 1/2002 | Huss et al. |
| 2002/0047063 | A1 | 4/2002 | Kaneda et al. |
| 2002/0135938 | A1 | 9/2002 | Hiraguchi et al. |
| 2003/0081978 | A1 | 5/2003 | Carriere et al. |
| 2004/0056143 | A1 | 3/2004 | Nonomura |
| 2004/0062586 | A1 | 4/2004 | Harada et al. |
| 2004/0233269 | A1 | 11/2004 | Tsubota |
| 2004/0265027 | A1 | 12/2004 | Hine et al. |
| 2005/0036816 | A1 | 2/2005 | Carriere et al. |
| 2005/0152732 | A1 | 7/2005 | Bandholz et al. |
| 2005/0172981 | A1 | 8/2005 | Byun |
| 2006/0088802 | A1 | 4/2006 | Akaiwa |
| 2006/0182921 | A1 | 8/2006 | Hioki et al. |
| 2006/0193669 | A1 | 8/2006 | Takada et al. |
| 2006/0204304 | A1 | 9/2006 | Hioki et al. |
| 2006/0216099 | A1 | 9/2006 | Sakano et al. |
| 2006/0216100 | A1 | 9/2006 | Minoya et al. |
| 2006/0233582 | A1 | 10/2006 | Horiuchi |
| 2006/0238600 | A1 | 10/2006 | Vandermeulen et al. |
| 2006/0239743 | A1 | 10/2006 | Naito |
| 2007/0009302 | A1 | 1/2007 | Vandermeulen |
| 2007/0009306 | A1 | 1/2007 | Harada et al. |
| 2007/0031171 | A1 | 2/2007 | Heyse et al. |
| 2007/0041772 | A1 | 2/2007 | Harada et al. |
| 2007/0070168 | A1 | 3/2007 | Mindler et al. |
| 2007/0098473 | A1 | 5/2007 | Heyse et al. |
| 2007/0172293 | A1 | 7/2007 | Vandermeulen |
| 2007/0212149 | A1 | 9/2007 | Ota et al. |
| 2007/0231041 | A1 | 10/2007 | Ueda et al. |
| 2007/0237562 | A1 | 10/2007 | Kato et al. |
| 2007/0264070 | A1 | 11/2007 | Loo et al. |
| 2008/0050160 | A1 | 2/2008 | Yamaguchi et al. |
| 2008/0056793 | A1 | 3/2008 | Yokoyama |
| 2008/0080922 | A1 | 4/2008 | Vandermeulen |
| 2008/0181703 | A1 | 7/2008 | Ito et al. |
| 2008/0181708 | A1 | 7/2008 | Yamaguchi et al. |
| 2008/0226373 | A1 | 9/2008 | Yamaguchi et al. |
| 2008/0310904 | A1 | 12/2008 | Yamaguchi et al. |
| 2009/0016795 | A1 | 1/2009 | Caveney et al. |
| 2009/0190988 | A1 | 7/2009 | Vereeckon et al. |
| 2009/0202283 | A1 | 8/2009 | Kumazaki et al. |
| 2009/0285617 | A1 | 11/2009 | Vandermeulen |
| 2010/0119281 | A1 | 5/2010 | Ford et al. |
| 2010/0166475 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0232862 | A1 | 9/2010 | Vandermeulen |
| 2010/0247208 | A1 | 9/2010 | Yamaguchi et al. |
| 2010/0247209 | A1 | 9/2010 | Yamaguchi et al. |
| 2010/0247210 | A1 | 9/2010 | Yamaguchi et al. |
| 2010/0272492 | A1 | 10/2010 | Van Britsom et al. |
| 2011/0058884 | A1 | 3/2011 | Kato et al. |
| 2012/0008999 | A1 | 1/2012 | Yamaguchi et al. |
| 2012/0027485 | A1 | 2/2012 | Suva et al. |
| 2012/0027486 | A1 | 2/2012 | Suva et al. |
| 2012/0027487 | A1 | 2/2012 | Suva et al. |
| 2012/0057917 | A1 | 3/2012 | Van Britsom et al. |
| 2012/0080550 | A1 | 4/2012 | Yamaguchi et al. |
| 2012/0170959 | A1 | 7/2012 | Vandermeulen et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0205350 | A1 | 7/2014 | Yamaguchi et al. |
| 2014/0218458 | A1 | 8/2014 | Suva et al. |

FOREIGN PATENT DOCUMENTS

| | | | |
|---|---|---|---|
| CA | 2182264 | A1 | 6/1996 |
| CH | 121073 | | 2/1994 |
| CH | 136498 | | 12/2009 |
| CN | 1098984 | A | 2/1995 |
| CN | 1119146 | A | 3/1996 |
| CN | 1143928 | A | 2/1997 |
| CN | 1146954 | A | 4/1997 |
| CN | 1148547 | A | 4/1997 |
| CN | 1148548 | | 4/1997 |
| CN | 1166155 | A | 11/1997 |
| CN | 1289293 | | 3/2001 |
| CN | 1313197 | A | 9/2001 |
| CN | 1313198 | A | 9/2001 |
| CN | 1085151 | C | 5/2002 |
| CN | 1376115 | | 10/2002 |
| CN | 1379115 | | 10/2002 |
| CN | 1385312 | A | 12/2002 |
| CN | 1385313 | A | 12/2002 |
| CN | 1385314 | A | 12/2002 |
| CN | 1397431 | | 2/2003 |
| CN | 1415482 | A | 5/2003 |
| CN | 1415484 | | 5/2003 |
| CN | 1469811 | | 1/2004 |
| CN | 1493462 | | 5/2004 |
| CN | 1636755 | | 7/2005 |
| CN | 1642746 | | 7/2005 |
| CN | 1663807 | A | 9/2005 |
| CN | 1744993 | A | 3/2006 |
| CN | 1744994 | A | 3/2006 |
| CN | 1762720 | | 4/2006 |
| CN | 1799850 | A | 7/2006 |
| CN | 1799851 | A | 7/2006 |
| CN | 1820940 | A | 8/2006 |
| CN | 1827386 | | 9/2006 |
| CN | 1835867 | | 9/2006 |
| CN | 1865012 | A | 11/2006 |
| CN | 1914045 | A | 2/2007 |
| CN | 1990261 | A | 7/2007 |
| CN | 1331684 | C | 8/2007 |
| CN | 101028771 | A | 9/2007 |
| CN | 101039807 | A | 9/2007 |
| CN | 101060985 | | 10/2007 |
| CN | 101128324 | | 2/2008 |
| CN | 101229724 | | 7/2008 |
| CN | 101264701 | A | 9/2008 |
| CN | 101264702 | A | 9/2008 |
| CN | 101310989 | | 11/2008 |
| CN | 101327696 | | 12/2008 |
| CN | 101356061 | A | 1/2009 |
| CN | 101516628 | A | 8/2009 |
| CN | 101758676 | A | 6/2010 |
| CN | 102616025 | | 8/2012 |
| EP | 214466 | A2 | 3/1987 |
| EP | 0 329 369 | A2 | 8/1989 |
| EP | 0 511 602 | A1 | 11/1992 |
| EP | 0555954 | A2 | 8/1993 |
| EP | 0593269 | A2 | 4/1994 |
| EP | 0 629 509 | A2 | 12/1994 |
| EP | 0635375 | | 1/1995 |
| EP | 0 644 506 | A2 | 3/1995 |
| EP | 0 684 143 | A2 | 11/1995 |
| EP | 0703089 | A1 | 3/1996 |
| EP | 0 734 878 | A2 | 10/1996 |
| EP | 0742103 | A1 | 11/1996 |
| EP | 0863021 | B1 | 9/1998 |
| EP | 0644506 | | 4/1999 |
| EP | 0936076 | A2 | 8/1999 |
| EP | 0940263 | A2 | 9/1999 |
| EP | 0958931 | A2 | 11/1999 |
| EP | 0997300 | A2 | 5/2000 |
| EP | 1167049 | A1 | 1/2002 |
| EP | 1170139 | A1 | 1/2002 |

(56) References Cited

FOREIGN PATENT DOCUMENTS

| | | | |
|---|---|---|---|
| EP | 1 199 179 | A1 | 4/2002 |
| EP | 1 284 196 | A2 | 2/2003 |
| EP | 1502758 | | 2/2005 |
| EP | 1 516 739 | A1 | 3/2005 |
| EP | 1552949 | | 7/2005 |
| EP | 1575781 | A1 | 9/2005 |
| EP | 1 700 705 | A1 | 9/2006 |
| EP | 1 707 395 | A1 | 10/2006 |
| EP | 1829696 | A2 | 9/2007 |
| EP | 2059396 | A1 | 5/2009 |
| EP | 2 236 304 | A1 | 10/2010 |
| EP | 2236303 | A1 | 10/2010 |
| EP | 2448762 | B1 | 9/2013 |
| JP | S56-20944 | U | 2/1981 |
| JP | 58-139415 | U | 9/1983 |
| JP | 5978879 | | 5/1984 |
| JP | 60-099692 | A | 6/1985 |
| JP | 61179776 | | 8/1986 |
| JP | S63-81063 | U | 5/1988 |
| JP | 63-166557 | A | 7/1988 |
| JP | 63-203348 | A | 8/1988 |
| JP | 63-254085 | A | 10/1988 |
| JP | H01-195088 | A | 8/1989 |
| JP | 0256664 | | 4/1990 |
| JP | H02-56665 | | 4/1990 |
| JP | H02-56666 | U | 4/1990 |
| JP | 02147272 | | 6/1990 |
| JP | 3-093584 | A | 4/1991 |
| JP | 3-120680 | A | 5/1991 |
| JP | 03151261 | | 6/1991 |
| JP | 3-63155 | B2 | 9/1991 |
| JP | 3-118672 | U | 12/1991 |
| JP | 4-037575 | A | 2/1992 |
| JP | 4-133756 | A | 5/1992 |
| JP | H04-168086 | A | 6/1992 |
| JP | 5-16342 | U | 3/1993 |
| JP | 5-063067 | A | 3/1993 |
| JP | 0518853 | | 3/1993 |
| JP | 05104840 | | 4/1993 |
| JP | 5-155067 | A | 6/1993 |
| JP | 5-54225 | U | 7/1993 |
| JP | 5-78565 | U | 10/1993 |
| JP | 5-80765 | U | 11/1993 |
| JP | 5-294051 | A | 11/1993 |
| JP | 05301435 | | 11/1993 |
| JP | 6-012053 | U | 2/1994 |
| JP | 6-21953 | U | 3/1994 |
| JP | 11-91144 | | 4/1994 |
| JP | 6-122239 | | 5/1994 |
| JP | 6-122249 | | 5/1994 |
| JP | 6-124406 | A | 5/1994 |
| JP | 6-127094 | | 5/1994 |
| JP | 6-152907 | A | 5/1994 |
| JP | 6-53560 | U | 7/1994 |
| JP | 6-183117 | A | 7/1994 |
| JP | 6-191081 | A | 7/1994 |
| JP | 6-210889 | A | 8/1994 |
| JP | 674348 | U | 10/1994 |
| JP | 6-328800 | A | 11/1994 |
| JP | 7-1782 | | 1/1995 |
| JP | 7-001805 | A | 1/1995 |
| JP | 7-009743 | A | 1/1995 |
| JP | 7-025123 | A | 1/1995 |
| JP | 0725122 | | 1/1995 |
| JP | 7-047737 | A | 2/1995 |
| JP | 7-20725 | B2 | 3/1995 |
| JP | 7-061009 | A | 3/1995 |
| JP | 7-069497 | A | 3/1995 |
| JP | 0768877 | | 3/1995 |
| JP | 7-089115 | A | 4/1995 |
| JP | 7-089196 | A | 4/1995 |
| JP | 7-101133 | A | 4/1995 |
| JP | 7-108702 | A | 4/1995 |
| JP | 07108730 | | 4/1995 |
| JP | 7-137327 | A | 5/1995 |
| JP | 7-40456 | U | 7/1995 |
| JP | 07214876 | | 8/1995 |
| JP | 7-237314 | A | 9/1995 |
| JP | 7-251539 | A | 10/1995 |
| JP | 7-276695 | A | 10/1995 |
| JP | 7-290803 | A | 11/1995 |
| JP | 7-314864 | A | 12/1995 |
| JP | 7-314865 | A | 12/1995 |
| JP | 7-314866 | A | 12/1995 |
| JP | 8-025768 | A | 1/1996 |
| JP | 8-039909 | A | 2/1996 |
| JP | 8-58211 | A | 3/1996 |
| JP | H08-90887 | A | 4/1996 |
| JP | 8-118738 | A | 5/1996 |
| JP | 08165035 | | 6/1996 |
| JP | 08216461 | | 8/1996 |
| JP | 8-252964 | A | 10/1996 |
| JP | 8-267839 | A | 10/1996 |
| JP | 8-290618 | A | 11/1996 |
| JP | 09-039347 | | 2/1997 |
| JP | 2596263 | B2 | 4/1997 |
| JP | 09109533 | | 4/1997 |
| JP | 9-123579 | | 5/1997 |
| JP | 9-134557 | A | 5/1997 |
| JP | H09-118044 | A | 5/1997 |
| JP | 9-141986 | A | 6/1997 |
| JP | 09-141997 | | 6/1997 |
| JP | 9-188049 | A | 7/1997 |
| JP | 9-188050 | A | 7/1997 |
| JP | 09240158 | | 9/1997 |
| JP | 10-056604 | A | 2/1998 |
| JP | 10-181063 | A | 7/1998 |
| JP | H1-146945 | A | 2/1999 |
| JP | 11-078188 | A | 3/1999 |
| JP | 1178189 | | 3/1999 |
| JP | 11-105351 | A | 4/1999 |
| JP | 11-129563 | A | 5/1999 |
| JP | 11-263055 | A | 9/1999 |
| JP | H11-263056 | A | 9/1999 |
| JP | 2000-006501 | A | 1/2000 |
| JP | 2000-025251 | A | 1/2000 |
| JP | 2998617 | B2 | 1/2000 |
| JP | 2000-043336 | A | 2/2000 |
| JP | 2000-043337 | A | 2/2000 |
| JP | 2000-085224 | A | 3/2000 |
| JP | 2000076372 | | 3/2000 |
| JP | 2000-103129 | A | 4/2000 |
| JP | 2000-103131 | A | 4/2000 |
| JP | 3031439 | | 4/2000 |
| JP | 2000-135843 | A | 5/2000 |
| JP | 2000-198258 | A | 7/2000 |
| JP | 2000211193 | | 8/2000 |
| JP | 2000229750 | | 8/2000 |
| JP | 2001-011594 | A | 1/2001 |
| JP | 2001-048389 | A | 2/2001 |
| JP | 2001-121797 | A | 5/2001 |
| JP | 3207860 | B2 | 9/2001 |
| JP | 2001-310540 | A | 11/2001 |
| JP | 2001-319447 | A | 11/2001 |
| JP | 2002-042441 | A | 2/2002 |
| JP | 3266739 | B2 | 3/2002 |
| JP | 2002-104568 | A | 4/2002 |
| JP | 2002103762 | | 4/2002 |
| JP | 2002-179300 | A | 6/2002 |
| JP | 2002166605 | | 6/2002 |
| JP | 2002166606 | | 6/2002 |
| JP | 2002167084 | | 6/2002 |
| JP | 2002-192769 | A | 10/2002 |
| JP | 2002-308481 | A | 10/2002 |
| JP | 2002-308518 | A | 10/2002 |
| JP | 2002-367333 | A | 12/2002 |
| JP | 3357128 | B2 | 12/2002 |
| JP | 2003011454 | | 1/2003 |
| JP | 2003026164 | | 1/2003 |
| JP | 2003-048337 | A | 2/2003 |
| JP | 3378622 | | 2/2003 |
| JP | 2003506235 | | 2/2003 |
| JP | 2003072127 | | 3/2003 |
| JP | 2003-251902 | A | 9/2003 |

(56) References Cited

FOREIGN PATENT DOCUMENTS

| | | | |
|---|---|---|---|
| JP | 2003-251904 | A | 9/2003 |
| JP | 2003251904 | | 9/2003 |
| JP | 2003-285522 | A | 10/2003 |
| JP | 2004018077 | | 1/2004 |
| JP | 2004-155150 | A | 6/2004 |
| JP | 3543659 | B2 | 7/2004 |
| JP | 3564848 | B2 | 9/2004 |
| JP | 2004255656 | | 9/2004 |
| JP | 2004-291591 | A | 10/2004 |
| JP | 2004-323241 | A | 11/2004 |
| JP | 3106187 | | 12/2004 |
| JP | 2005059504 | | 3/2005 |
| JP | 2005-088597 | A | 4/2005 |
| JP | 2005178206 | | 7/2005 |
| JP | 2005-231203 | A | 9/2005 |
| JP | 2005-280008 | A | 10/2005 |
| JP | 2005-297348 | A | 10/2005 |
| JP | 2005298031 | | 10/2005 |
| JP | 2006021432 | | 1/2006 |
| JP | 2006-096030 | A | 4/2006 |
| JP | 2006-512224 | A | 4/2006 |
| JP | 2006-142835 | A | 6/2006 |
| JP | 2006-168974 | A | 6/2006 |
| JP | 2006-182034 | A | 7/2006 |
| JP | 2006-240310 | A | 9/2006 |
| JP | 2006-248059 | A | 9/2006 |
| JP | 2006-272895 | A | 10/2006 |
| JP | 2006-272977 | A | 10/2006 |
| JP | 2006-289991 | A | 10/2006 |
| JP | 2006264337 | | 10/2006 |
| JP | 2007-196654 | A | 8/2007 |
| JP | 2007-230155 | A | 9/2007 |
| JP | 2007268815 | | 10/2007 |
| JP | 2007-296863 | A | 11/2007 |
| JP | 4003068 | B2 | 11/2007 |
| JP | 4061507 | B2 | 3/2008 |
| JP | 2008062474 | A | 3/2008 |
| JP | 2008-080668 | A | 4/2008 |
| JP | 2008-083432 | A | 4/2008 |
| JP | 2008-509823 | A | 4/2008 |
| JP | 2008-229855 | A | 10/2008 |
| JP | 2008-254384 | | 10/2008 |
| JP | 2008-279678 | A | 11/2008 |
| JP | 2008265180 | A | 11/2008 |
| JP | 2008279678 | | 11/2008 |
| JP | 2008307703 | | 12/2008 |
| JP | 2009001020 | | 1/2009 |
| JP | 2009-028976 | A | 2/2009 |
| JP | 2009-509812 | A | 3/2009 |
| JP | 2009-184832 | A | 8/2009 |
| JP | 2009-215083 | A | 9/2009 |
| JP | 2009214431 | | 9/2009 |
| JP | 4571626 | B2 | 10/2010 |
| JP | 2011-011407 | A | 1/2011 |
| JP | 2011-110843 | A | 6/2011 |
| JP | 2011-110845 | A | 6/2011 |
| JP | 2011-110848 | A | 6/2011 |
| KR | 2007-0091073 | A | 9/2007 |
| RU | 2297333 | C2 | 4/2007 |
| TW | 200827179 | A | 7/2008 |
| WO | 96/16812 | A1 | 6/1996 |
| WO | 00/32401 | A1 | 6/2000 |
| WO | 01/10649 | | 2/2001 |
| WO | 03/080350 | A1 | 10/2003 |
| WO | 2004/058509 | A1 | 7/2004 |
| WO | 2005101306 | A1 | 10/2005 |
| WO | 2005/120844 | A1 | 12/2005 |
| WO | 2006/013466 | | 2/2006 |
| WO | 2006/033431 | | 2/2006 |
| WO | 2006/024913 | A2 | 3/2006 |
| WO | 2006033432 | A1 | 3/2006 |
| WO | 2006/090842 | A1 | 8/2006 |
| WO | 2008/029931 | A1 | 3/2008 |
| WO | 2009/107534 | A1 | 9/2009 |
| WO | 2010113445 | A1 | 10/2010 |
| WO | 2010113782 | | 10/2010 |

OTHER PUBLICATIONS

NZ Examination Report of NZ 596044 dated Sep. 28, 2012.
Japanese Office Action of JP 2009-270056 dated Nov. 13, 2012.
Japanese Office Action of JP 2009-297502 dated Nov. 13, 2012.
Japanese Office Action in JP 2009-086239 on May 8, 2012.
Japanese Office Action in JP 2009-086222 on Jun. 12, 2012.
International Preliminary Report on Patentability in PCT/JP2010/055310 in Apr. 11, 2012.
Japanese Office Action of JP 2010-084500 dated Jul. 13, 2012.
Japanese Office Action of JP 2010-084501 dated Jul. 3, 2012.
Japanese Office Action of JP 2010-084502 dated Jul. 3, 2012.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.
Japanese Office Action issued in Japanese Application No. 2011-506968 on Jan. 29, 2013.
Japanese Office Action of JP 2010-084500 dated Jul. 3, 2012.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
Chinese Office Action issued in Chinese Application No. 201080013099.9 on Apr. 15, 2013.
Japanese Office Action issued in Japanese Application No. 2009-156398 on Apr. 2, 2013.
Japanese Office Action issued in Japanese Application No. 2009-156403 on Apr. 2, 2013.
Japanese Office Action issued in Japanese Application No. 2009-156281 on Apr. 2, 2013.
Japanese Office Action issued in Japanese Application No. 2009-156355 on Apr. 2, 2013.
Japanese Office Action issued in Japanese Application No. 2009-156399 on Apr. 2, 2013.
Japanese Office Action issued in Japanese Application No. 2009-156404 on Apr. 2, 2013.
Japanese Office Action issued in Japanese Application No. 2009-156350 on Apr. 2, 2013.
Japanese Office Action issued in Japanese Application No. 2009-156357 on Apr. 2, 2013.
Japanese Office Action issued in Japanese Application No. 2009-156371 on Apr. 2, 2013.
Japanese Office Action issued in Japanese Application No. 2009-270325 on Apr. 2, 2013.
Chinese Office Action issued in Chinese Application No. 200980158165.9 on Mar. 8, 2013.
New Zealand Office Action issued in Application No. 596044 on Sep. 25, 2013.
Chinese Office Action issued in Application No. 201010150928 on Sep. 3, 2013.
U.S. Office Action issued in U.S. Appl. No. 13/240,266 on Oct. 16, 2013.
Chinese Office Action issued in Application No. 201010150090.4 on Sep. 26, 2013.
Chinese Office Action issued in Application No. 201010150109.5 on Sep. 22, 2013.
Extended European Search Report issued in Application No. 09842716.4 on Nov. 6, 2013.
Chinese Office Action issued in Application No. 201010150088.7 on Sep. 30, 2013.
Chinese Office Action issued in Application No. 200980158165.9 on Oct. 28, 2013.
Extended European Search Report issued in Application No. 10758310.6 on Nov. 12, 2013.

(56) References Cited

OTHER PUBLICATIONS

U.S. Office Action issued in U.S. Appl. No. 13/240,216 on Nov. 13, 2013.
Japanese Office Action issued in Japanese Application 2010-73748 on Apr. 23, 2013.
Japanese Office Action issued in Japanese Application 2010-73750 on Apr. 23, 2013.
Chinese Office Action issued in Chinese Application No. 200910262677.1 on May 2, 2013.
Chinese Office Action issued in Chinese Application No. 200910262679.0 on May 2, 2013.
Chinese Office Action issued in Chinese Application No. 200910262680.3 on May 2, 2013.
Chinese Office Action issued in Chinese Application No. 200980161443.6 on Jun. 4, 2013.
Chinese Office Action issued in Chinese Application No. 200910262675.2 on Aug. 7, 2013.
Chinese Office Action issued in Chinese Application No. 201080013339.5 on Aug. 22, 2013.
Japanese Office Action issued in Japanese Application No. 2010-073747 on May 14, 2013.
Japanese Office Action issued in Japanese Application No. 2010-073749 on May 21, 2013.
Japanese Office Action issued in Japanese Application No. 2010-073755 on May 21, 2013.
Japanese Office Action issued in Japanese Application No. 2010-073751 on May 28, 2013.
Japanese Office Action issued in Japanese Application No. 2010-073754 on Jun. 4, 2013.
Japanese Office Action issued in Japanese Application No. 2009-156281 on Jul. 2, 2013.
Japanese Office Action issued in Japanese Application No. 2009-156350 on Jul. 2, 2013.
Japanese Office Action issued in Japanese Application No. 2011-547222 on Oct. 1, 2013.
Japanese Office Action issued in Japanese Application No. 2011-507143 on Sep. 3, 2013.
U. S. Office Action issued in U.S. Appl. No. 12/817,556 on Jul. 16, 2013.
New Zealand Office Action issued in New Zealand Application No. 596044 on Jul. 10, 2013.
New Zealand Office Action issued in New Zealand Application No. 596044 on Sep. 25, 2013.
U.S. Office Action issue in U.S. Appl. No. 13/934,512 on Nov. 19, 2013.
Japanese Office Action issue in Application No. 2011-507142 on Nov. 26, 2013.
European Office Action issued in Application No. 10711776.4 on Nov. 22, 2013.
New Zealand Office Action issue in Application No. 596044 on Nov. 8, 2013.
Japanese Office Action issue in Application No. 2011-507049 on Dec. 3, 2013.
Chinese Office Action issue in Application No. 200980161405.0 on Nov. 1, 2013.
Notice of Allowance issued in corresponding U.S. Appl. No. 12/732,747 mailed Feb. 19, 2014.
Notice of Allowance issued in corresponding U.S. Appl. No. 12/732,404 mailed Feb. 4, 2014.
Notice of Allowance issued in corresponding U.S. Appl. No. 12/732,828 mailed Jan. 27, 2014.
Notice of Allowance issued in corresponding U.S. Appl. No. 12/644,451 mailed Feb. 24, 2014.
May 21, 2014 (EP) Extended European Search Report issued in European Application No. 10758552.3.
May 6, 2014 (CN) Chinese Office Action issued in Chinese Application No. 201010150087.2.
May 6, 2014 (CN) Chinese Office Action issued in Chinese Application No. 201010150878.5.
May 13, 2014 (CN) Chinese Office Action issued in Chinese Application No. 201080013339.5.
Apr. 25, 2014 (MX) Mexican Office Action issued in Mexican Application No. MX/a/2011/013553.
Jun. 10, 2014 (JP) Japanese Office Action issued Japanese Application No. 2013-142488.
Jun. 24, 2014 (JP) Japanese Office Action issued Japanese Application No. 2013-153250.
Jun. 24, 2014 (JP) Japanese Office Action issued Japanese Application No. 2013-153340.
Office Action issued in Chinese Patent Application 201010274378.2 dated Jan. 22, 2014.
Extended European Search Report issued Dec. 16, 2013 in EP App. No. 12160324.5.
Extended European Search Report issued Dec. 18, 2013 in EP App. No. 12160192.6.
Extended European Search Report issued Dec. 20, 2013 in EP App. No. 12161271.7.
Office Action issued Dec. 19, 2013 in Chinese Application No. 200910262674.8.
Office Action issued Jan. 17, 2014 in Chinese Application No. 201210071810.7.
Office Action issued Jan. 3, 2014 in Australian Application No. 2010231426.
Office Action issued Dec. 30, 2013 in Chinese Application No. 201010209208.6.
Office Action issued Dec. 30, 2013 in Chinese Application No. 201210070147.9.
Extended European Search Report issued Feb. 5, 2014 in EP App. No. 09852818.5.
Final Office Action received in corresponding U.S. Appl. No. 12/732,457 mailed Mar. 26, 2014.
Final Office Action issued Dec. 23, 2013 in U.S. Appl. No. 13/431,350.
Jul. 7, 2014 (US) Final Office Action issued in U.S. Appl. No. 13/430,080.
Jul. 22, 2014 (US) Non-Final Office Action issued in U.S. Appl. No. 12/732,257.
Jul. 18, 2014 (US) Non-Final Office Action issued in U.S. Appl. No. 13/431,350.
Jul. 8, 2014 (JP) Office Action issued in Japanese Patent Application No. 2013-153421.
Jul. 8, 2014 (JP) Office Action issued in Japanese Patent Application No. 2013-153495.
Jun. 27, 2014 (AU) Office Action issued in Australian Patent Application No. 2010231426.
Jun. 2, 2014 (AU) Office action issued in Australian Patent Application No. 2010231425.
Jul. 8, 2014 (CA) Office Action issued in Canadian Patent Application No. 2,755,882.
Jun. 20, 2014 (CN) Office action issued in Chinese Patent Application No. 201210070147.
Jun. 26, 2014 (CN) Office action issued in Chinese Patent Application No. 200980161405.
Nov. 15, 2011 (PCT) International Preliminary Report on Patentability issued in PCT/JP2009/071568.
Nov. 15, 2011 (PCT) International Preliminary Report on Patentability issued in PCT/JP2010/055324.
Nov. 15, 2011 (PCT) International Preliminary Report on Patentability issued in PCT/JP2010/055326.
Nov. 15, 2011 (PCT) International Preliminary Report on Patentability issued in PCT/JP2010/050253.
Nov. 15, 2011 (JP) Office Action issued in Japanese Patent Application No. 2009-088241.
May 20, 2010 (PCT) International Search Report in International Application No. PCT/JP2009/007086.
May 20, 2010 (PCT) International Search Report in International Application No. PCT/JP2009/007085.
Jul. 30, 2010 (PCT) International Search Report in International Application No. PCT/JP2010/002169.
Jul. 30, 2010 (PCT) International Search Report in International Application No. PCT/JP2010/002165.

(56) References Cited

OTHER PUBLICATIONS

Mar. 23, 2010 (PCT) International Search Report in International Application No. PCT/JP2009/071568.
May 21, 2010 (PCT) International Search Report in International Application No. PCT/JP2009/007089.
Jun. 22, 2010 (PCT) International Search Report in International Application No. PCT/JP2010/055324.
Jun. 22, 2010 (PCT) International Search Report in International Application No. PCT/JP2010/055326.
Mar. 16, 2010 (PCT) International Search Report in International Application No. PCT/JP2010/050253.
May 20, 2010 (PCT) International Search Report in International Application No. PCT/JP2009/007087.
Mar. 5, 2010 (PCT) International Search Report in International Application No. PCT/JP2009/007088.
Aug. 3, 2010 (PCT) International Search Report in International Application No. PCT/JP2010/002154.
Aug. 3, 2010 (PCT) International Search Report in International Application No. PCT/JP2010/002161.
Jun. 22, 2010 (PCT) International Search Report in International Application No. PCT/JP2010/055305.
Aug. 24, 2010 (PCT) International Search Report in International Application No. PCT/JP2010/004076.
Jun. 22, 2010 (PCT) International Search Report in International Application No. PCT/JP2010/055311.
Jun. 22, 2010 (PCT) International Search Report in International Application No. PCT/JP2010/055310.
Jun. 28, 2010 (PCT) International Search Report in International Application No. PCT/JP2010/002170.
Mar. 23, 2010 (PCT) International Search Report in International Application No. PCT/JP2009/070971.
May 21, 2010 Extended European Search Report in European Patent Application No. 09180351.
Jul. 2, 2010 Extended European Search Report in European Patent Application No. 10157994.
Jul. 12, 2010 Extended European Search Report in European Patent Application No. 10158024.
Oct. 12, 2010 Extended European Search Report in European Patent Application No. 10155348.
May 21, 2010 Extended European Search Report in European Patent Application No. 09180354.
Dec. 3, 2010 Extended European Search Report in European Patent Application No. 10175769.
Oct. 11, 2011 (JP) Office Action issued in Japanese Patent Application No. 2008-331634.
Oct. 11, 2011 (JP) Office Action issued in Japanese Patent Application No. 2009-088440.
Oct. 11, 2011 (JP) Office Action issued in Japanese Patent Application No. 2009-088227.
Oct. 11, 2011 (JP) Office Action issued in Japanese Patent Application No. 2009-088238.
Oct. 11, 2011 (JP) Office Action issued in Japanese Patent Application No. 2009-088441.
Oct. 11, 2011 (JP) Office Action issued in Japanese Patent Application No. 2009-088460.
Jan. 17, 2012 (JP) Office Action issued in Japanese Patent Application No. 2009-088456.
Mar. 16, 2010 (PCT) International Search Report and Written Opinion issued in International Application No. PCT/JP2009/071812.
Non-Final Office Action received in corresponding U.S. Appl. No. 13/430,080 mailed Mar. 10, 2014.
Notice of Allowance issued in corresponding U.S. Appl. No. 13/240,266 mailed Mar. 27, 2014.
Notice of Allowance issued in corresponding U.S. Appl. No. 12/644,572 mailed Apr. 11, 2014.
Final Office Action received in corresponding U.S. Appl. No. 13/240,216 mailed May 7, 2014.
Notice of Allowance issued in U.S. Appl. No. 13/934,512 mailed May 6, 2014.
Non-Final Office Action received in corresponding U.S. Appl. No. 14/226,256 mailed May 22, 2014.
Office Action issued Apr. 1, 2014 in Japanese Application No. 2013-035990.
Office Action issued Mar. 13, 2014 in Chinese Application No. 201010150928.
Office Action issued Apr. 15, 2014 in Australian Application No. 2009332345.
Office Action issued Apr. 1, 2001 in Chinese Application No. 20101015019.
Office Action issued Apr. 2, 2014 in Chinese Application No. 201210070968.
Office Action issued Apr. 17, 2014 in Russian Application No. 2011143817.
Office Action issued May 9, 2014 in Vietnamese Application No. 1-2011-02491.
Jul. 25, 2014—(CN) Notice of Second Office Action—App 201010150090.4—Eng Tran.
14 Jul. 28—(CN) Notice of Second Office Action—App 201010150088.7—Eng Tran.
Aug. 12, 2014—(CN) Notice of Second Office Action—App 201210071810.7—Eng Tran.
Aug. 26, 2014—(CN) Notice of Second Office Action—App 201010274378.2—Eng Tran.
Sep. 24, 2014—(JP) Notification of Rejection—App 2013-142488—Eng Tran.
Aug. 28, 2014—(US) Non-Final Office Action—U.S. Appl. No. 13/240,216.
Oct. 2, 2014—(US) Non-Final Office Action—U.S. Appl. No. 13/430,033.
Sep. 2, 2014—(US) Non-Final Office Action—U.S. Appl. No. 14/226,165.
Sep. 9, 2014—(US) Non-Final Office Action—U.S. Appl. No. 14/226,380.
Sep. 9, 2014—(US) Non-Final Office Action—U.S. Appl. No. 14/226,417.
Sep. 10, 2014—(US) Notice of Allowance—U.S. Appl. No. 13/934,512.
Sep. 11, 2014—(US) Non-Final Office Action—U.S. Appl. No. 13/848,750.
Sep. 12, 2014—(US) Non-Final Office Action—U.S. Appl. No. 14/226,386.
Sep. 22, 2014—(US) Non-Final Office Action—U.S. Appl. No. 14/141,673.
Sep. 24, 2014—(US) Notice of Allowance—U.S. Appl. No. 13/431,277.
Sep. 25, 2014—(US) Non-Final Office Action—U.S. Appl. No. 14/226,424.
Dec. 5, 2014—(US) Non-Final Office Action—U.S. Appl. No. 14/226,325.
Dec. 1, 2014—(US) Non-Final Office Action—U.S. Appl. No. 14/226,289.
Nov. 4, 2014—(US) Non-Final Office Action—U.S. Appl. No. 14/226,367.
Nov. 4 2014—(US) Non-Final Office Action—U.S. Appl. No. 14/226,428.
Nov. 5, 2014—(US) Non-Final Office Action—U.S. Appl. No. 14/226,373.
Nov. 25, 2014—(US) Notice of Allowance—U.S. Appl. No. 13/934,512.
Oct. 10, 2014—(US) Notice of Allowance—U.S. Appl. No. 12/732,457.
Oct. 27, 2014—(US) Non-Final Office Action—U.S. Appl. No. 14/141,576.
Oct. 30, 2014 (US) Final Office Action—U.S. Appl. No. 14/226,256.
Dec. 16, 2014—(US) Notice of Allowance—U.S. Appl. No. 13/240,216.
Feb. 6, 2015—(EP) Extended Search Report—App. 14189221.6.
Jan. 29, 2015—(TW) Office Action—App 099132599.
Jan. 23, 2015 (AU) Office Action in Application No. 2010231426.
Mar. 6, 2015 (AU) Office Action in Application No. 2010231425.
Mar. 10, 2015 (JP) Office Action in Application No. 2014-095027.
Mar. 12, 2015 (EP) Search Report in Application No. 14156840.2.

(56) References Cited

OTHER PUBLICATIONS

Feb. 19, 2015 (CA) Office Action in Application No. 2755885.
Mar. 2, 2015 (TW) Office Action in Application No. 101110368.
Mar. 8, 2013 (CN) Office Action issued in Chinese Patent Application No. 200980158165.9.
Feb. 12, 2015—(US) Final Office Action—U.S. Appl. No. 12/732,257.
Feb. 12, 2015—(US) Final Office Action—U.S. Appl. No. 13/431,350.
Feb. 12, 2015—(US) Final Office Action—U.S. Appl. No. 14/226,417.
Feb. 17, 2015—(US) Final Office Action—U.S. Appl. No. 14/141,673.
Mar. 4, 2015—(US) Final Office Action—U.S. Appl. No. 14/141,576.
Mar. 4, 2015—(US) Non-Final Office Action—U.S. Appl. No. 14/226,386.
Mar. 6, 2015—(US) Final Office Action—U.S. Appl. No. 14/226,424.
Mar. 17, 2015 (US) Notice of Allowance—U.S. Appl. No. 13/848,750.
Apr. 1, 2015—(US) Notice of Allowance—U.S. Appl. No. 12/732,457.
Apr. 1 2015—(US) Notice of Allowance—U.S. Appl. No. 13/430,033.
Apr. 10, 2015—(US) Non-Final Office Action—U.S. Appl. No. 13/430,080.
Apr. 9, 2015—(US) Notice of Allowance—U.S. Appl. No. 13/431,277.
Mar. 13, 2015 (US) Notice of Allowance in Application No. 14226165.
Mar. 23, 2015 (US) Notice of Allowance in Application No. 13934512.
Apr. 14, 2015—(US) Notice of Allowance—U.S. Appl. No. 13/240,266.
Apr. 9, 2015—(US) Non-Final Office Action—U.S. Appl. No. 14/641,681.
Apr. 17, 2015—(US) Final Office Action—U.S. Appl. No. 14/226,367.
Apr. 21, 2015—(US) Final Office Action—U.S. Appl. No. 14/226,428.
May 1, 2015—(US) Notice of Allowance—U.S. Appl. No. 12/644,572.
May 6, 2015—(US) Final Office Action—U.S. Appl. No. 14/226,259.
May 6, 2015 (US) Final Office Action—U.S. Appl. No. 14/226,373.
Apr. 20, 2015 (AU) Office Action in Application No. 2010231426.
Apr. 7, 2015 (TW) Office Action in Application No. 99132600.
Apr. 2, 2015 (EP) Office Action in Application No. 10711776.4.
May 19, 2015—(US) Final Office Action—U.S. Appl. No. 14/226,289.
May 19, 2015—(US) Notice of Allowance—U.S. Appl. No. 14/226,201.
May 20, 2015—(US) Notice of Allowance—U.S. Appl. No. 13/848,750.
May 22, 2015—(US) Non-Final Office Action—U.S. Appl. No. 12/732,257.
May 29, 2015—(US) Notice of Allowance—U.S. Appl. No. 14/226,165.
Jun. 2, 2015—(US) Final Office Action—U.S. Appl. No. 14/226,262.
Jun. 5, 2015—(US) Notice of Allowance—U.S. Appl. No. 14/226,380.
Jun. 2, 2015—(US) Non-Final Office Action—U.S. Appl. No. 14/226,256.
Jun. 17, 2015—(US) Final Office Action—U.S. Appl. No. 14/226,325.
Jun. 18, 2015—(US) Notice of Allowance—U.S. Appl. No. 12/732,457.
Feb. 13, 2015—(US) Non-Final Office Action—U.S. Appl. No. 13/240,322.
Apr. 13, 2015—(CN) Notification of Third Office Action—App 201210071810.7—Eng. Tran.
Apr. 9, 2015—(TW) Office Action—App 099132598—Eng. Tran.
May 26, 2015—(CN) Office Action—App 201310659625.4.
Dec. 16, 2014—(US) Non-Final Office Action—U.S. Appl. No. 14/226,259.
Jan. 2, 2015—(US) Non-Final Office Action—U.S. Appl. No. 14/226,262.
Jan. 5, 2015—(US) Non-final Office Action—U.S. Appl. No. 14/226,201.
Jan. 22, 2015—(US) Notice of Allowance—U.S. Appl. No. 12/732,457.
Jan. 16, 2015—(US) Non-Final Office Action—U.S. Appl. No. 14/226,402.
Jan. 28, 2015—(US) Notice of Allowance—U.S. Appl. No. 13/431,277.
Nov. 12, 2014 (MX) Office Action in Application No. MX/a/2011/013553.
Dec. 26, 2014—(CN) Office Action in Application No. 201080013339.5.
Jan. 22, 2015—(US) Non-Final Office Action—U.S. Appl. No. 14/226,411.
Feb. 10, 2015—(US) Notice of Allowance—U.S. Appl. No. 14/226,380.
Jun. 25, 2015—(US) Non-Final Office Action—U.S. Appl. No. 13/431,350.
May 29, 2015—(MY) Substantive Examination Adverse Report—App. PI 2013702520—Eng Tran.
Jun. 1, 2015—(CN) Notification of First Office Action—App 201310717842.4—Eng Tran.
Jun. 1, 2015—(CN) Notification of First Office Action—App 201310717871.0—Eng Tran.
Jul. 7, 2015—(US) Notice of Allowance—U.S. Appl. No. 14/141,673.
Jul. 16, 2015—(US) Non-Final Office Action—U.S. Appl. No. 14/226,417.
Jun. 19, 2015 (CN) Notification of First Office Action—App 201310659875.8—Eng Tran.
Aug. 4, 2015—(US) Notice of Allowance—U.S. Appl. No. 14/141,576.
Jul. 31, 2015—(US) Final Office Action—U.S. Appl. No. 14/226,411.
Aug. 6, 2015—(CN) Office Action—App 201410046812.X—Eng Tran.
Aug. 11, 2015—(AU) Patent Examination Report 1—App 2014221250.
Aug. 24, 2015—(US) Final Office Action—U.S. Appl. No. 14/226,402.
Sep. 1, 2015—(US) Notice of Allowance—U.S. Appl. No. 14/226,259.
Sep. 8, 2015—(JP) Office Action—App 2014-210427—Eng Tran.
Sep. 8, 2015—(US) Notice of Allowance—U.S. Appl. No. 14/141,673.
Sep. 9, 2015—(US) Final Office Action—U.S. Appl. No. 14/226,386.
Sep. 17, 2015—(US) Non-Final Office Action—U.S. Appl. No. 14/226,424.
Sep. 18, 2015—(US) Non-Final Office Action—U.S. Appl. No. 14/226,428.
Oct. 1, 2015 (US) Notice of Allowance—U.S. Appl. No. 12/732,457.
Oct. 5, 2015—(US) Notice of Allowance—U.S. Appl. No. 12/644,572.
Oct. 5, 2015—(US) Notice of Allowance—U.S. Appl. No. 14/141,673.
Oct. 7, 2015—(US)—Final Office Action—U.S. Appl. No. 13/240,322.
Oct. 13, 2015—(US) Notice of Allowance—U.S. Appl. No. 13/430,033.
Oct. 20, 2015—(US) Notice of Allowance—U.S. Appl. No. 14/226,201.
Oct. 22, 2015—(US) Final Office Action—U.S. Appl. No. 14/641,681.

(56) References Cited

OTHER PUBLICATIONS

Sep. 2, 2015—(CN) Notification of First Office Action—App 201410200475.5.
Oct. 23, 2015—(US) Final Office Action—U.S. Appl. No. 13/431,350.
Oct. 26, 2015—(US)—Non-Final Office Action—U.S. Appl. No. 14/643,865.
Oct. 30, 2015—(US)—Non-Final Office Action—U.S. Appl. No. 14/226,373.
Nov. 3, 2015—(US) Notice of Allowance—U.S. Appl. No. 14/226,259.
Nov. 9, 2015—(US) Notice of Allowance—U.S. Appl. No. 13/848,750.
Nov. 13, 2015—(US) Non-Final Office Action—U.S. Appl. No. 14/226,289.
Nov. 25, 2015—(US) Final Office Action—U.S. Appl. No. 14/226,256.
Nov. 27, 2015—(US) Notice of Allowance—U.S. Appl. No. 14/226,367.
Dec. 4, 2015—(US) Notice of Allowance—U.S. Appl. No. 14/226,325.
Dec. 10, 2015—(US)—Non Final Office Action—U.S. Appl. No. 14/755,141.
Nov. 20, 2015—(KR) Office Action—App 10-2015-7006347.
Nov. 20, 2015—(KR) Office Action—App 10-2011-7017238.
Nov. 27, 2015—(CN) Office Action—App 201410311930.9.
Dec. 3, 2015—(CN) Office Action—App 201510088644.5.
Dec. 11, 2015—(US) Notice of Allowance—U.S. Appl. No. 14/226,165.
Dec. 17, 2015—(US) Non-Final Office Action—U.S. Appl. No. 14/920,398.
Dec. 21, 2015—(US) Notice of Allowance—U.S. Appl. No. 13/934,512.
Dec. 23, 2015—(US) Final Office Action—U.S. Appl. No. 14/226,417.
Oct. 27, 2015—(CN) Office Action—App 201410195767.4.
Dec. 24, 2015—(US) Non-Final Office Action—U.S. Appl. No. 14/226,380.
Jan. 15, 2016—(US) Notice of Allowance—U.S. Appl. No. 12/732,257.
Jan. 29, 2016—(US) Notice of Allowance—U.S. Appl. No. 14/226,411.
Dec. 24, 2015—(TW) Decision of Rejection—App 101110368—Eng Tran.
Feb. 5, 2016—(US) Non-Final Office Action—U.S. Appl. No. 13/240,322.
Feb. 11, 2016—(US) Notice of Allowance—U.S. Appl. No. 14/226,402.
Feb. 12, 2016—(US) Notice of Allowance—U.S. Appl. No. 13/431,277.
Feb. 16, 2016—(US) Non-Final Office Action—U.S. Appl. No. 14/867,877.
Feb. 25, 2016—(US) Non-Final Office Action—U.S. Appl. No. 14/141,568.
Mar. 29, 2016—(US) Notice of Allowance—U.S. Appl. No. 13/431,350.

TAPE CASSETTE

CROSS-REFERENCE TO RELATED APPLICATION

This application is a divisional of U.S. Ser. No. 12/732,404 filed Mar. 26, 2010 which claims priority to Japanese Patent Application Nos. 2009-086184, 2009-086172, 2009-086201, and 2009-086222, respectively filed on Mar. 31, 2009. The disclosure of the foregoing applications is herein incorporated by reference in its entirety.

BACKGROUND

The present invention relates to a tape cassette that is removably installed in a tape printer.

Conventionally, when a box-shaped tape cassette is installed in a cassette housing portion of a tape printer, the tape cassette is vertically inserted such that the plane surfaces (that is, the top and bottom surfaces) of the tape cassette match the upwardly-opening cassette housing portion. More specifically, when a user vertically installs the box-shaped tape cassette having side surfaces with a certain height in the cassette housing portion, the user sandwiches the side surfaces with his or her fingers and maintains the plane surfaces substantially horizontal.

SUMMARY

However, it may be difficult for the user to maintain the plane surfaces substantially horizontal at the installation of the tape cassette, due to the arrangement positions of a tape and an ink ribbon housed inside the tape cassette. In such a case, the tape cassette may be inserted in the cassette housing portion in an inclined state. If printing is performed while the inclined tape cassette is installed in the tape printer, a feeding failure of the tape or ink ribbon, or a printing failure of a print head may occur.

An object of the present invention is to provide a tape cassette that can be accurately and smoothly installed in and removed from a tape printer.

Exemplary embodiments herein provide a tape cassette that includes a generally rectangular box-like housing, a first and second cavities, at least one tape, and a third cavity. The generally rectangular box-like housing has a top wall, a bottom wall, and a side wall defining a periphery of the housing. The first and second cavities extend from the bottom wall and disposed between a tape containing area and the periphery at opposite ends of a diagonal of the generally rectangular box-like housing. The tape containing area is defined within the periphery, and the diagonal connects a first corner portion and a second corner portion of the generally rectangular box-like housing. The at least one tape is wound and mounted within the housing in the tape containing area. The at least one tape includes a first tape disposed in a first area. The first tape has a hole at a center of winding, and the first area is one of two areas formed by dividing the housing with respect to a line connecting the first and second cavities. The third cavity extends in the hole of the first tape from the bottom wall.

BRIEF DESCRIPTION OF THE DRAWINGS

Exemplary embodiments of the present disclosure will be described below in detail with reference to the accompanying drawings in which.

DETAILED DESCRIPTION OF EXEMPLARY EMBODIMENTS

Figure 1:
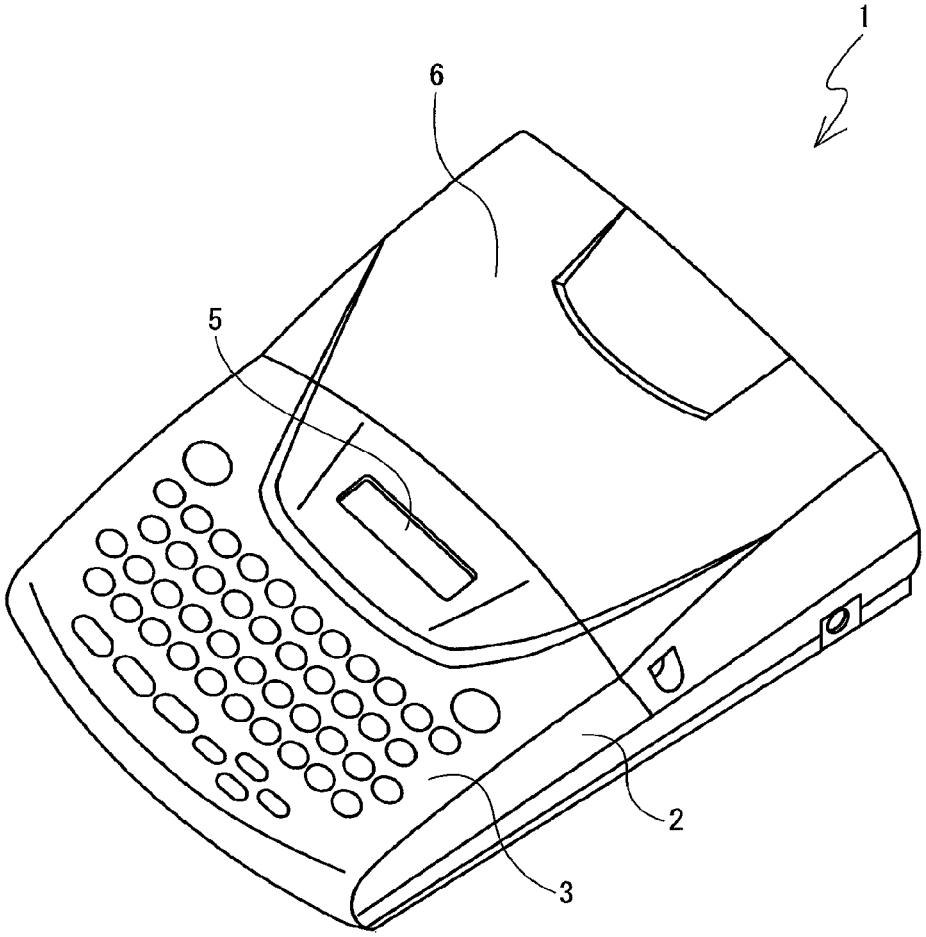
FIG. 1 is a perspective view of a tape printer 1 according to a first embodiment in a state where a cassette cover 6 is closed.

Exemplary embodiments embodying the present invention will be described below with reference to the drawings. The configurations of the apparatuses, the flowcharts of various processing and the like described below and shown in the drawings are merely exemplary and do not intend to limit the present invention.

In the following explanation, the upper side, the lower side, the lower left side, the upper right side, the lower right side and the upper left side in FIG. 1 are respectively defined as the upper side, the lower side, the front side, the rear side, the right side and the left side of a tape printer 1. In addition, the upper side, the lower side, the lower right side, the upper left side, the upper right side and the lower left side in FIG. 3 are respectively defined as the upper side, the lower side, the front side, the rear side, the right side and the left side of a tape cassette 30 (similar also in FIGS. 24, 38, 42 and 44).

Figure 3:
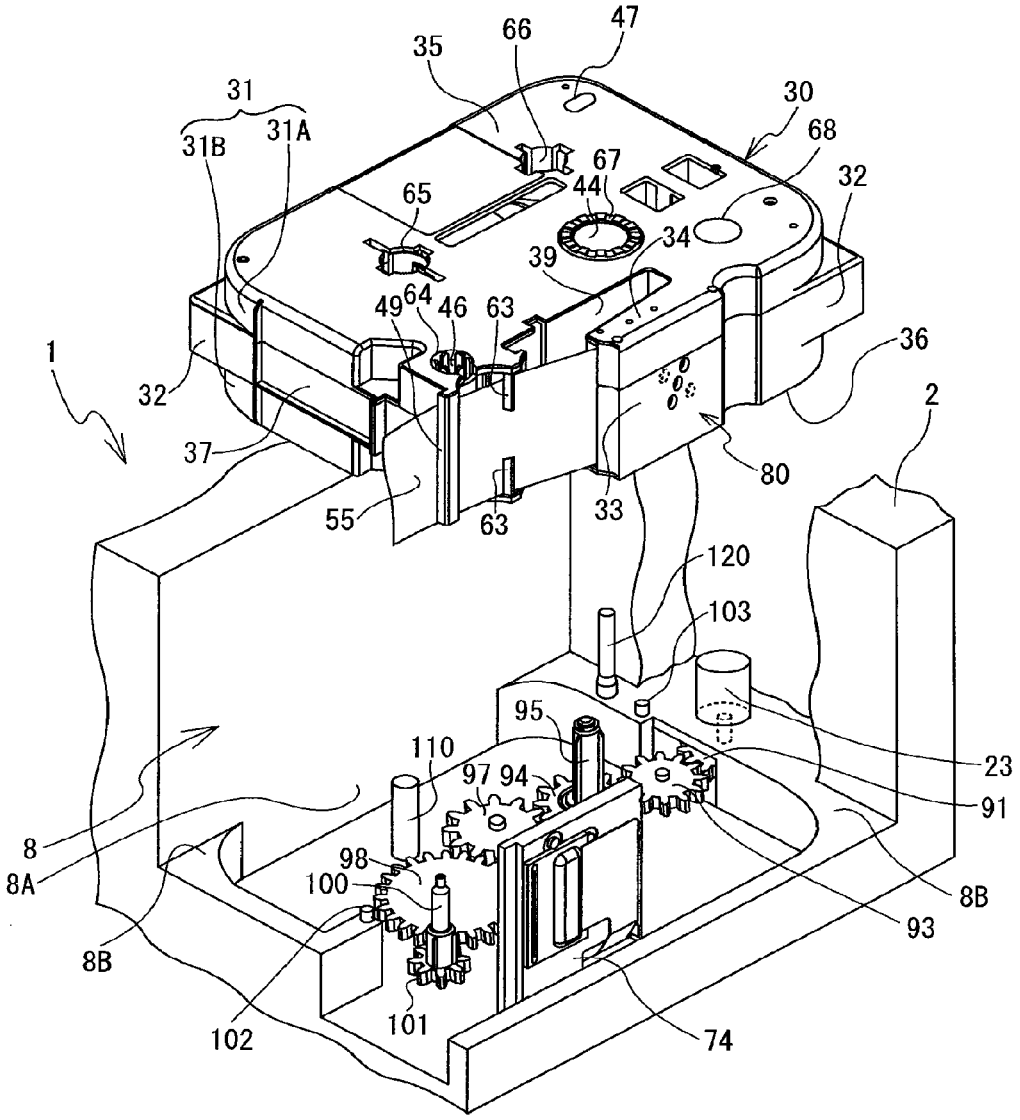
FIG. 3 is a perspective view illustrating a tape cassette 30 and a cassette housing portion 8 according to the first embodiment.
Figure 5:
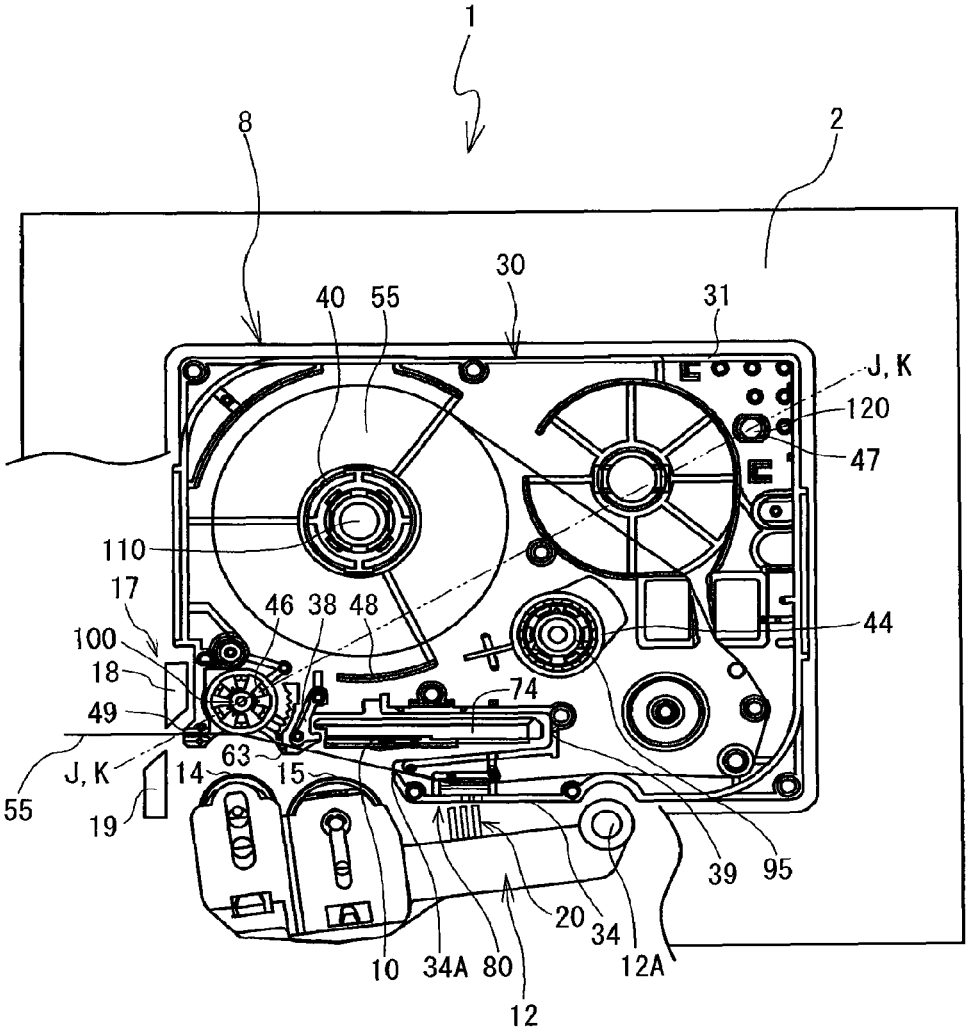
FIG. 5 is a plan view of the cassette housing portion 8 in which the tape cassette 30 is installed, when a platen holder 12 is at a standby position.
Figure 6:
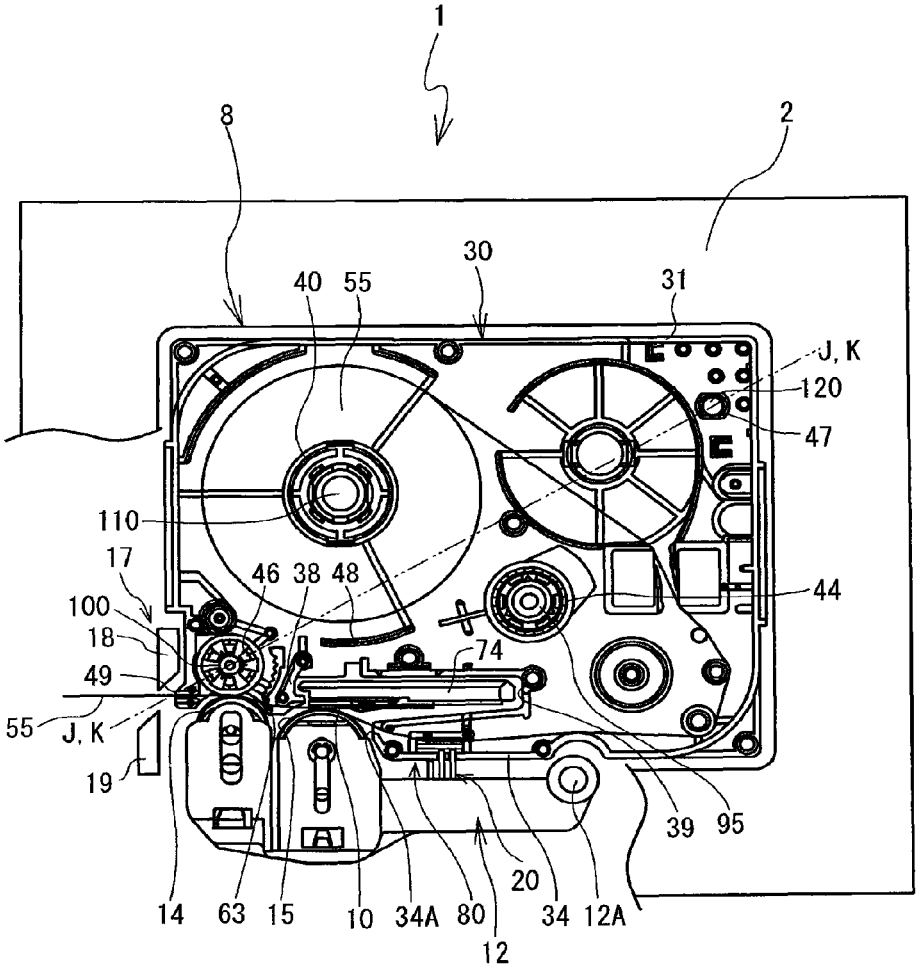
FIG. 6 is a plan view of the cassette housing portion 8 in which the tape cassette 30 is installed, when the platen holder 12 is at a print position.

In actuality, a group of gears, including gears 91, 93, 94, 97, 98 and 101 shown in FIG. 3, is covered and hidden by the bottom surface of a cavity 8A. However, the bottom surface of the cavity 8A is not shown in FIG. 3 for explaining the group of gears (similar also in FIGS. 24, 38, 42 and 44). Furthermore, FIG. 3 shows side walls that form a periphery around a cassette housing portion 8, but this is simply a schematic diagram, and the side walls shown in FIG. 3 are depicted as thicker than they are in actuality (similar also in FIG. 24). On the other hand, in FIG. 38, for ease of understanding, the cassette housing portion 8 is shown with the side walls that form the periphery thereof removed (similar also in FIGS. 42 and 44). Moreover, FIGS. 5 and 6 show the states in which the tape cassette 30 is installed in the cassette housing portion 8 with a top case 31A removed (similar also in FIGS. 21, 26, 30, 31, 32, 34, 36 and 45).

First Embodiment

A tape printer 1 and a tape cassette 30 according to a first embodiment will be explained below with reference to FIGS. 1 to 23. The first embodiment describes an example in which the tape cassette 30 houses a tape (specifically, a heat-sensitive paper tape that is a print medium) therein, and has three guide holes for guiding the tape cassette 30 when the tape cassette 30 is installed in or removed from the tape printer 1. The first embodiment also describes an example in which the tape printer 1 has three guide shafts for guiding the tape cassette 30 to a proper installation position (hereinafter referred to as a proper position) corresponding to the three guide holes described above.

First, an outline configuration of the tape printer 1 according to the first embodiment will be explained. Hereinafter, the tape printer 1 configured as a general purpose device will be explained as an example. As the general purpose device, the tape printer 1 may commonly use a plurality of types of tape cassettes 30 with various types of tapes. The types of the tape cassettes 30 may include a thermal type tape cassette 30 that houses a heat-sensitive paper tape only, a receptor type tape cassette 30 that houses a print tape and an ink ribbon, and a laminated type tape cassette 30 that houses a double-sided adhesive tape, a film tape and an ink ribbon.

Figure 2:
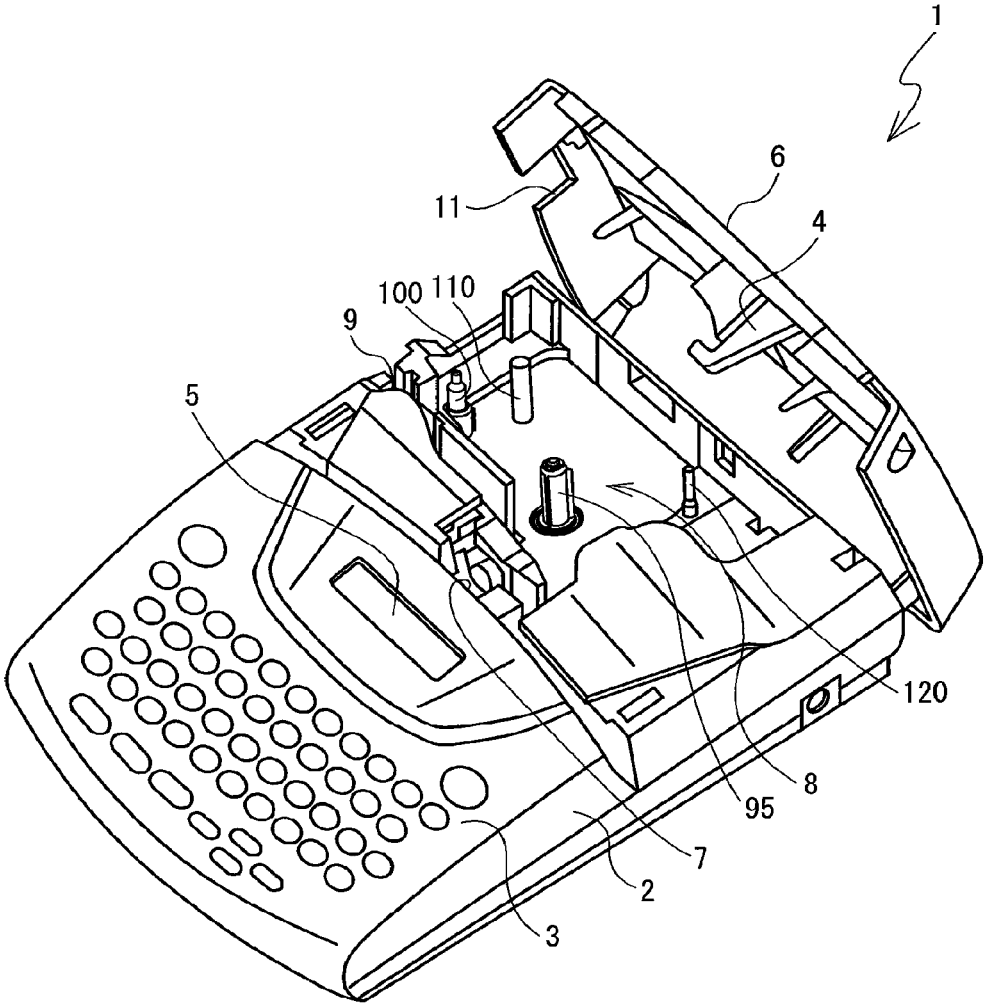
FIG. 2 is a perspective view of the tape printer 1 in a state where the cassette cover 6 is opened according to the first embodiment.

As shown in FIGS. 1 and 2, the tape printer 1 includes a main unit cover 2 that has a rectangular shape in a plan view. A keyboard 3 is provided on the front side of the main unit cover 2. The keyboard 3 includes character keys for characters (letters, symbols, numerals and so on), a variety of function keys, and so on. A liquid crystal display 5 is provided on the rear side of the keyboard 3. The liquid crystal display 5 displays input characters. A cassette cover 6 is provided on the rear side f the liquid crystal display 5. The cassette cover 6 may be opened and closed when the tape cassette 30 is replaced.

A discharge slit 9, from which the printed tape is discharged to the outside of the tape printer 1, is provided to the rear of the left side of the main unit cover 2. A discharge window 11 is formed on the left side face of the cassette cover 6 such that when the cassette cover 6 is in a closed state, the discharge slit 9 is exposed to the outside. Substantially at the center of the front face of the cassette cover 6, a hook-shaped latching lock 4, which projects downward from the lower surface of the cassette cover 6, is provided. The main unit cover 2 is provided with a lock hole 7 at a position corresponding to the latching lock 4, and the latching lock 4 is fitted and engaged with the lock hole 7 when the cassette cover 6 is closed, thereby preventing unintentional release of the cassette cover 6.

Next, an internal configuration within the main unit cover 2 will be explained with an emphasis on the cassette housing portion 8 with reference to FIGS. 2 to 7. FIGS. 3 to 6 schematically show the internal configuration within the main unit cover 2 (particularly, the shape, configuration and the like of the cassette housing portion 8) for ease of understanding. As shown in FIG. 3, the cassette housing portion 8 is provided in the interior of the main unit cover 2 below the cassette cover 6. The cassette housing portion 8 is an area which the tape cassette 30 can be installed in or removed from. The cassette housing portion 8 is equipped with a feed mechanism, a print mechanism, and the like.

As shown in FIGS. 2 to 7, a head holder 74 is fixed on the front portion of the cassette housing portion 8. A thermal head 10 including a heating element (not shown in the figures) is mounted on the head holder 74. A tape feed motor 23 that is a stepping motor is provided outside the cassette housing portion 8 (the upper right side in FIG. 3). A drive gear 91 is anchored to the lower end of a drive shaft of the tape feed motor 23. The drive gear 91 is meshed with a gear 93 through an opening, and the gear 93 is meshed with a gear 94. A ribbon take-up shaft 95 is standing upward on the upper surface of the gear 94. The ribbon take-up shaft 95 has a substantially cylindrical shape, and drives to rotate a ribbon take-up spool 44, which will be described later. The ribbon take-up shaft 95 is provided with a plurality of cam members 95A extending from the base end of the shaft toward the leading end at the outer periphery to be radial in a plan view (refer to FIG. 14).

In addition, the gear 94 is meshed with a gear 97, the gear 97 is meshed with a gear 98, and the gear 98 is meshed with a gear 101. A tape drive shaft 100 is standing upward on the upper surface of the gear 101. The tape drive shaft 100 has a substantially cylindrical shape, and drives to rotate a tape feed roller 46, which will be described later. The tape drive shaft 100 is provided with a plurality of cam members 100A extending from the base end of the shaft toward the leading end at the outer periphery to be radial in a plan view (refer to FIG. 14). An auxiliary shaft 110 is standing upward at the rear side of the gear 98. The auxiliary shaft 110 has a substantially cylindrical shape, and can be inserted in and removed from a first tape support hole 65, which will be described later.

If the tape feed motor 23 is driven to rotate in the counterclockwise direction in a state where the tape cassette 30 is installed in the cassette housing portion 8, the ribbon take-up shaft 95 is driven to rotate in the counterclockwise direction via the drive gear 91, the gear 93 and the gear 94. The ribbon take-up shaft 95 causes the ribbon take-up spool 44, which is fitted with the ribbon take-up shaft 95, to rotate. Furthermore, the rotation of the gear 94 is transmitted to the tape drive shaft 100 via the gear 97, the gear 98 and the gear 101, to thereby drive the tape drive shaft 100 to rotate in the clockwise direction. The tape drive shaft 100 causes the tape feed roller 46, which is fitted with the tape drive shaft 100 by insertion, to rotate.

Two positioning pins 102 and 103 are provided at the periphery of the cassette housing portion 8. The positioning pin 102 is provided at the left edge portion of the cassette housing portion 8 corresponding to a pin hole 53 described later formed in the bottom surface of the tape cassette 30. The positioning pin 102 defines a height position (a position in the vertical direction) and a horizontal position (a position in the horizontal direction) of the tape cassette 30 at the left edge side of the tape cassette 30 installed in the cassette housing portion 8. The positioning pin 103 is provided at the right edge portion of the cassette housing portion 8 corresponding to a common portion 32 described later positioned at the rear right side of the tape cassette 30. The positioning pin 103 defines the height position of the tape cassette 30 at the right edge side of the tape cassette 30 installed in the cassette housing portion 8.

A guide shaft 120 is standing upward at the rear right side of the cassette housing portion 8. The guide shaft 120 can be inserted in and removed from a guide hole 47, which will be described later. The guide shaft 120 is a substantially cylindrical shaft that includes two shaft portions having different diameters (a large-diameter shaft portion 120A and a small-diameter shaft portion 120B) and a taper portion 120C connecting the large-diameter shaft portion 120A and the small-diameter shaft portion 120B (refer to FIG. 14). The large-diameter shaft portion 120A forms the base end side of the guide shaft 120 and has the largest diameter in the guide shaft 120. The small-diameter shaft portion 120B forms the leading end side of the guide shaft 120 and has a smaller diameter than the large-diameter shaft portion 120A. The taper portion 120C is provided between the large-diameter shaft portion 120A and the small-diameter shaft portion 120B, and has a taper-shaped inclined surface in which the diameter is gradually reduced from the large-diameter shaft portion 120A toward the small-diameter shaft portion 120B.

The cassette housing portion 8 has an opening with a substantially rectangular shape in a plan view that substantially corresponds to the plan shape of a cassette case 31. The cassette housing portion 8 includes a cavity 8A and a cassette support portion 8B. The cavity 8A is formed as a depression that has a generally rectangular shape with rounded corners in a plan view that corresponds to the shape of a bottom surface of a cassette case 31. The cassette support portion 8B is a flat portion extending horizontally from the outer edge of the cavity 8A. The cassette support portion 8B opposes the lower surface of the common portion 32 of the tape cassette 30 installed in the cassette housing portion 8 (described later in detail).

Figure 7:
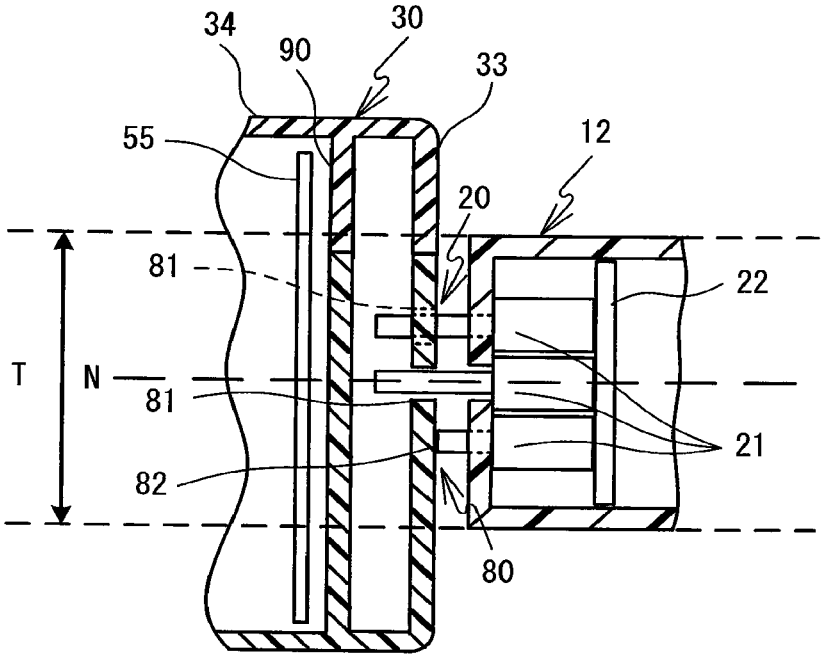
FIG. 7 is a side sectional view illustrating a state in which the tape cassette 30 and the platen holder 12 are oppositely arranged.

As shown in FIG. 7, a switch portion 20 is provided on the rear side surface of the platen holder 12 (that is, the surface opposite to the thermal head 10). The switch portion 20 includes a plurality of through-holes formed in the rear side surface of the platen holder 12, a sensor substrate 22, and a plurality of detecting switches 21 that respectively correspond to the through holes. One end of each of the detecting switches 21 is connected to the sensor substrate 22. Terminal shafts of the detecting switches 21 project rearward from the respective through-holes. The detecting switches 21 are selectively pressed by an arm indicator portion 80 of the tape cassette 30 to thereby detect a type of the tape cassette 30 installed in the cassette housing portion 8

Figure 4:
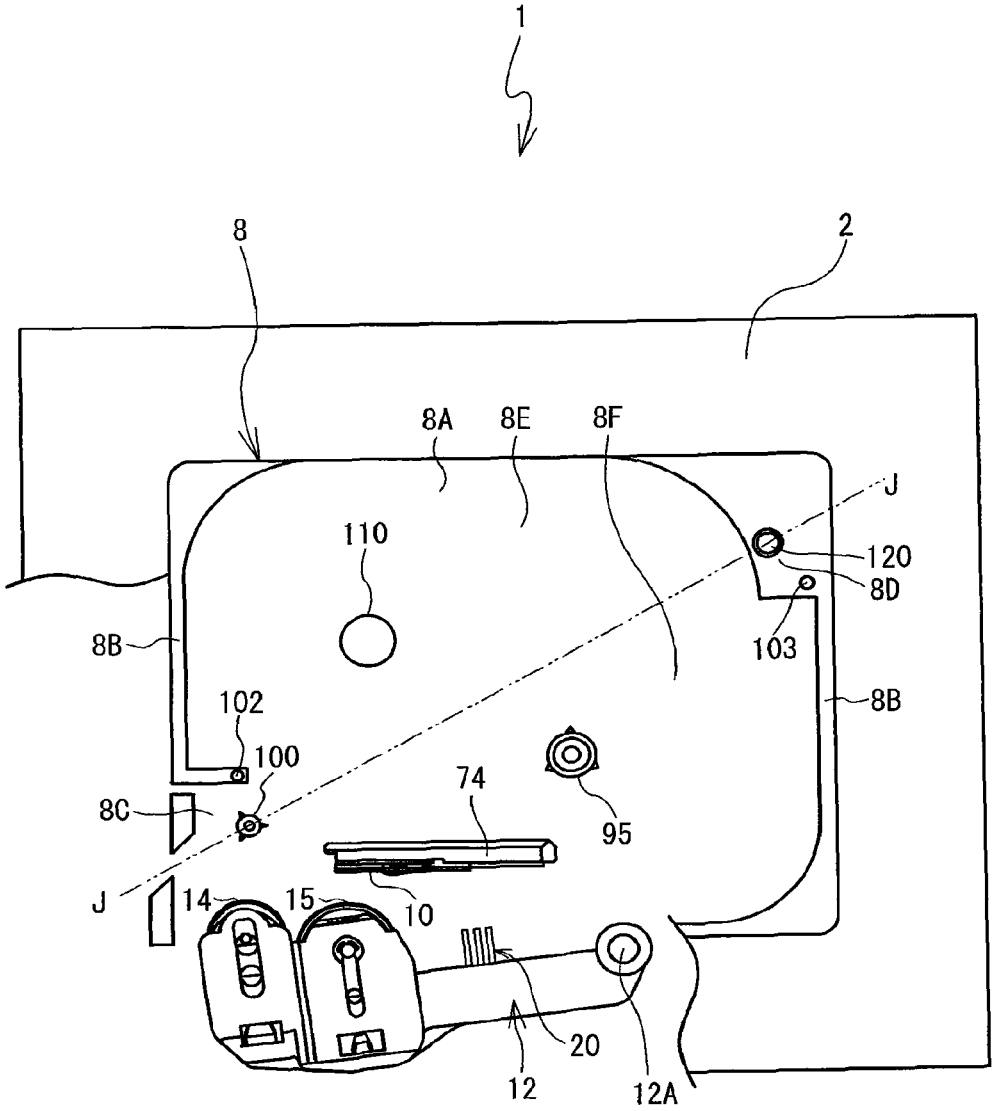
FIG. 4 is a plan view of the cassette housing portion 8 according to the first embodiment.

The positional relationships among the respective members standing upward in the cassette housing portion 8 will be explained with reference to FIG. 4. The two-dot chain line in FIG. 4 indicates a division line J described later. The tape drive shaft 100, the guide shaft 120, the auxiliary shaft 110, the ribbon take-up shaft 95, the positioning pin 102 and the head holder 74, which are described above, are provided at positions that oppose the roller support hole 64, the guide hole 47, the first tape support hole 65, the take-up spool support hole 67, the pin hole 53 and the head insertion portion 39 (all of which are described later) provided in the tape cassette 30 when the tape cassette 30 is installed in the cassette housing portion 8, respectively.

The tape drive shaft 100 is standing upward in a first shaft installation area 8C including a corner portion positioned on the front left side of the cassette housing portion 8. More specifically, nine areas can be formed if the cassette housing portion 8, which is substantially rectangular in a plan view, is divided into three parts in its front-rear direction and left-right direction, respectively. The first shaft installation area 8C is an area at the foremost and leftmost position among the nine areas. The first shaft installation area 8C is adjacent to the left side of the head holder 74 fixed on the center of the front portion of the cassette housing portion 8 and is positioned on the downstream side of the print position of the thermal head 10 in a tape feed direction described later.

The guide shaft 120 is standing upward in a second shaft installation area 8D including a corner portion positioned on the rear right side of the cassette housing portion 8. More specifically, the second shaft installation area 8D is an area at the rearmost and rightmost position among the nine areas described above. In other words, when the cassette housing portion 8 is seen in a plan view, the corner portion included in the second shaft installation area 8D is at a diagonal position with respect to the corner portion included in the first shaft installation area 8C.

When the cassette housing portion 8 is divided in a plan view with reference to the division line J connecting the tape drive shaft 100 and the guide shaft 120, two areas are formed. An area that occupies the part at the rear side of the division line J is a first installation area 8E. The other area that occupies the part at the front side of the division line J is a second installation area 8F. The auxiliary shaft 110 is standing upward in the first installation area 8E. More specifically, the auxiliary shaft 110 is positioned at the rear left side of the center of the cassette housing portion 8 in a plan view. The ribbon take-up shaft 95 is standing upward in the second installation area 8F. More specifically, the ribbon take-up shaft 95 is positioned at the front right side of the center of the cassette housing portion 8 in a plan view. The auxiliary shaft 110 and the ribbon take-up shaft 95 are positioned substantially symmetrically across the division line J in a plan view.

The positioning pin 102 is adjacently provided at the rear side of the tape drive shaft 100. The positioning pin 103 is adjacently provided at the front side of the guide shaft 120. The positioning pins 102 and 103 support the tape cassette 30 installed in the cassette housing portion 8 in the vicinity of the tape drive shaft 100 and the guide shaft 120, respectively.

The positional relationships in a plan view among the members standing upward in the cassette housing portion 8 are as described above. The height position from which each member is standing upward is different depending on whether it is standing from the cavity 8A or from the cassette support portion 8B. In other words, the members provided in the cassette support portion 8B (the guide shaft 120 and the positioning pins 102, 103) are standing upward from higher positions than the members provided in the cavity 8A (the ribbon take-up shaft 95, the tape drive shaft 100, the auxiliary shaft 110 and the head holder 74). The relationships in height among the members standing upward in the cassette housing portion 8 will be described later.

As shown in FIGS. 2 to 6, the arm-shaped platen holder 12 is pivotably supported around a support shaft 12A on the front side of the head holder 74. A platen roller 15 and a movable feed roller 14 are both rotatably supported on the leading end side of the platen holder 12. The platen roller 15 faces the thermal head 10 and may be moved close to and apart from the thermal head 10. The movable feed roller 14 faces the tape feed roller 46 that may be fitted with the tape drive shaft 100, and may be moved close to and apart from the tape feed roller 46.

A release lever (not shown in the figures), which moves in the left-right direction in response to the opening and closing of the cassette cover 6, is coupled to the platen holder 12. When the cassette cover 6 is opened, the release lever moves in the right direction, and the platen holder 12 moves toward a standby position shown in FIG. 5. The platen holder 12 has moved away from the cassette housing portion 8 at the standby position shown in FIG. 5, so that the tape cassette 30 can be installed in and removed from the cassette housing portion 8. The platen holder 12 is constantly elastically urged to remain at the standby position by a spiral spring (not shown in the figures).

When the cassette cover 6 is closed, the release lever moves in the left direction and the platen holder 12 moves toward a print position shown in FIG. 6. The platen holder 12 moves closer to the cassette housing portion 8 toward the print position shown in FIG. 6. Then, if the tape cassette 30 is installed in the cassette housing portion 8, the platen roller 15 presses the thermal head 10 via a tape which is a print medium (a heat-sensitive paper tape 55 in the present embodiment), and the movable feed roller 14 presses the tape feed roller 46 via the tape. Thus, at the print position shown in FIG. 6, printing can be performed using the tape cassette 30 installed in the cassette housing portion 8.

A feed path along which a printed tape is fed extends from a tape discharge aperture 49 to the discharge slit 9. A cutting mechanism 17 that cuts the printed tape at a predetermined position is provided on the feed path. The cutting mechanism 17 includes a fixed blade 18 and a movable blade 19 that opposes the fixed blade 18 and that is supported movably in the front-rear direction (in the vertical direction shown in FIGS. 5 and 6). The movable blade 19 is moved in the front-rear direction by a cutter motor (not shown in the figures).

The configuration of the tape cassette 30 according to the first embodiment will be explained. Hereinafter, the tape cassette 30 configured as a general purpose cassette will be explained as an example. As the general purpose cassette, the tape cassette 30 may be assembled as the thermal type, the receptor type and the laminated type that have been explained above, by changing, as appropriate, the type of the tape to be mounted in the tape cassette 30 and by changing the presence or absence of the ink ribbon, and so on.

The general configuration of the tape cassette 30 will be explained with reference to FIGS. 3, 5 and 6 to 9. The tape cassette 30 includes a cassette case 31 that is a housing having a generally rectangular parallelepiped shape (box-like shape). The tape cassette 30 includes a bottom case 31B and a top case 31A fixed to an upper portion of the bottom case 31B. A rectangular planar portion of the top case 31A that is longer in left-right direction and that is perpendicular to an opposing direction of the top case 31A and the bottom case 31B is a top wall 35 of the cassette case 31. The planar portion of the bottom case 31B that has substantially the same shape as the top wall 35 and that is perpendicular to the opposing direction of the top case 31A and the bottom case 31B is a bottom wall 36 of the cassette case 31. A side portion of the top case 31A that extends downward from the outer edge of the top wall 35 toward the bottom case 31B and a side portion of the bottom case 31B that extends upward from the outer edge of the bottom wall 36 toward the top case 31A form a side wall 37 of the cassette case 31.

In other words, the cassette case 31 is a box-like housing that includes the top wall 35 and the bottom wall 36 which form rectangular planar portions oppositely arranged in the vertical direction, and the side wall 37 that is formed with a predetermined height over the outer edges of the top wall 35 and the bottom wall 36. In the cassette case 31, the entire peripheries of the top wall 35 and the bottom wall 36 may not have to be surrounded by the side wall 37 completely. A part of the side wall 37 (the rear wall, for example) may be provided with an opening that exposes the interior of the cassette case 31, or a boss that connects the top wall 35, and the bottom wall 36 may be provided at the opening. The vertical direction of the cassette case 31 (that is, the direction in which the top wall 35 and the bottom wall 36 oppose each other) substantially corresponds to a direction in which the tape cassette 30 is installed in and removed from the cassette housing portion 8 (that is, an installation/removal direction of the tape cassette 30).

The first tape support hole 65 is formed at the rear left side of the center of the tape cassette 30 in a plan view. The first tape support hole 65 rotatably supports the first tape spool 40 (refer to FIGS. 5 and 6) on which a first tape is wound. A second tape support hole 66 is formed at the rear right side of the center of the tape cassette 30 in a plan view. The second tape support hole 66 rotatably supports a second tape spool (not shown in the first embodiment) on which a second tape is wound. A ribbon support hole 68 is formed at the front right side of the center of the tape cassette 30 in a plan view. The ribbon support hole 68 rotatably supports a ribbon spool (not shown in the first embodiment) on which an ink ribbon is wound. The take-up spool support hole 67 is formed between the first tape support hole 65 and the ribbon support hole 68. The take-up spool support hole 67 rotatably supports the ribbon take-up spool 44. The ribbon take-up spool 44 pulls out an ink ribbon from the ribbon spool and takes up the ink ribbon that has been used for printing characters.

The tape cassette 30 according to the first embodiment is assembled as a so-called thermal type tape cassette, in which the heat-sensitive paper tape 55 as a first tape is wound on the first tape spool 40. The thermal type tape cassette 30 does not include the second tape spool on which a second tape is wound, since another print medium does not need to be housed. Further, the thermal type tape cassette 30 does not include a ribbon spool on which an ink ribbon is wound, since no ink ribbon needs to be housed.

An arm portion 34 extends from the front right side of the tape cassette 30. The arm portion 34 is folded back at the right side at a right angle and extends toward the center of the tape cassette 30. The arm portion 34 guides an unused tape and an unused ink ribbon, and supplies them to the head insertion portion 39 from the exit 34A provided at the leading end thereof. The head insertion portion 39 is a space surrounded by an inner wall of the arm portion 34 and a wall opposing the inner wall and extending through the cassette case 31 in the vertical direction. As shown in FIGS. 5 and 6, the thermal head 10 of the tape printer 1 can be inserted in the head insertion portion 39. The head insertion portion 39 has an opening width wider than the thickness (the length in the front-rear direction) of the head holder 74 and the lateral width (the length in the left-right direction) such that when the head holder 74 having the thermal head 10 is inserted, looseness May be allowed for the head holder 74 in the front-rear direction and the left-right direction.

An arm side wall 33, which is a front wall of the arm portion 34, is provided with the arm indicator portion 80. The arm indicator portion 80 is formed in a specified pattern in accordance with a type of the tape cassette 30 (tape width, tape type, etc., for example). The arm indicator portion 80 includes indicators that respectively correspond to the arm detecting switches 21. Each of the indicators is either one of a non-pressing portion 81 and a pressing portion 82. The non-pressing portion 81 is a switch hole through which a switch terminal can be inserted or removed. The pressing portion 82 is a surface portion through which a switch terminal cannot be inserted.

The roller support hole 64 is provided at the front left portion of the tape cassette 30. The tape feed roller 46 is rotatably supported inside the roller support hole 64. The tape feed roller 46 pulls out an unused tape in concert with the corresponding movable feed roller 14. A pair of regulating members 63 that matches in the vertical direction is provided on the upstream side of the tape feed roller 46 in the tape feed direction. The regulating members 63 regulate the printed tape in a width direction of the tape on the downstream side of the thermal head 10 in the tape feed direction, and guide it toward the tape discharge aperture 49. The tape feed direction is a direction in which a tape mounted in the tape cassette 30 is fed within the cassette housing portion 8 when printing is performed in the tape printer 1.

As shown in FIGS. 5, 6, 8 and 9, the guide hole 47 according to the first embodiment has an opening shape such that both sides opposite to each other in the front-rear direction in a plan view are linear, and both sides opposing each other in the left-right direction are curved. A distance from the center of the opening of the guide hole 47 to any point on the curved sides is constant. The opening width of the guide hole 47 is larger than the diameter of the small-diameter shaft portion 120B of the guide shaft 120 in all directions through the center of the opening of the guide hole 47 in a plan view. In the guide hole 47, the opening width in the left-right direction through the center of the opening of the guide hole 47 in a plan view is the largest, and the opening width in the front-rear direction through the center of the opening of the guide hole 47 in a plan view is the smallest. The opening width in the front-rear direction through the center of the opening of the guide hole 47 is substantially equal to the diameter of the large-diameter shaft portion 120A of the guide shaft 120.

A guide wall 38 is standing upward in the vicinity of the regulating members 63. A separating wall 48 is standing upward between the guide wall 38 and the ribbon take-up spool 44. The above configurations fulfill their functions when the tape cassette 30 is of the laminated type (refer to FIG. 36). Specifically, the guide wall 38 separates a used ink ribbon fed via the head insertion portion 39 from a film tape, and guides the used ink ribbon toward the ribbon take-up spool 44. The separating wall 48 prevents mutual contact between the used ink ribbon guided along the guide wall 38 and the double-sided adhesive tape that is wounded on and supported by the first tape spool 40.

As shown in FIG. 3, the cassette case 31 has a generally rectangular parallelepiped shape with rounded corner portions. The common portion 32 having a constant width (a height T described later) is provided along a predetermined height of all the sides of the cassette case 31 regardless of a type of the tape cassette 30 (the tape width, for example). The common portion 32 horizontally projects in the outward direction to form a right angle in a plan view at predetermined corner portions of the cassette case 31 (more specifically, corner portions at which the tape discharge aperture 49 is not provided).

The common portion 32 opposes the cassette support portion 8B within the cassette housing portion 8 when the tape cassette 30 is installed in the cassette housing portion 8. At this time, in the cassette housing portion 8, the cassette case 31 is fitted in the cavity 8A up to a predetermined height position from the bottom surface of the cassette case 31 (that is, up to the lower surface of the common portion 32). Thus, the common portion 32 is held at a same height position by the cassette support portion 8B regardless of the thickness (the length in the vertical direction of the cassette case 31) of the tape cassette 30.

Figure 13:
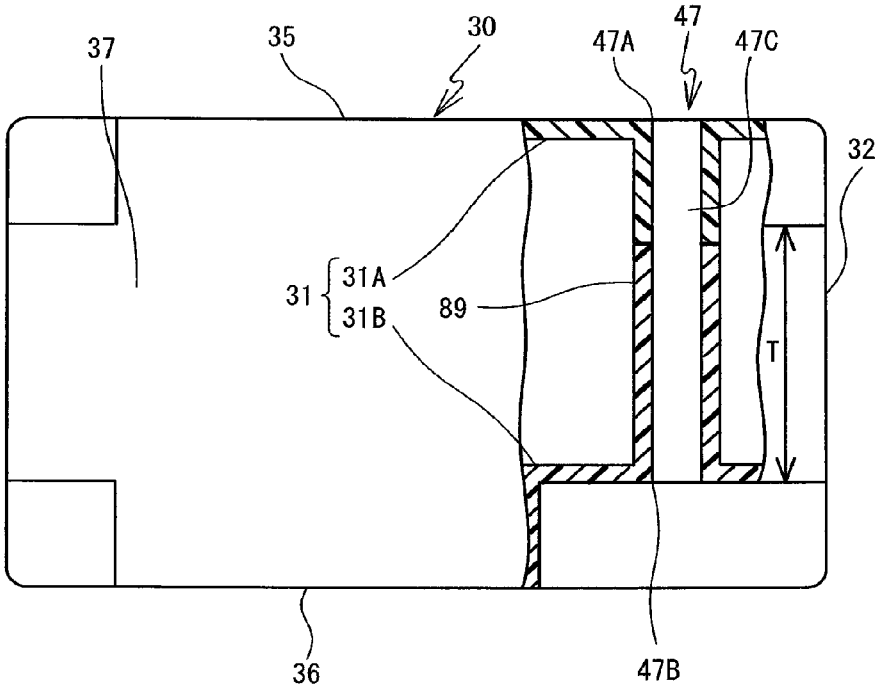
FIG. 13 is a side sectional view of the tape cassette 30 about a guide hole 47.

More specifically, as shown in FIG. 7, the common portion 32 has a height T formed to be symmetrical in the vertical direction with respect to a center line N in the height (width) direction of the cassette case 31 (also refer to FIG. 13). The height T of the common portion 32 is set to be constant regardless of the tape width of the print medium mounted in the cassette case 31. For example, when the height T of the common portion 32 is 12 mm, as the tape width becomes larger (18 mm, 24 mm, 36 mm, for example), the height of the cassette case 31 also becomes larger, but the height T of the common portion 32 remains constant. If the tape width is equal to or less than the height T (6 mm, 12 mm, for example), the height of the cassette case 31 is the width T of the common portion 32 (12 mm) plus a predetermined width.

Some portions of the tape cassette 30 will be explained in detail with reference to FIGS. 10 to 13. A description will be given below of the holes formed in the tape cassette 30 (the first tape support hole 65, the take-up spool support hole 67, the roller support hole 64 and the guide hole 47) and the members associated with the holes.

Figure 10:
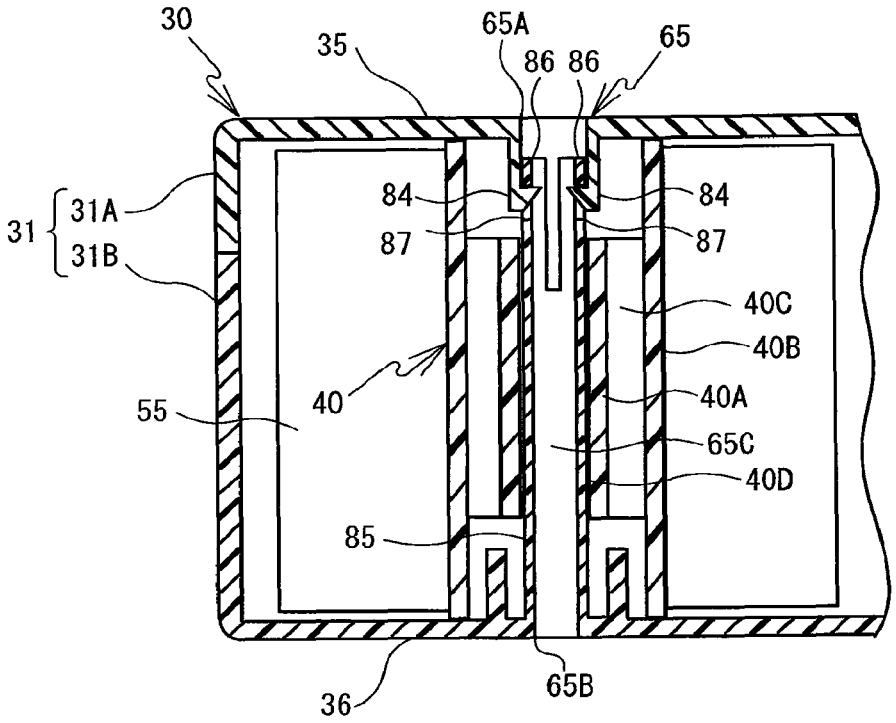
FIG. 10 is a front sectional view of the tape cassette 30 about a first tape support hole 65 and a first tape spool 40.

As shown in FIG. 10, the first tape spool 40 is rotatably supported by the first tape support hole 65 extending through the cassette case 31 in the vertical direction. More specifically, the first tape support hole 65 includes an opening 65A and an opening 65B, and a shaft hole 65C that connects the openings 65A and 65B. Both the openings 65A and 65B are provided at positions opposing each other in the top wall 35 and the bottom wall 36, respectively. The top case 31A has a pair of latching ribs 84. The latching ribs 84 extend downward from the opening 65A toward the bottom wall 36 and provided at opposite positions across the center of the opening 65A in a plan view. The latching ribs 84 each have a hook shape. The leading ends of the hooks project toward each other inside the cassette case 31.

The bottom case 31B includes a cylindrical wall portion 85 having a cylindrical shape which extends upward from the opening 65B toward the top wall 35. A pair of slits 87, which are cuts extending in the vertical direction, is provided in the cylindrical wall portion 85. The slits 87 are provided at opposite positions across the center of the opening 65B in a plan view. A head portion 86 that closes an opening end of each slit 87 is provided at the upper end side of each slit 87 in the cylindrical wall portion 85. The corresponding latching rib 84 is engaged with each head portion 86 provided at the leading end of the cylindrical wall portion 85 via each slit 87 within the cassette case 31. The shaft hole 65C that extends through the cassette case 31 in the vertical direction connects the openings 65A and 65B inside the cylindrical wall portion 85.

The first tape spool 40 has a double-wall configuration with an internal wall 40A and an external wall 40B. The internal wall 40A is a cylindrical member, and has the inner diameter slightly larger than the outer diameter of the cylindrical wall portion 85. The internal wall 40A has a height that is smaller than the tape width of the print medium. A shaft hole 40D that extends through the internal wall 40A in the vertical direction is formed within the internal wall 40A. The external wall 40B is a cylindrical member that is provided outside the diameter of the internal wall 40A and surrounds the internal wall 40A along the entire periphery. The external wall 40B has substantially the same height as the tape width of the print medium. A first tape (the heat-sensitive paper tape 55 in the first embodiment) is wound on the outer periphery of the external wall 40B.

Connecting members 40C are provided radially from the center of the internal wall 40A and the external walls 40B in a plan view between the internal wall 40A and the external wall 40B. The connecting members 40C are plate-shaped members that are longer in the vertical direction. The first tape spool 40 is formed to have a double-cylinder configuration in which the internal wall 40A and the external wall 40B are coaxially connected by the connecting members 40C. The first tape spool 40 is supported by the cylindrical wall portion 85 inserted in the shaft hole 40D to be rotatable about its axis inside the cassette case 31. In the first tape spool 40, the opening width of the shaft hole 65C is substantially equal to or slightly larger than the diameter of the auxiliary shaft 110 in order to reduce looseness in the circumferential direction which may exist relative to the auxiliary shaft 110 inserted in the shaft hole 65C.

Figure 11:
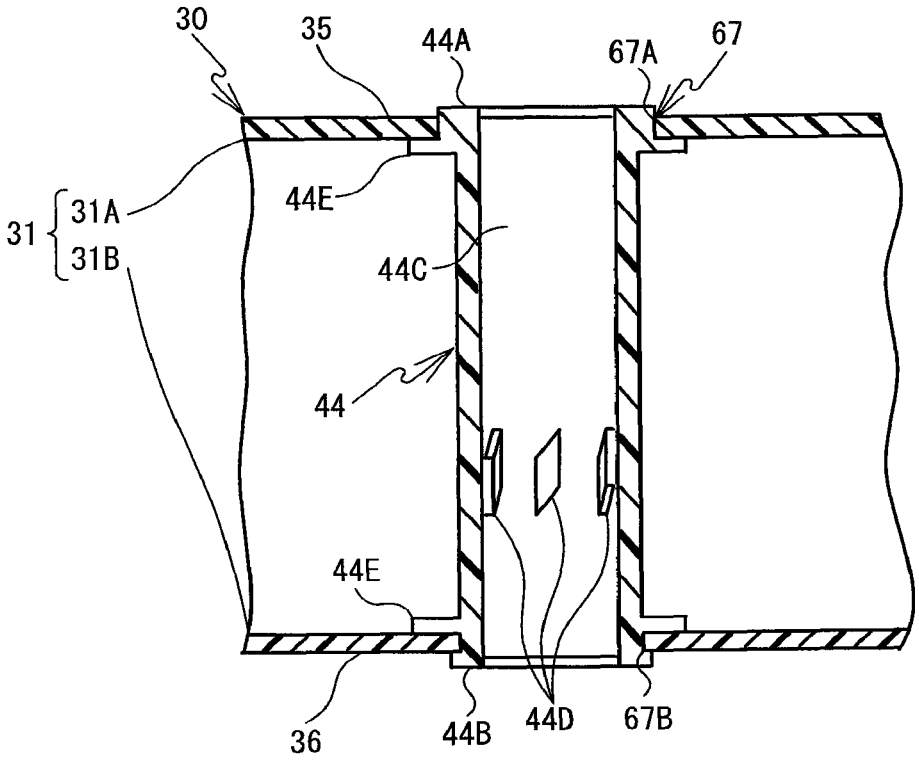
FIG. 11 is a front sectional view of the tape cassette 30 about a take-up spool support hole 67 and a ribbon take-up spool 44.

As shown in FIG. 11, the ribbon take-up spool 44 is rotatably supported by the take-up spool support hole 67 that extends through the cassette case 31 in the vertical direction. More specifically, the take-up spool support hole 67 includes an opening 67A and an opening 67B that are through-holes formed at positions opposing each other in the top wall 35 and the bottom wall 36, respectively. The ribbon take-up spool 44 is formed in a cylindrical shape that has substantially the same height as the width (that is, the length in the vertical direction) of the cassette case 31. Flange-shaped support portions 44E that project outwardly along the entire periphery are provided at the upper edge and the lower edge of the ribbon take-up spool 44, respectively.

Inside the cassette case 31, an upper end 44A of the ribbon take-up spool 44 is fitted in the opening 67A of the top wall 35, and a lower end 44B of the ribbon take-up spool 44 is fitted in the opening 67B of the bottom wall 36. The support portion 44E provided at the upper edge of the ribbon take-up spool 44 contacts with the top case 31A from below to regulate the movement of the ribbon take-up spool 44 in the upward direction. The support portion 44E provided at the lower edge of the ribbon take-up spool 44 contacts with the bottom case 31B from above to regulate the movement of the ribbon take-up spool 44 in the downward direction. Thus, the ribbon take-up spool 44 is supported at both ends 44A and 44B to be rotatable about its axis inside the cassette case 31.

A shaft hole 44C that extends in the vertical direction through the ribbon take-up spool 44 is formed inside the ribbon take-up spool 44. A plurality of latching ribs 44D are provided slightly below the center position in the vertical direction on the inner peripheral surface of the ribbon take-up spool 44 (that is, on the internal wall forming the shaft hole 44C). When the tape cassette 30 is installed in the cassette housing portion 8, the ribbon take-up shaft 95 described above is inserted in the shaft hole 44C via the opening 67B. Then, the latching ribs 44D provided in the ribbon take-up spool 44 are meshed with cam members 95A (refer to FIG. 14) formed around the ribbon take-up shaft 95. Thus, the rotation of the ribbon take-up shaft 95 is transmitted to the ribbon take-up spool 44 (that is, the ribbon take-up spool 44 rotates in concert with the rotation of the ribbon take-up shaft 95). The opening width of the shaft hole 44C is larger than the diameter of the ribbon take-up shaft 95 such that looseness may be allowed in the circumferential direction with respect to the ribbon take-up shaft 95 when the ribbon take-up shaft 95 is inserted in the ribbon take-up spool 44.

Figure 12:
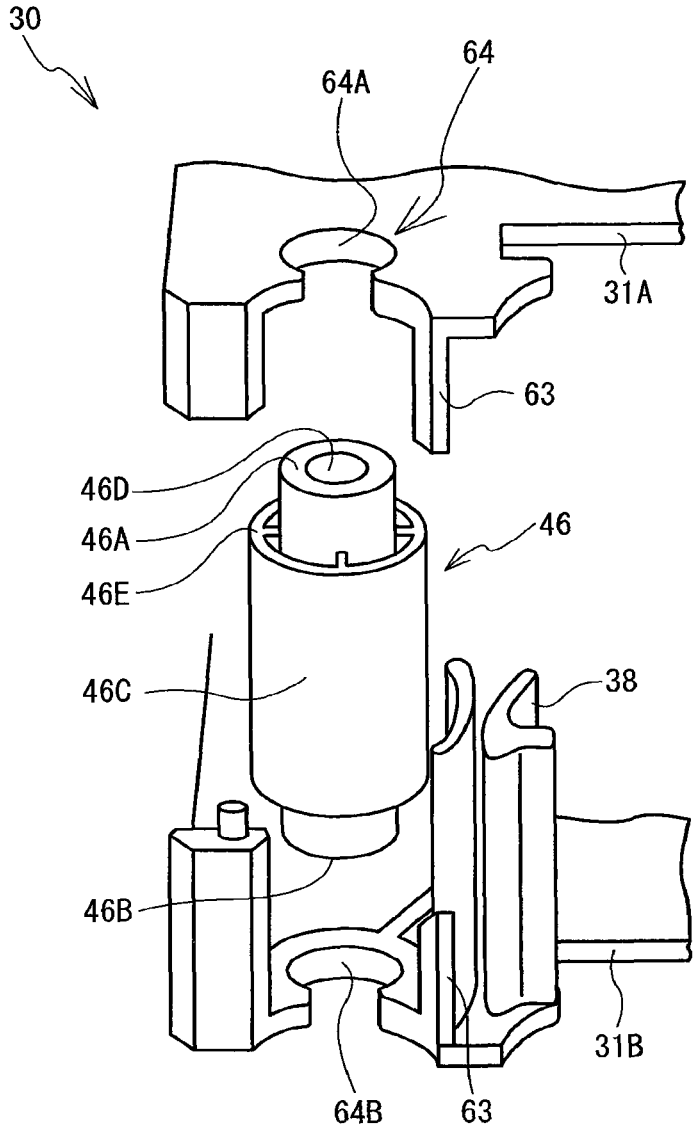
FIG. 12 is an enlarged and exploded perspective view of a roller support hole 64 and a tape feed roller 46.

As shown in FIG. 12, the tape feed roller 46 is rotatably supported by the roller support hole 64 that extends through the cassette case 31 in the vertical direction. More specifically, the roller support hole 64 includes an opening 64A and an opening 64B both of which are through-holes formed at positions opposing each other in the top wall 35 and the bottom wall 36, respectively. The regulating members 63 projecting toward each other are formed along the front edge of the cassette case 31 at each position near the openings 64A and 64B. The guide wall 38 is standing upward adjacent to and at the rear of the regulating members 63. The guide wall 38 extends between the top case 31A and the bottom case 31B. An interval between base ends of the regulating members 63 is set to be the same as the tape width of the print medium.

The tape feed roller 46 is formed in a cylindrical shape that has substantially the same height as the width (that is, the length in the vertical direction) of the cassette case 31. A main body 46E of the tape feed roller 46 has a larger diameter than the openings 64A and 64B and has a roller surface 46C. The roller surface 46C is an outer peripheral surface of the main body 46E that contacts the print medium. The length of the roller surface 46C in the vertical direction (that is, a tape feed width of the tape feed roller 46) is set to be the same as the tape width of the print medium. An upper end 46A and a lower end 46B respectively project in the upward and downward directions from the main body 46E of the tape feed roller 46. The upper end 46A and the lower end 46B have a slightly smaller diameter than the openings 64A and 64B. The shaft hole 46D that extends through the main body 46E in the vertical direction connects both ends 46A and 46B inside the tape feed roller 46.

Inside the cassette case 31, the upper end 46A is fitted in the opening 64A of the top wall 35, and the lower end 46B is fitted in the opening 64B of the bottom wall 36. The main body 46E contacts with the top case 31A from below to regulate the movement of the tape feed roller 46 in the upward direction, and contacts with the bottom case 31B from above to regulate the movement of the tape feed roller 46 in the downward direction. Thus, the tape feed roller 46 is supported at both ends 46A and 46B to be rotatable about its axis inside the cassette case 31.

Figure 17:
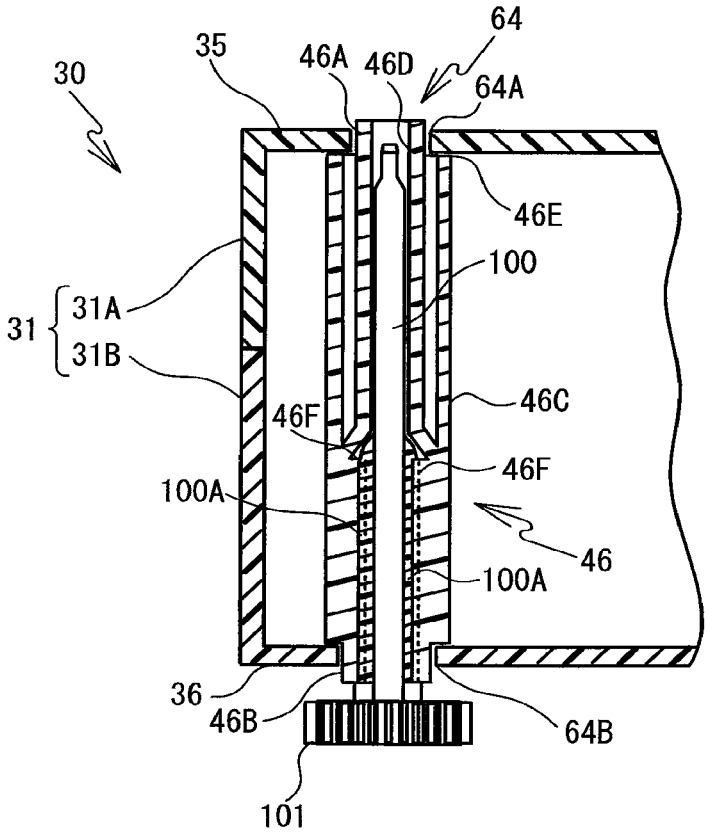
FIG. 17 is a front sectional view showing a state in which a tape drive shaft 100 is inserted in the tape feed roller 46.

As shown in FIG. 17, a plurality of latching ribs 46F are provided at the lower end of the tape feed roller 46 on the inner periphery surface of the tape feed roller 46 (that is, on the internal wall forming the shaft hole 46D). When the tape cassette 30 is installed in the cassette housing portion 8, the tape drive shaft 100 described above is inserted in the shaft hole 46D via the opening 64B. Then, the latching ribs 46F provided in the tape feed roller 46 are meshed with the cam members 100A formed around the tape drive shaft 100. Thus, the rotation of the tape drive shaft 100 is transmitted to the tape feed roller 46 (that is, the tape feed roller 46 rotates in concert with the rotation of the tape drive shaft 100). The opening width of the shaft hole 46D is slightly larger than the diameter of the tape drive shaft 100 such that looseness may be slightly allowed in the circumferential direction with respect to the tape drive shaft 100 when the tape drive shaft 100 is inserted in the tape feed roller 46.

As shown in FIG. 13, the guide hole 47 that extends through the cassette case 31 in the vertical direction is formed at the rear right side of the cassette case 31. More specifically, the guide hole 47 includes an opening 47A and an opening 47B, and a shaft hole 47C which connects the openings 47A and 47B. The openings 47A and 47B are provided at positions opposing each other in the top wall 35 and the bottom wall 36, respectively. Since the guide hole 47 is formed in the common portion 32 which is positioned at the rear right side of the cassette case 31 in a plan view, the opening 47B is formed in the lower surface of the common portion 32. A cylindrical wall portion 89 having a cylindrical shape extends between the top wall 35 and the bottom wall 36 (the lower surface of the common portion 32) inside the cassette case 31. The cylindrical wall portion 89 forms the shaft hole 47C connecting the openings 47A and 47B.

Figure 8:
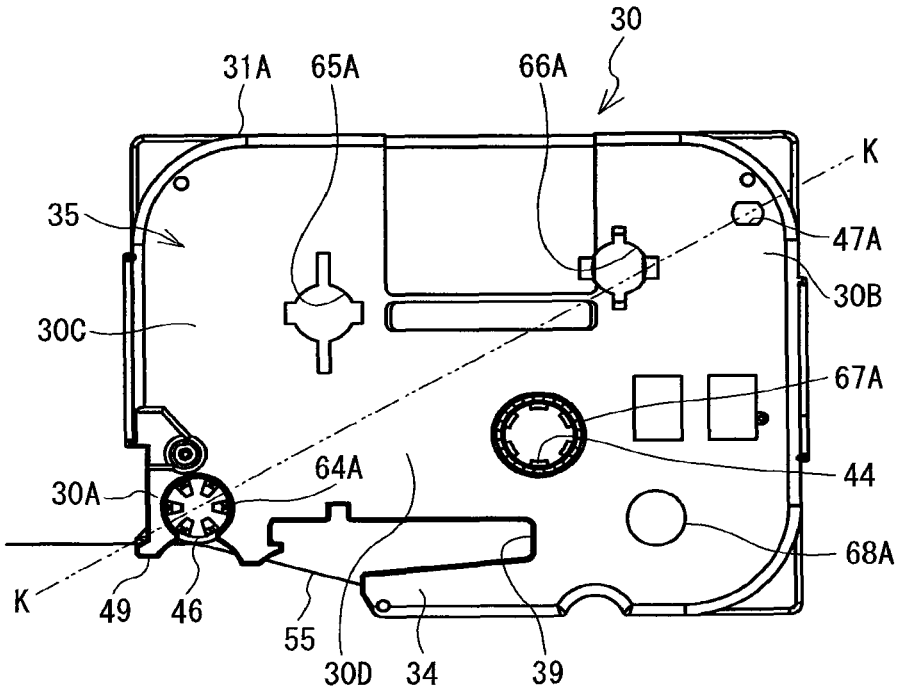
FIG. 8 is a plan view of the tape cassette 30.
Figure 9:
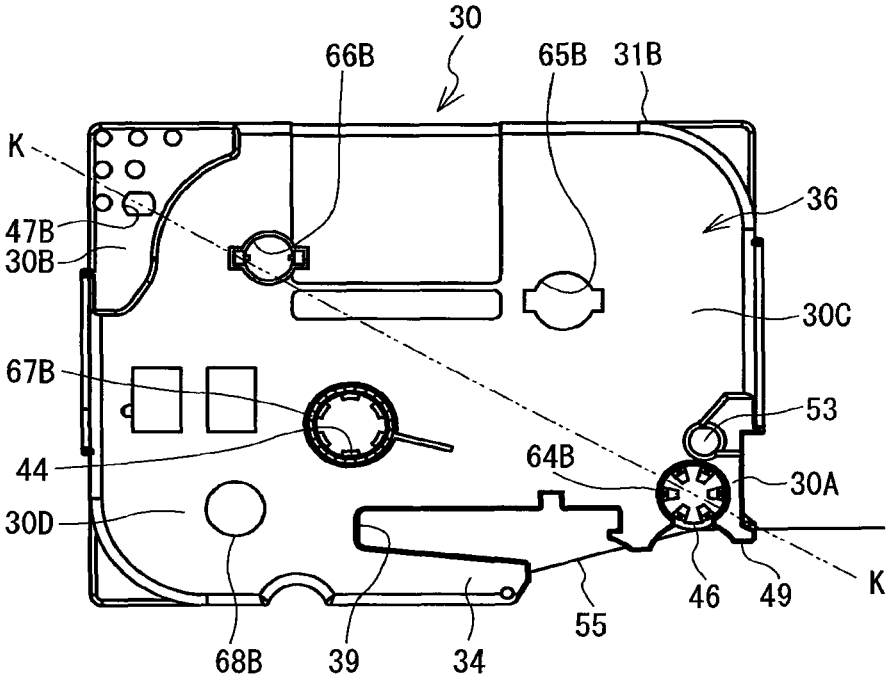
FIG. 9 is a bottom view of the tape cassette 30.

As shown in FIGS. 8 and 9, the second tape support hole 66 also includes a pair of openings 66A and 66B that are formed at positions opposing each other in the top wall 35 and the bottom wall 36, respectively. A pair of short cylindrical wall portions extends from the openings 66A and 66B toward each other inside the cassette case 31. The second tape spool (not shown in the figures) is a cylindrical member having substantially the same height as the tape width of the print medium and is wound with a second tape on its outer periphery surface. When the second tape is mounted in the cassette case 31, the short cylindrical wall portions extends from the openings 66A and 66B are respectively inserted in openings at both ends of the shaft hole which extends through the second tape spool in the vertical direction. Thus, the second tape spool is supported in the second tape support hole 66 to be rotatable about its axis inside the cassette case 31. The tape cassette 30 according to the first embodiment does not include the second tape spool inside the cassette case 31.

Similarly, the ribbon support hole 68 also includes a pair of openings 68A and 68B that are formed at positions opposing each other in the top wall 35 and the bottom wall 36, respectively. A pair of short cylindrical wall portions extends from the opening 68A and 68B toward each other inside the cassette case 31. The ribbon spool (not shown in the figures) is a cylindrical member having substantially the same height as the ribbon width of the ink ribbon, and is wound with an ink ribbon on its outer periphery surface. When the ink ribbon is mounted in the cassette case 31, the pair of short cylindrical wall portions extending from the openings 68A and 68B are respectively inserted in openings at both ends of the shaft hole which extends through the ribbon spool in the vertical direction. Thus, the ribbon spool is supported in the ribbon support hole 68 to be rotatable about the axial line inside the cassette case 31. The tape cassette 30 according to the first embodiment does not include the ribbon spool inside the cassette case 31.

The positional relationships among the respective portions provided in the tape cassette 30 according to the first embodiment will be explained with reference to FIGS. 3, 8 and 9. The two-dot chain line in FIGS. 8 and 9 indicates a division line K described later. The roller support hole 64, the guide hole 47, the first tape support hole 65, the lake-up spool support hole 67, the pin hole 53 and the head insertion portion 39, which are described above, are formed at positions that oppose the tape drive shaft 100, the guide shaft 120, the auxiliary shaft 110, the ribbon take-up shaft 95, the positioning pin 102 and the head holder 74 in the cassette housing portion 8 when the tape cassette 30 is installed in the cassette housing portion 8, respectively.

The roller support hole 64 is formed in a first hole forming area 30A including a corner portion positioned at the front left portion of the tape cassette 30. More specifically, nine areas can be formed if the tape cassette 30, which is substantially rectangular in a plan view, is divided into three parts in its front-rear direction and left-right direction, respectively. The first hole forming area 30A is an area at the foremost and leftmost position among the nine areas. The first hole forming area 30A is adjacent to the left side of the head insertion portion 39 provided at the center of the front portion of the tape cassette 30. In other words, the first hole forming area 30A is positioned on the downstream side of the head insertion portion 39 in the tape feed direction. Thus, when the tape cassette 30 is installed at a proper position in the cassette housing portion 8, the corner portion included in the first hole forming area 30A opposes the first shaft installation area 8C described above.

The guide hole 47 is formed in a second hole forming area 30B including a corner portion positioned at the rear right portion of the tape cassette 30. More specifically, the second hole forming area 30B is an area at the rearmost and rightmost position among the nine areas described above. In other words, when the tape cassette 30 is seen in a plan view, the corner portion included in the second hole forming area 30B is at a diagonal position with respect to the corner portion included in the first hole forming area 30A. Thus, when the tape cassette 30 is installed at a proper position in the cassette housing portion 8, the corner portion included in the second hole forming area 30B opposes the second shaft installation area 8D.

When the tape cassette 30 is divided in a plan view with reference to the division line K connecting the roller support hole 64 and the guide hole 47, two areas are formed. An area that occupies the part at the rear side of the division line K is a first housing area 30C. The other area that occupies the part at the front side of the division line K is a second housing area 30D. The first tape support hole 65 is formed at or in the vicinity of the center of gravity of the first housing area 30C forming a triangle shape in a plan view. The center of gravity of the first housing area 30C is the intersecting point of the three median lines of the triangular first housing area 30C. The take-up spool support hole 67 is formed at or in the vicinity of the center of gravity of the second housing area 30D forming a triangle shape in a plan view. The center of gravity of the second housing area 30D is the intersecting point of the three median lines of the triangular second housing area 30D. The first tape support hole 65 and the take-up spool support hole 67 are positioned substantially symmetrically across the division line K in a plan view.

The pin hole 53 that is indented upward at substantially the same depth as the height of the positioning pin 102 is formed adjacent to and at the rear side of the roller support hole 64 in the bottom case 31B. The tape cassette 30 installed in the cassette housing portion 8 is supported in the vicinity of the roller support hole 64 by the positioning pin 102 inserted in the pin hole 53, and is supported in the vicinity of the guide hole 47 by the positioning pin 103 contacting with the common portion 32.

The second tape support hole 66 is formed on the division line K in a plan view. More specifically, the second tape support hole 66 is positioned substantially at the middle between the center of the tape cassette 30 in a plan view and the guide hole 47. The ribbon support hole 68 is formed in the second housing area 30D. More specifically, the ribbon support hole 68 is positioned nearer to the front right side corner of the tape cassette 30 than the take-up spool support hole 67.

With the above positional relationships, the weight distribution of the tape cassette 30 according to the first embodiment can be explained as follows. The first tape spool 40 is rotatably supported around the first tape support hole 65 inside the tape cassette 30, as described above. This means that at least the center of rotation of the first tape spool 40 (that is, the shaft hole 40D) exists within the first housing area 30C in a plan view. In other words, this means that the center of gravity of the first tape (the heat-sensitive paper tape 55) wound on the first tape spool 40 is positioned within the first housing area 30C in a plan view.

On the other hand, the tape cassette 30 according to the first embodiment does not include another print medium (second tape) or an ink ribbon. In other words, in the tape cassette 30, the first housing area 30C in which the center of gravity of the heat-sensitive paper tape 55 is positioned is heavier than the second housing area 30D. A user may vertically insert the tape cassette 30 having such a weight distribution in the cassette housing portion 8 while maintaining the top wall 35 and the bottom wall 36 substantially horizontal with the fingers sandwiching the side wall 37 at the right and left sides, for example. At this time, due to a weight imbalance of the tape cassette 30, the first housing area 30C may be inclined downward with the division line K as the center of rotation.

With the tape printer 1 and the tape cassette 30 described above, when the tape cassette 30 is installed in the cassette housing portion 8, the three guide shafts (the tape drive shaft 100, the guide shaft 120 and the auxiliary shaft 110) standing upward in the cassette housing portion 8 can be inserted in the three guide holes (the roller support hole 64, the guide hole 47 and the first support hole 65) provided in the tape cassette 30, respectively. Thus, the tape cassette 30 can be guided to a proper position in the cassette housing portion 8. The installation/removal modes of the tape cassette 30 with respect to the cassette housing portion 8 will be described below in detail.

When the tape cassette 30 is installed at a proper position in the cassette housing portion 8, the tape drive shaft 100 is fitted in the tape feed roller 46 by insertion, and the ribbon take-up shaft 95 is fitted in the ribbon take-up spool 44 by insertion. Then, when the cassette cover 6 is closed, the platen holder 12 moves toward the print position, so that the platen roller 15 opposes the thermal head 10, and the movable feed roller 14 presses the tape feed roller 46. Thus, the tape printer 1 is in a state in which printing can be performed on the print medium.

When the platen holder 12 moves from the standby position toward the print position, the switch portion 20 provided in the platen holder 12 opposes the arm indicator portion 80 provided in the tape cassette 30. At this time, if the tape cassette 30 is installed at the proper position of the cassette housing portion 8, each of the detecting switches 21 enters an ON state or an OFF state, depending on a pattern of the indicators (the non-pressing portion 81 and the pressing portion 82) included in the arm indicator portion 80. More specifically, the detecting switch 21 that opposes the non-pressing portion 81 is inserted in the non-pressing portion 81 to enter the OFF state. The detecting switch 21 that opposes the pressing portion 82 is pressed by the pressing portion 82 to enter the ON state.

In the tape printer 1, the information on the tape cassette 30 is obtained based on a combination of the ON and OFF states of the detecting switches 21. The tape cassette 30 according to the first embodiment is a general purpose cassette that can be assembled as various types, but is actually assembled as a thermal type tape cassette that houses only the heat-sensitive paper tape 55 as the print medium. Thus, in the tape printer 1, "thermal type with tape width of 36 mm" is detected as a type of the tape cassette 30, for example, based on the detection result in the switch portion 20.

In the first embodiment, while printing is being performed in the tape printer 1, the tape feed roller 46 that is driven to rotate via the tape drive shaft 100 pulls out the heat-sensitive paper tape 55 from the first tape spool 40 in concert with the movable feed roller 14. The heat-sensitive paper tape 55 that has been pulled out from the first tape spool 40 passes the right side of the ribbon support hole 68 to be fed along the feed path within the arm portion 34. Further, the heat-sensitive paper tape 55 is supplied from the exit 34A of the arm portion 34 to the head insertion portion 39 to be fed between the thermal head 10 and the platen roller 15. Then, characters are printed onto the print surface of the heat-sensitive paper tape 55 by the thermal head 10. Following that, the printed heat-sensitive paper tape 55 is further fed toward the tape discharge aperture 49 by the tape feed roller 46 in concert with the movable feed roller 14, and is cut by the cutting mechanism 17.

While the printing is being performed, the ribbon take-up spool 44 is also driven to rotate via the ribbon take-up shaft 95. However, the tape cassette 30 according to the first embodiment does not include a ribbon spool in the cassette case 31. For that reason, the ribbon take-up spool 44 does not pull out the unused ink ribbon, nor does it take up the used ink ribbon. In other words, even when the thermal type tape cassette 30 is used in the tape printer 1 that is equipped with the ribbon take-up shaft 95, the rotation drive of the ribbon take-up shaft 95 does not have an influence on the printing operation onto the heat-sensitive paper tape 55 and printing can be correctly performed. In the above tape cassette 30, the ribbon take-up spool 44 may not be provided and the ribbon take-up shaft 95 may perform idle running inside the take-up spool support hole 67 in a similar manner.

Figure 14:
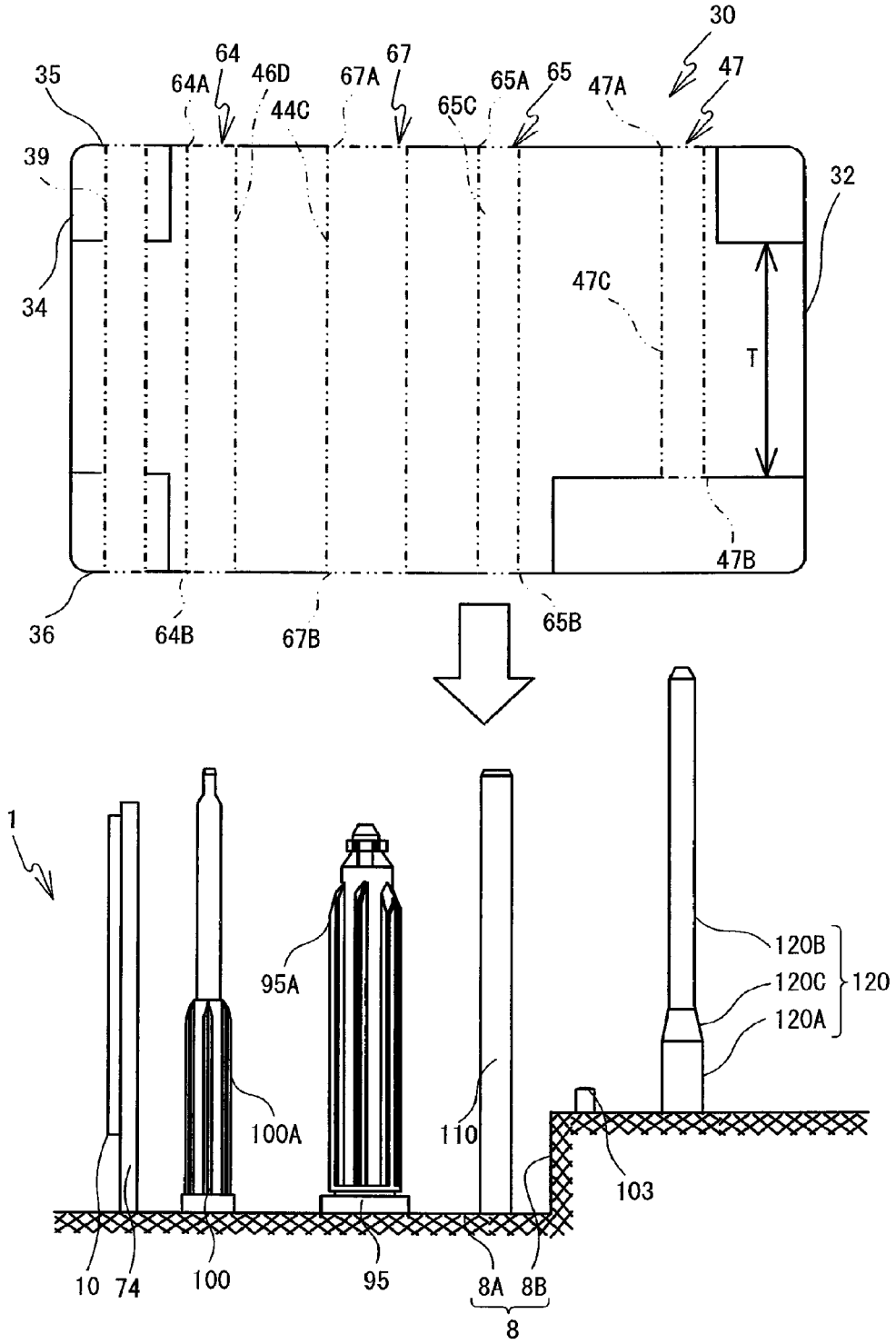
FIG. 14 is a right side view showing an installation process of the tape cassette 30 in the cassette housing portion 8 according to the first embodiment.
Figure 15:
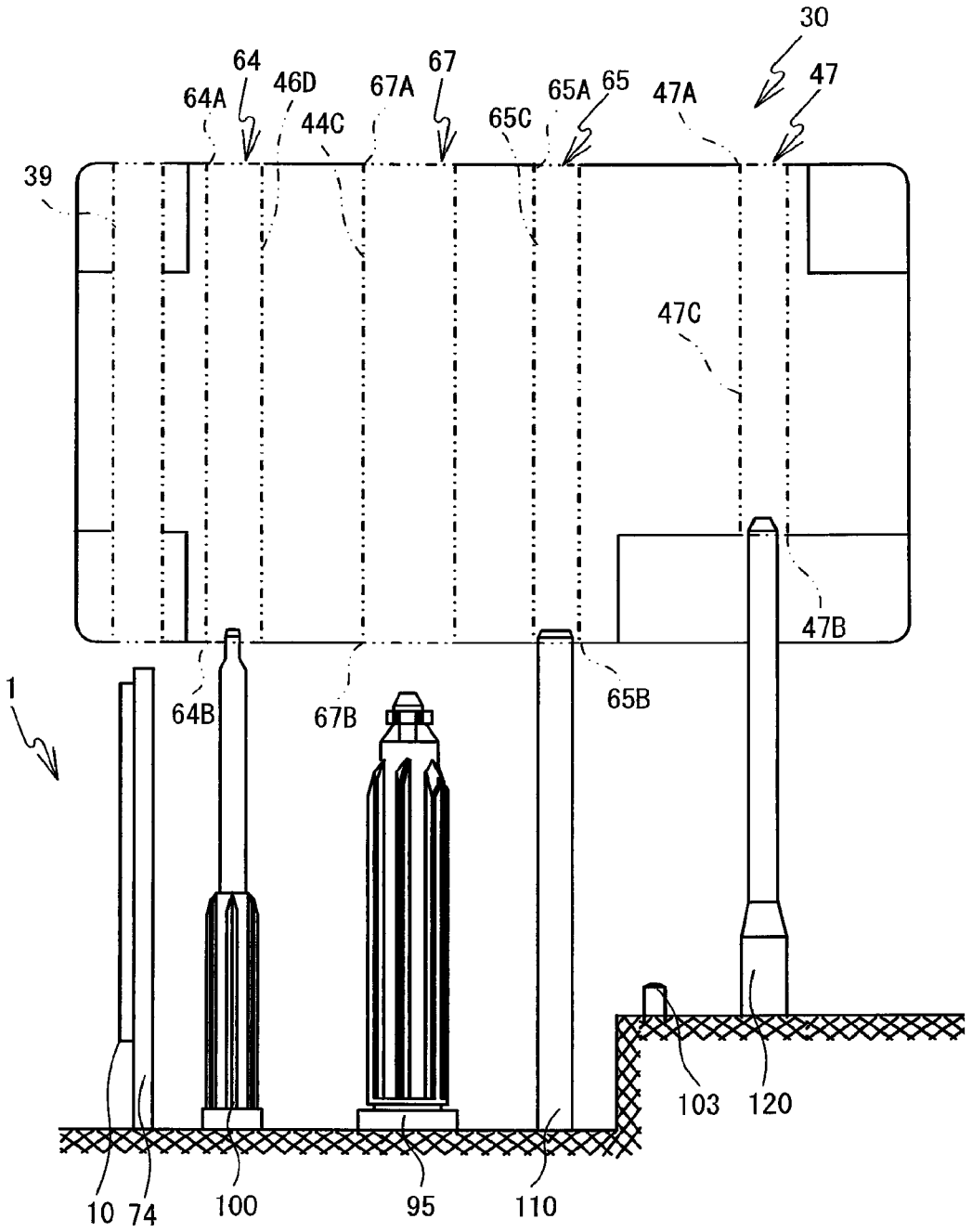
FIG. 15 is another right side view of the installation process of the tape cassette 30 in the cassette housing portion 8 according to the first embodiment.
Figure 16:
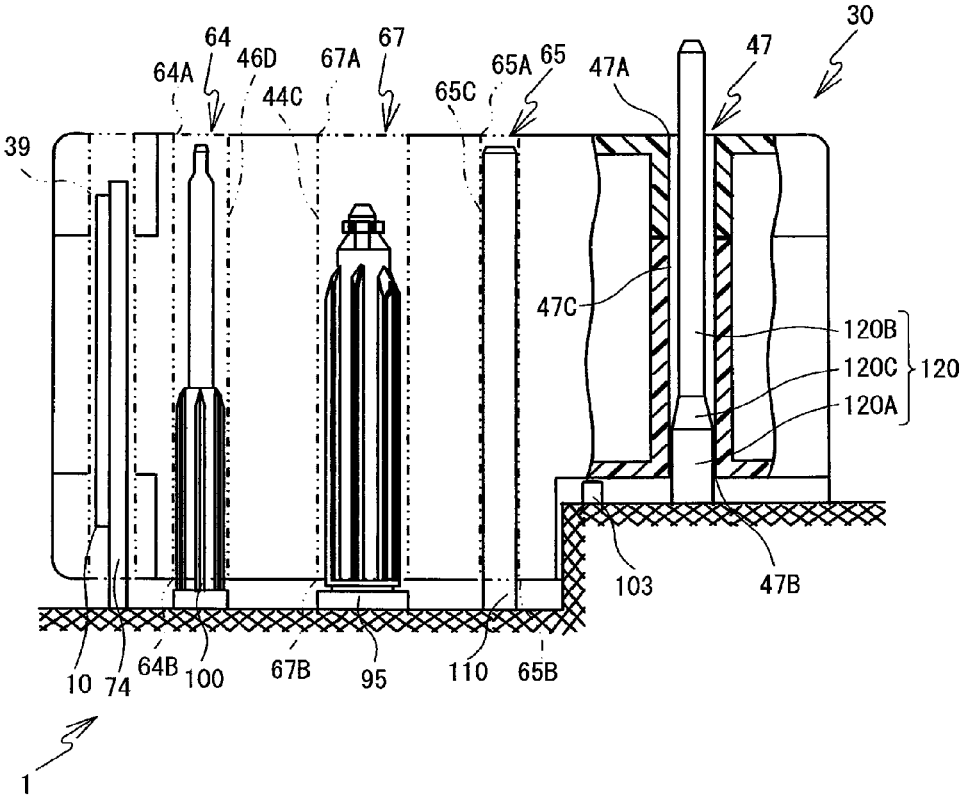
FIG. 16 is a right side view showing a state in which the tape cassette 30 is installed in the cassette housing portion 8 according to the first embodiment.

The installation/removal modes of the tape cassette 30 with respect to the cassette housing portion 8 according to the first embodiment will be described with reference to FIGS. 14 to 18. In FIGS. 14 to 16 that show the right side surface of the tape cassette 30, only the holes associated with the installation and removal of the tape cassette 30 are illustrated in a two-dot chain line for ease of understanding. In addition, in FIGS. 14 to 16 that also show the schematic section views of the cassette housing portion 8 as seen from the right side thereof, only the shafts associated with the installation and removal of the tape cassette 30 are illustrated for ease of understanding. In FIG. 16, only the guide hole 47 and its vicinity are shown in a section as seen from the right side of the tape cassette 30.

The relationships in the vertical direction among the respective members standing upward in the cassette housing portion 8 will be explained. In the first embodiment, the head holder 74, the tape drive shaft 100, the ribbon take-up shaft 95, the auxiliary shaft 110 and the guide shaft 120 each have a height (lengths in the vertical direction) at least larger than the height T of the common portion 32. Three guide shafts (the tape drive shaft 100, the auxiliary shaft 110 and the guide shaft 120) among the shafts have a substantially same height. In addition, the height of each of the tape drive shaft 100, the auxiliary shaft 110 and the guide shaft 120 is longer than the height of the ribbon take-up shaft 95 and the height of the head holder 74.

For that reason, in a state in which the head holder 74, the tape drive shaft 100, the ribbon take-up shaft 95 and the auxiliary shaft 110 are standing upward, with reference to the height position on the planar portion of the cavity 8A, the height positions of the upper ends of the tape drive shaft 100 and the auxiliary shaft 110 are the highest. The height position of the upper end of the head holder 74 is the second highest. The height position of the upper end of the ribbon take-up shaft 95 is the lowest. The height position of the upper end of the ribbon take-up shaft 95 is substantially the same as the height position of the upper end of the thermal head 10 fixed to the head holder 74.

The guide shaft 120 is standing upward on the cassette support portion 8B positioned above the cavity 8A, as described above. The upper end of the guide shaft 120 is at a height position higher than the upper end of any of the head holder 74, the tape drive shaft 100, the ribbon take-up shaft 95 and the auxiliary shaft 110. The height (the length in the vertical direction) from each upper end of the tape drive shaft 100 and the auxiliary shaft 110 to the upper end of the guide shaft 120 is substantially equal to the height (the length in the vertical direction) from the lower surface of the bottom wall 36 of the tape cassette 30 to the lower surface of the common portion 32. In other words, the thickness of the tape cassette 30 is made smaller due to the common portion 32 formed like steps, and thus the guide shaft 120 correspondingly extends above the height positions of the tape drive shaft 100 and the auxiliary shaft 110.

As shown in FIG. 14, when the user installs the tape cassette 30 in the cassette housing portion 8, the user positions the tape cassette 30 such that the relative positions in a plan view of the roller support hole 64, the first tape support hole 65 and the guide hole 47 substantially match those of the tape drive shaft 100, the auxiliary shaft 110 and the guide shaft 120, respectively. Then, the user vertically inserts the tape cassette 30 in the cassette housing portion 8, while maintaining the top wall 35 and the bottom wall 36 substantially horizontal, as described above. As the tape cassette 30 is moved down toward the cassette housing portion 8, as shown in FIG. 15, the respective upper ends of the tape drive shaft 100, the auxiliary shaft 110 and the guide shaft 120 enter the openings 64B, 65B and 47B provided at the bottom wall 36 of the tape cassette 30, respectively. On the other hand, since the respective upper ends of the head holder 74 and the ribbon take-up shaft 95 are positioned below the bottom wall 36, the head holder 74 and the ribbon take-up shaft 95 do not enter the interior of the tape cassette 30.

When the tape cassette 30 is moved further down from the state shown in FIG. 15, the tape drive shaft 100, the auxiliary shaft 110 and the guide shaft 120 are inserted in the shaft holes 46D, 65C and 47C via the openings 64B, 65B and 47B from below, respectively. The tape drive shaft 100, the auxiliary shaft 110 and the guide shaft 120 respectively inserted in the shaft holes 46D, 65C and 47C are regulated in their movement in the circumferential direction by the internal walls of respective shaft holes 46D, 65C and 47C to enter a slidable state along the standing direction (that is, in the vertical direction). In other words, the tape cassette 30 is guided along the standing direction of the tape drive shaft 100, the auxiliary shaft 110 and the guide shaft 120 inserted in the shaft holes 46D, 65C and 47C, respectively, and moves down due to its own weight.

The upper edges of the tape drive shaft 100, the auxiliary shaft 110 and the guide shaft 120 are tapered such that the diameters become smaller toward the upper ends. For that reason, even when the roller support hole 64, the first tape support hole 65 and the guide hole 47 are slightly offset in the relative positions in a plan view, the tape drive shaft 100, the auxiliary shaft 110 and the guide shaft 120 can be inserted in the respective holes correctly and smoothly. In addition, the diameter of the tape drive shaft 100 is slightly smaller than the opening width of the tape feed roller 46 (the shaft hole 46D). Therefore, even if the horizontal position of the tape feed roller 46 is slightly changed within the roller support hole 64 due to vibration, inclination or the like, the tape drive shaft 100 can be smoothly inserted therein.

Further, as described above, the opening width of the guide hole 47 is larger than the diameter of the leading end of the guide shaft 120 (the small-diameter shaft portion 120B described above) and particularly the opening width in the left-right direction thereof is larger than the opening width in the front-rear direction. Thus, when the tape cassette 30 is installed, the guide shaft 120 can be inserted in the guide hole 47 even if the relative position of the guide hole 47 with respect to the guide shaft 120 is slightly offset in the left-right direction in a plan view.

With above-described configuration, the holes (the roller support hole 64, the first tape support hole 65, and the guide hole 47) of the tape cassette 30 do not need to be accurately positioned corresponding to the three guide shafts (the tape drive shaft 100, the auxiliary shaft 110, and the guide shaft 120) provided in the cassette housing portion 8. Therefore, the user's load can be reduced at the installation of the tape cassette 30. A high-level dimensional accuracy may be required for a worker in order to completely match the dimensional widths of the roller support hole 64 and the guide hole 47 with the dimensional widths of the tape drive shaft 100 and the guide shaft 120 when the tape cassette 30 is manufactured. In that respect, by giving looseness in the left-right direction in the guide hole 47, a slight error of the dimensional accuracy in forming the guide hole 47 may be acceptable. Therefore, the worker's load at the time of manufacturing the tape cassette 30 can be also reduced.

As the tape cassette 30 is guided downward, the head holder 74 having the thermal head 10 is inserted in the head insertion portion 39 from below, and the ribbon take-up shaft 95 is inserted in the shaft hole 44C via the opening 67B from below. As described above, since looseness is given in the head insertion portion 39 even if the head holder 74 is installed therein, the head holder 74 enters the loosely inserted state in which the head holder 74 can be displaced within the head insertion portion 39 in the front-rear direction and the left-right direction. In addition, since the opening width of the ribbon take-up spool 44 (the shaft hole 44C) is larger than the diameter of the ribbon take-up shaft 95, the ribbon take-up shaft 95 enters the loosely inserted state in which the ribbon take-up shaft 95 can displace within the ribbon take-up spool 44 in the circumferential direction.

As shown in FIG. 16, as the tape cassette 30 is moved further down along the tape drive shaft 100, the auxiliary shaft 110 and the guide shaft 120, the positioning pin 103 standing upward on the cassette support portion 8B contacts the lower surface of the common portion 32 provided at the rear right portion of the tape cassette 30. At the same time, although not shown in FIG. 16, the positioning pin 102 standing upward on the cassette support portion 8B is inserted in the pin hole 53 and the upper end of the positioning pin 102 contacts the ceiling wall of the interior of the pin hole 53. In other words, the height position of the tape cassette 30 installed in the cassette housing portion 8 is defined at the height position at which the tape cassette 30 is supported by the positioning pins 102 and 103.

At the same time, the base end side (the large-diameter shaft portion 120A described above) of the guide shaft 120 is fitted in the guide hole 47 (the shaft hole 47C) while being guided along the taper portion 120C. As described above, since the diameter of the large-diameter shaft portion 120A is substantially equal to the opening width of the guide hole 47, the large-diameter shaft portion 120A is tightly engaged with the guide hole 47 in the front-rear direction. Consequently, the guide shaft 120 is regulated in its displacement in the circumferential direction (particularly, in the front-rear direction) of the guide shaft 120. In addition, the positioning pin 102 is engaged within the pin hole 53 and is regulated in its displacement in the circumferential direction of the positioning pin 102. In other words, the horizontal position of the tape cassette 30 installed in the cassette housing portion 8 is defined at the horizontal position at which the tape cassette 30 is engaged by the guide shaft 120 and the positioning pin 102.

Printing by the thermal head 10 is performed in the direction perpendicular to the tape feed direction (i.e. the front-rear direction of the tape cassette 30). For that reason, it may be preferable that the installation position of the tape cassette 30 in the front-rear direction is accurately defined in order to prevent an offset of a printing position on the tape. On the other hand, even if the installation position of the tape cassette 30 is slightly offset along the tape feed direction (the left-right direction of the tape cassette 30), the offset may not have a large influence on the print quality. Since slight looseness is given around the large-diameter shaft portion 120A in the left-right direction when the guide shaft 120 is inserted in the guide hole 47 according to the first embodiment, the tape cassette 30 may be smoothly installed and removed while maintaining the print quality.

Figure 18:
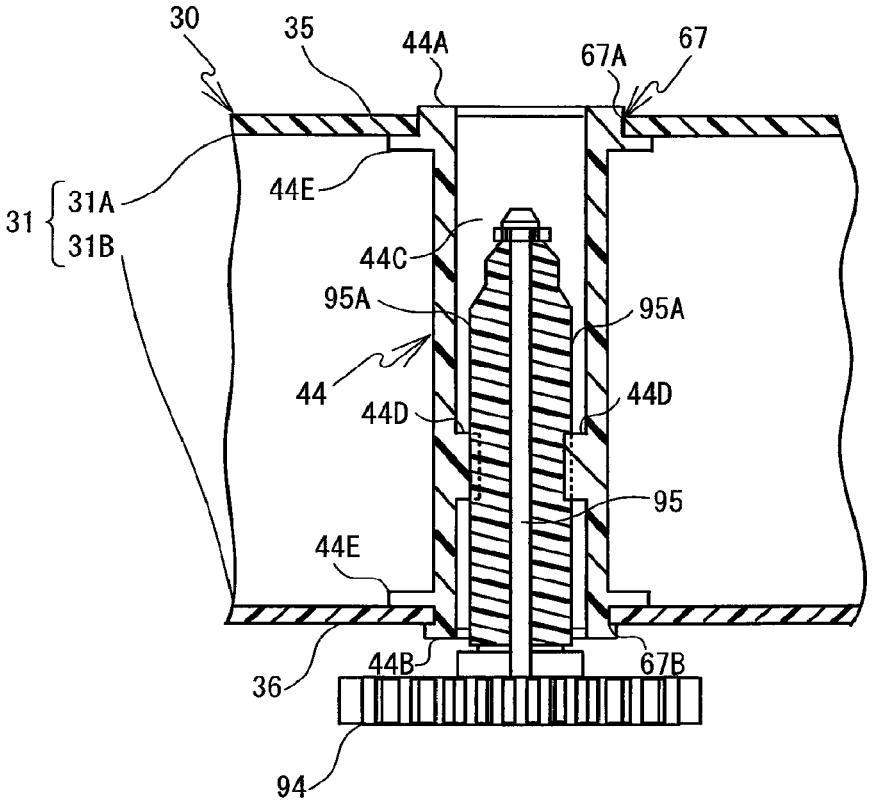
FIG. 18 is a front sectional view showing a state in which a ribbon take-up shaft 95 is inserted in the ribbon take-up spool 44.

In this way, in the first embodiment, the tape cassette 30 is guided downward to a proper position in the cassette housing portion 8 by the three guide shafts (the tape drive shaft 100, the auxiliary shaft 110 and the guide shaft 120). Then, the tape cassette 30 is positioned at a proper horizontal position by the guide shaft 120 and the positioning pin 102, and is positioned at a proper height position by the positioning pins 102 and 103. As shown in FIG. 17, in the state in which the tape cassette 30 is positioned at the proper position, the cam members 100A provided at the base end side of the tape drive shaft 100 are properly meshed with the latching ribs 46F of the tape feed roller 46. In addition, as shown in FIG. 18, the cam members 95A provided in the ribbon take-up shaft 95 are properly meshed with the latching ribs 44D of the ribbon take-up spool 44. Furthermore, the thermal head 10 provided on the head holder 74 is arranged at a proper print position in the head insertion portion 39. In this state, as described above, the tape printer 1 can appropriately perform printing on the print medium.

When the tape cassette 30 is removed from the cassette housing portion 8, the user may pull out the tape cassette 30 upward from the cassette housing portion 8 with the fingers sandwiching the side wall 37 at both the right and left sides. Also at this time, the tape cassette 30 is guided in the upward direction by the three guide shafts (the tape drive shaft 100, the auxiliary shaft 110 and the guide shaft 120). Thus, the tape cassette 30 may be less likely to be inclined and caught at an internal wall and the like of the cassette housing portion 8 while the tape cassette 30 is removed from the cassette housing portion 8.

The tape cassette 30 according to the first embodiment has a weight distribution such that the first housing area 30C may be inclined downward. Therefore, the first housing area 30C is provided with the first tape support hole 65 that passes through the center of gravity of the first tape (the heat-sensitive paper tape 55), and the tape printer 1 is provided with the auxiliary shaft 110 to be inserted in the first tape support hole 65. When the tape cassette 30 is installed or removed, the first housing area 30C, which may cause a raised or inclined state of the tape cassette 30 inside the cassette housing portion 8, is guided in the vertical direction by the auxiliary shaft 110 inserted in the first tape support hole 65. For that reason, the raised or inclined state of the tape cassette 30 due to a downward inclination of the first housing area 30C may be restricted when the tape cassette 30 is installed.

In the first embodiment, the tape cassette 30 is guided in the vertical direction at the three points, that is, a pair of corner portions on a diagonal of the tape cassette 30 (specifically, the roller support hole 64 and the guide hole 47) and the center of gravity of the first tape (specifically, the first tape support hole 65) in a plan view. For that reason, a positional displacement or an inclination may be appropriately prevented when the tape cassette 30 is installed in the cassette housing portion 8. It may be preferable that the center of gravity of the entire tape cassette 30 is positioned within an area defined by connecting the roller support hole 64, the first tape support hole 65 and the guide hole 47 in a plan view. In such a case, the own weight of the tape cassette 30 is uniformly distributed to and acts on the three points, that is, the tape drive shaft 100, the auxiliary shaft 110 and the guide shaft 120, by which the tape cassette 30 is guided. Then, the tape cassette 30 can smoothly move in the installation/removal direction and the positional displacement or the inclination may be more reliably prevented in the process of the installation of the tape cassette 30.

The tape cassette 30 has four corner portions in a plan view. While the tape cassette 30 is installed or removed, the tape cassette 30 is guided at least at two points, that is, the front left corner portion at which the roller support hole 64 is provided and the rear right corner portion which is diagonal to the front left corner portion and at which the guide hole 47 is provided. At and in the vicinity of the front left corner portion of the tape cassette 30, tape feeding is performed by the tape feed roller 46 and printing is performed by the thermal head 10. In addition, the tape is exposed to the outside from the cassette case 31 for tape feeding and printing. For that reason, the positioning of the tape cassette 30 at the front left corner portion may have a large influence on the print quality or tape feeding. In order to perform tape feeding by the tape feed roller 46, the tape drive shaft 100 that rotates the tape feed roller 46 is used.

Considering the above-described conditions, with the configuration in which the tape cassette 30 is guided in the installation/removal direction at the front left corner portion, the tape cassette 30 may be accurately positioned in the vicinity of the position at which the tape feeding and printing is performed. This configuration may also prevent a failure (that is, a so-called jam) in which the tape exposed to the outside tangles with other members in the installation process of the tape cassette 30. If the tape drive shaft 100 is utilized as one of guide shafts, as in the first embodiment, an additional shaft that guides the front left corner portion of the tape cassette 30 does not need to be separately provided. Therefore, the configuration of the tape printer 1 may be simplified. Further, with the configuration in which the tape cassette 30 is additionally guided at the rear right corner portion in the installation/removal direction, the tape cassette 30 may be stably guided in the installation/removal direction at the diagonal corner portions, which make the largest distance between two points in the tape cassette 30 in a plan view.

When the tape cassette 30 is installed at the proper position, the division line J and the division line K substantially match with each other in a plan view (refer to FIGS. 5 and 6). Then, the tape cassette 30 is fitted in the cavity 8A and the common portion 32 is supported above the cassette support portion 8B without an inclination or a positional displacement in the cassette housing portion 8. The thermal head 10 fixed on the head holder 74 is arranged at a correct print position within the head insertion portion 39. The tape drive shaft 100 and the ribbon take-up shaft 95 are appropriately inserted and fitted in the tape feed roller 46 and the ribbon take-up spool 44, respectively, without a shaft offset. The switch portion 20 (a plurality of detecting switches 21) provided in the platen holder 12 opposes the arm indicator portion 80 (the non-pressing portion 81 and the pressing portion 82) provided in the arm side wall 33 without a positional displacement, and a type of the tape cassette 30 is accurately detected. For that reason, in the tape printer 1, a possibility of a feeding failure of a tape or an ink ribbon, or a printing failure of the thermal head 10 may be remarkably reduced, and thus, correct printing may be performed.

In the first embodiment, the general purpose cassette assembled as the thermal type tape cassette 30 is used in the general purpose tape printer 1. Thus, a single tape printer 1 can be used with various types of the tape cassette 30 such as the thermal type, the receptor type and the laminated type. In other words, it may not be necessary to use the different tape printer for each type. Furthermore, when the tape cassette is manufactured, the cassette case is normally formed by injecting plastic into a plurality of combined dies. In the case of the tape cassettes that correspond to the same tape width, common dies can be used except for the die including the portion that forms the arm indicator portion 80. Thus, costs may be significantly reduced. When a thermal type tape cassette is assembled considering the above advantages, it may be effective that the long heat-sensitive paper tape 55 is wound on the first tape spool 40 and housed in the general purpose cassette case, as in the first embodiment.

In the first embodiment, the thermal type tape cassette 30 formed from a general purpose cassette is used in the general purpose tape printer 1. However, a dedicated tape cassette for the thermal type may be configured, or the tape cassette 30 of the first embodiment may be used in a dedicated tape printer for the thermal type.

Figure 19:
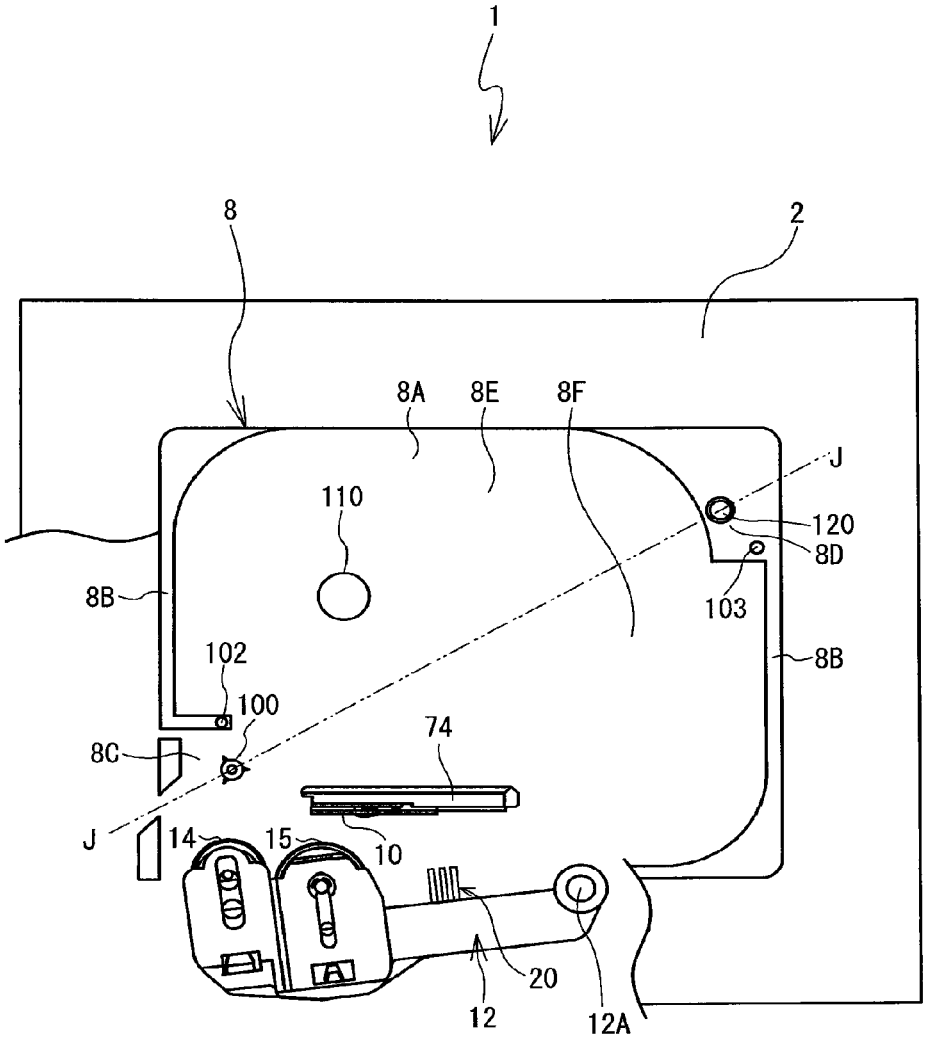
FIG. 19 is a plan view of the cassette housing portion 8 according to a variant of the first embodiment.
Figure 21:
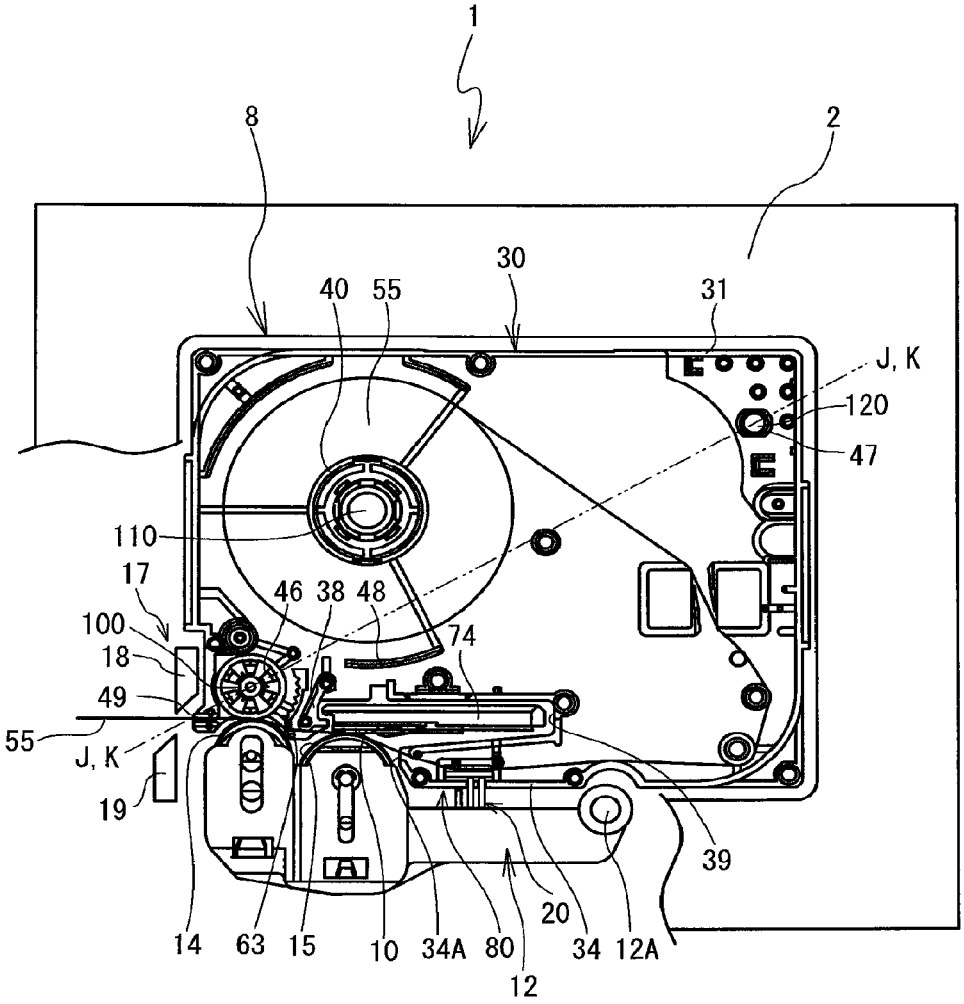
FIG. 21 is a plan view of the cassette housing portion 8 in which the tape cassette 30 is installed according to the variant of the first embodiment.
Figure 22:
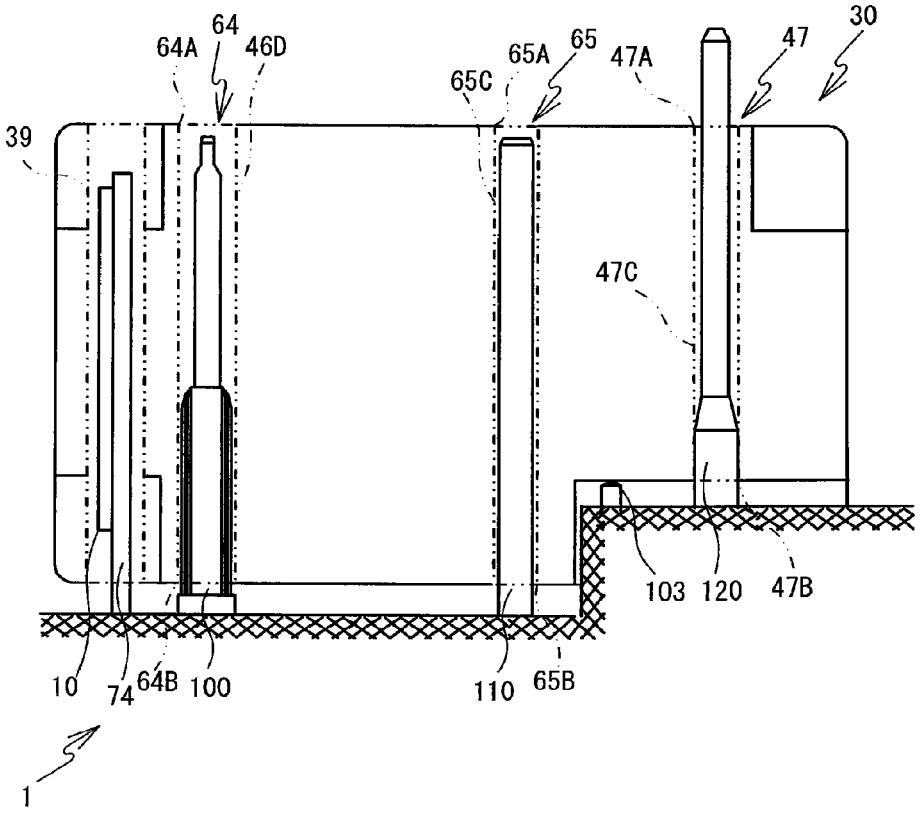
FIG. 22 is a right side view showing a state in which the tape cassette 30 is installed in the cassette housing portion 8 according to the variant of the first embodiment.

For example, as shown in FIGS. 19 and 21, a tape printer 1 dedicated for the thermal type may be configured. An ink ribbon is not used for printing on the print medium with the thermal type. Therefore, if the tape printer 1 is a dedicated device in which only the thermal type tape cassette 30 is used, the tape printer 1 may not include the ribbon take-up shaft 95 for rotating the ribbon take-up spool 44. For that reason, the ribbon take-up shaft 95 is not standing upward on the gear 94 (refer to FIG. 3).

Figure 20:
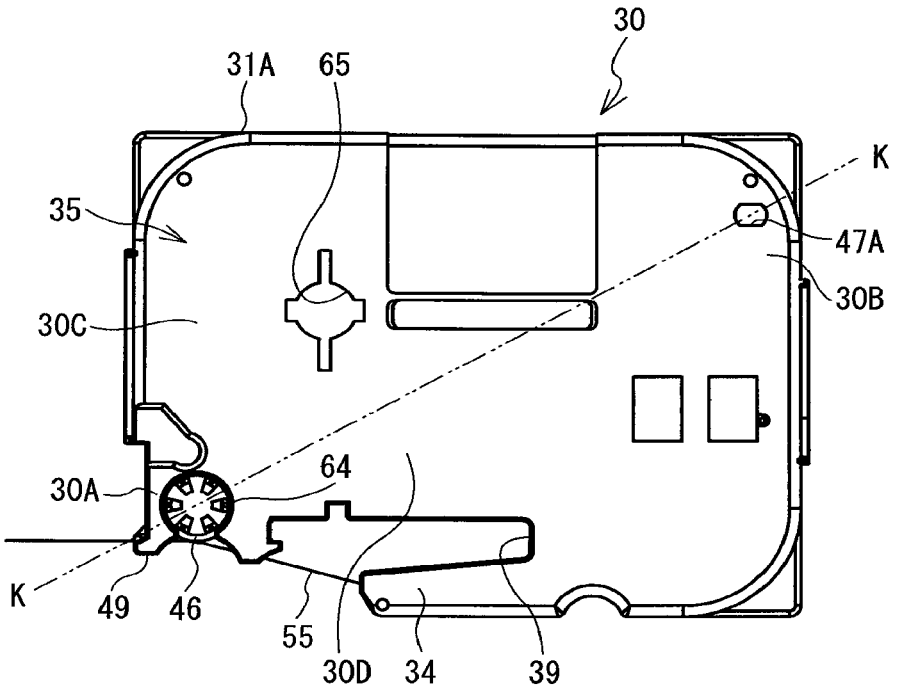
FIG. 20 is a plan view of the tape cassette 30 according to the variant of the first embodiment.

As shown in FIGS. 20 and 21, a dedicated tape cassette 30 for the thermal type capable of housing only the heat-sensitive paper tape may be configured. If the tape cassette 30 is dedicated for the thermal type, the tape cassette 30 may not be configured to house other print medium or an ink ribbon. For that reason, the tape cassette 30 shown in FIGS. 20 and 21 has none of the second tape spool and the second tape support hole 66 for supporting the second tape spool, the ribbon take-up spool 44 and the take-up spool support hole 67 for supporting the ribbon take-up spool 44, and the ribbon spool and the ribbon support hole 68 for supporting the ribbon spool.

Even when such a configuration is employed, the tape cassette 30 may be installed in and removed from the tape printer 1 in a similar manner as described above. Specifically, the three guide shafts (the tape drive shaft 100, the guide shaft 120 and the auxiliary shaft 110) are inserted in the three corresponding guide holes (the roller support hole 64, the guide hole 47 and the first tape support hole 65), respectively, so that the tape cassette 30 is guided to a proper position of the cassette housing portion 8 (refer to FIG. 22).

In the dedicated tape cassette 30 for the thermal type shown in FIGS. 20 and 21, the weight of the first housing area 30C is further heavier relative to the second housing area 30D, due to an absence of the ribbon take-up spool 44 and the like in the second housing area 30D, as compared to the general purpose tape cassette 30 shown in FIGS. 8 and 9. Therefore, the first housing area 30C may be inclined downward more easily when the tape cassette 30 is installed, and thus the tape cassette 30 may be inclined or raised in the cassette housing portion 8 more easily. According to the first embodiment, the auxiliary shaft 110 is inserted in the guide hole 47 that passes through the first housing area 30C as described above so that the tape cassette 30 is guided while being installed or removed. For that reason, even if the weight of the first housing area 30C is heavier in the tape cassette 30, the tape cassette 30 may be prevented from being inclined or raised.

In the first embodiment, the auxiliary shaft 110 that has a slightly smaller diameter than the opening width of the shaft hole 65C is inserted or removed at the center of the opening of the shaft hole 65C of the first tape support hole 65 in a plan view (refer to FIGS. 5, 6 and the like). However, the auxiliary shaft 110 may be positioned in a direction in which the tape cassette 30 to be installed in or removed from the cassette housing portion 8 is likely to incline and contact the internal peripheral surface of the shaft hole 65C in a plan view.

Figure 23:
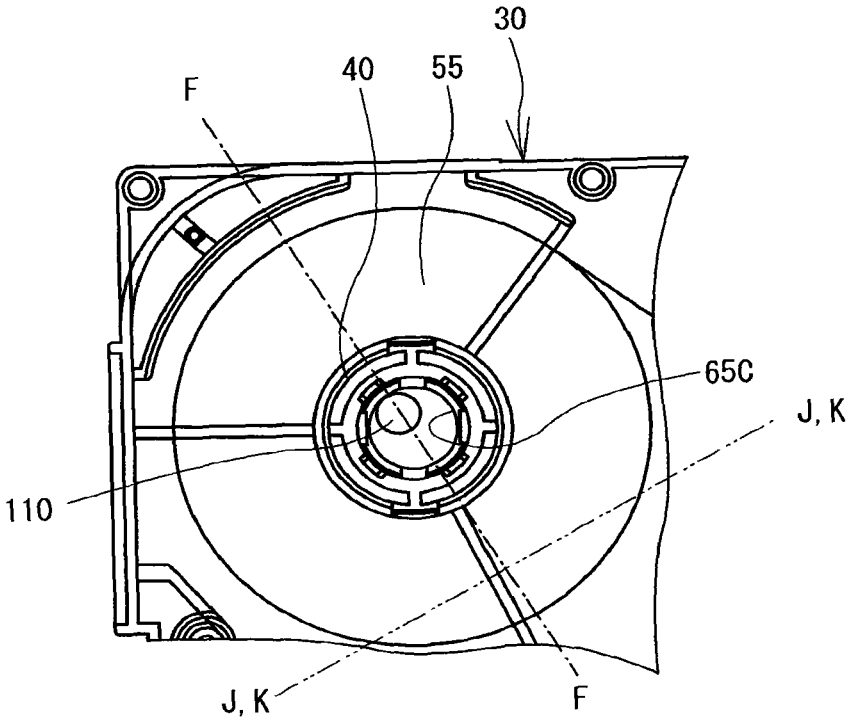
FIG. 23 is a plan view enlarged about the first tape support hole 65 of the cassette housing portion 8 in which the tape cassette 30 is installed according to the variant of the first embodiment.

For example, the auxiliary shaft 110 shown in FIG. 23 has a smaller diameter than the opening width of the shaft hole 65C (about half of the shaft hole 65C). Moreover, the auxiliary shaft 110 shown in FIG. 23 is positioned at the upper left side of the center of the opening of the shaft hole 65C in a plan view when the tape cassette 30 is installed in the cassette housing portion 8. The auxiliary shaft 110 has a smaller diameter than the opening width of the shaft hole 65C, and contacts the rear left portion in a plan view of the internal peripheral surface of the shaft hole 65C (hereinafter referred to as the rear left side surface). For that reason, when the tape cassette 30 is installed or removed, in a similar manner as the first embodiment, the auxiliary shaft 110 contacts the internal peripheral surface of the shaft hole 65C so that the tape cassette 30 is guided along the auxiliary shaft 110 while being installed or removed.

When the tape cassette 30 is guided along the two guide shafts (the tape drive shaft 100 and the guide shaft 120), a direction in which the tape cassette 30 is likely to incline during the installation/removal is a direction F (one-dot chain line in FIG. 23), which is perpendicular to the division line K. The rear left side surface of the shaft hole 65C which the auxiliary shaft 110 shown in FIG. 23 contacts is at the furthest position from the center of rotation (the division line K) in the direction F in a plan view.

In other words, the auxiliary shaft 110 shown in FIG. 23 defines a proper horizontal position of the first tape support hole 65 by the distance from the division line K in a plan view. The auxiliary shaft 110 contacts the rear left side surface of the shaft hole 65C so that the tape cassette 30 is prevented from inclining in the direction F with the division line K as the center of rotation in a plan view. In FIG. 23, the auxiliary shaft 110 is positioned at the rear left side of the center of the opening of the shaft hole 65C, but even if the auxiliary shaft 110 is positioned in other direction (for example, at the left side or rear side of the center of the opening of the shaft hole 65C) in which the tape cassette 30 is likely to incline, similar effects as described above may be obtained.

Second Embodiment

The tape printer 1 and the tape cassette 30 according to a second embodiment will be explained with reference to FIGS. 24 to 31. The second embodiment describes an example in which the tape cassette 30 houses one tape (specifically, a non-heat-sensitive print tape as a print medium) and an ink ribbon, and has two guide holes for guiding the tape cassette 30 when the tape cassette 30 is installed in or removed from the tape printer 1. The second embodiment also describes an example in which the tape printer 1 has two guide shafts for guiding the tape cassette 30 to a proper position corresponding to the two guide holes described above.

Figure 24:
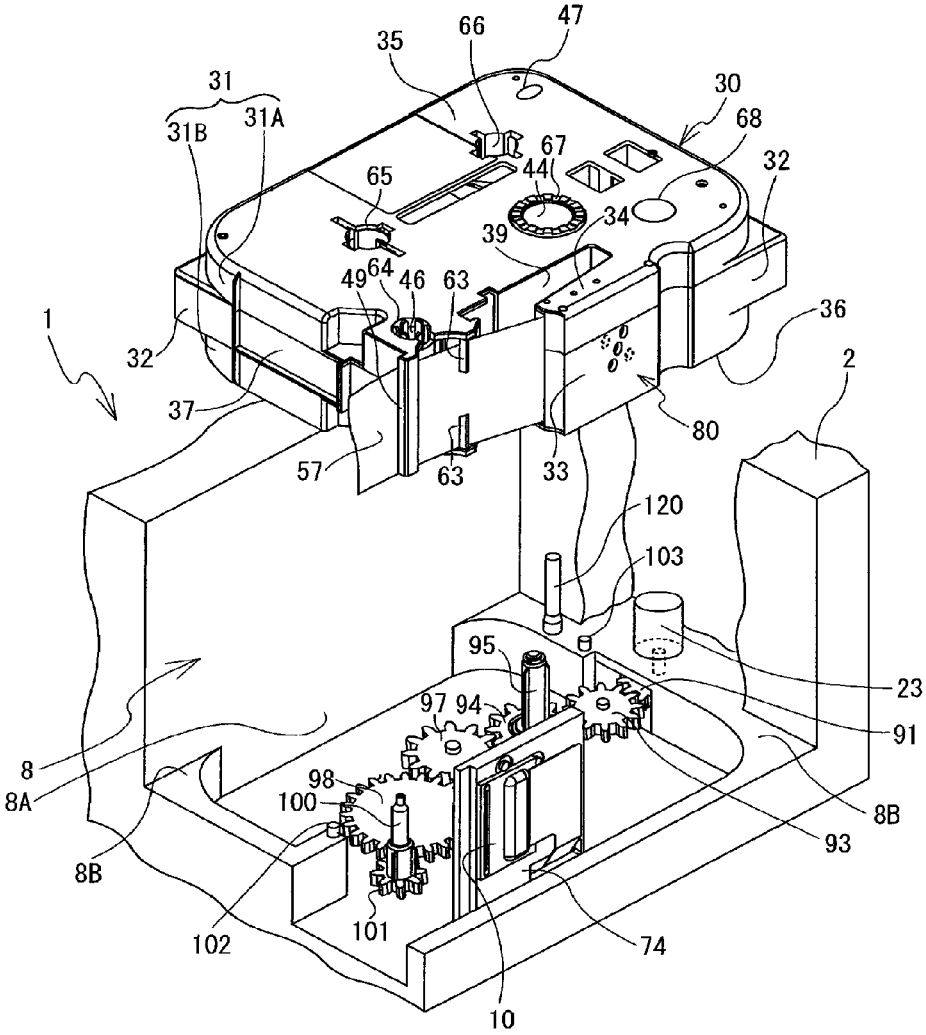
FIG. 24 is a perspective view illustrating the tape cassette 30 and the cassette housing portion 8 according to a second embodiment.
Figure 25:
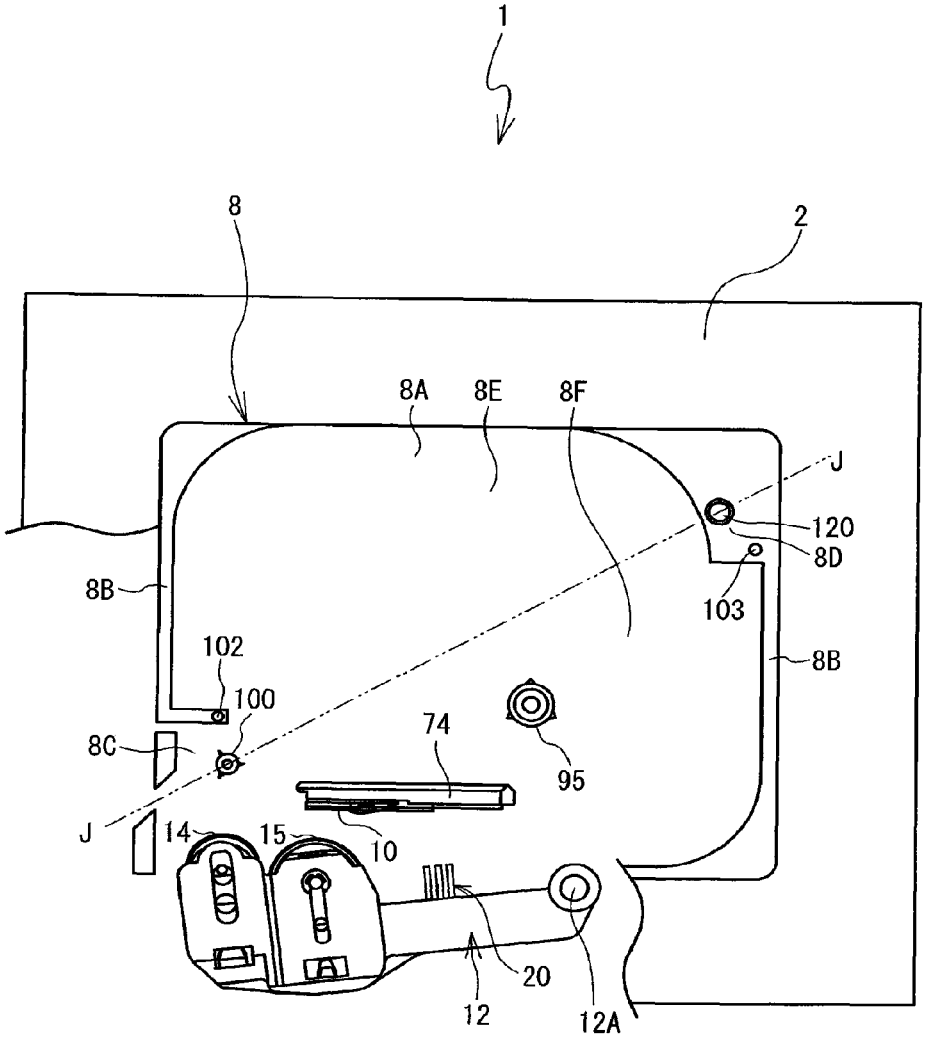
FIG. 25 is a plan view of the cassette housing portion 8 according to the second embodiment.
Figure 26:
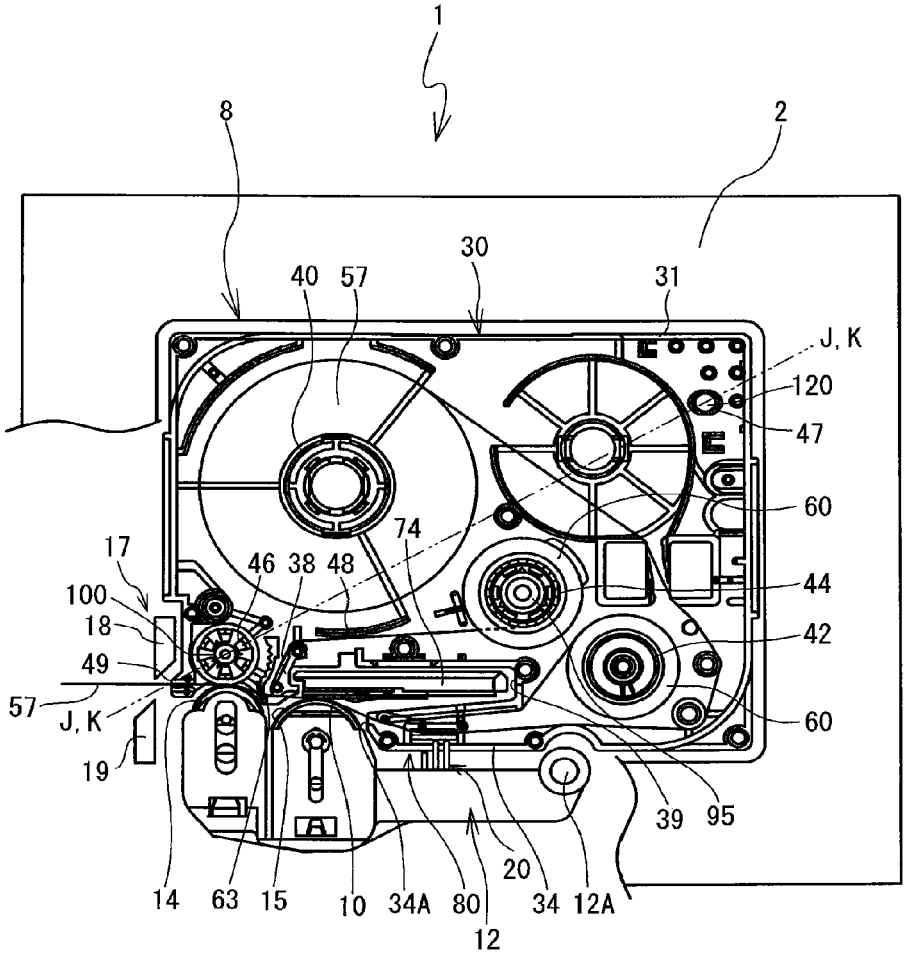
FIG. 26 is a plan view of the cassette housing portion 8 in which the tape cassette 30 is installed according to the second embodiment.

As shown in FIGS. 24 to 26, the tape printer 1 according to the second embodiment is a general purpose device that can commonly use a plurality of types of tape cassettes 30 with various tape types, similar to the tape printer 1 according to the first embodiment (refer to FIGS. 1 to 7). However, the tape printer 1 according to the second embodiment is different from the tape printer 1 according to the first embodiment in that the auxiliary shaft 110 is not provided.

As shown in FIG. 24, the tape cassette 30 according to the second embodiment is a general purpose cassette that may be assembled as various types, similar to the tape cassette 30 according to the first embodiment (refer to FIGS. 3 and 7 to 13). As shown in FIG. 26, in the tape cassette 30 according to the second embodiment, the first tape spool 40 is rotatably supported by the first tape support hole 65. A non-heat-sensitive print tape 57 as the first tape is wound on the first tape spool 40. In addition, a ribbon spool 42 is rotatably supported by the ribbon support hole 68 and an ink ribbon 60 to be used for printing on the print tape 57 is wound on the ribbon spool 42. In other words, the tape cassette 30 according to the second embodiment is assembled as a so-called receptor type tape cassette. The receptor type tape cassette 30 does not need to house other print medium, and thus does not include the second tape spool on which the second tape is wound.

In the tape printer 1 and the tape cassette 30 described above, when printing is performed in the tape printer 1, the tape feed roller 46 that is driven to rotate via the tape drive shaft 100 pulls out the print tape 57 from the first tape spool 40 in concert with the movable feed roller 14. Further, the ribbon take-up spool 44, which is driven to rotate via the ribbon take-up shaft 95, pulls out an unused ink ribbon 60 from the ribbon spool 42 in synchronization with the print speed.

The print tape 57 that has been pulled out from the first tape spool 40 passes the right side of the ribbon support hole 68 is to be fed along the feed path within the arm portion 34. The print tape 57 is supplied from the exit 34A to the head insertion portion 39 in a state in which the ink ribbon 60 is joined to the surface of the print tape 57. The print tape 57 is fed between the thermal head 10 and the platen roller 15 of the tape printer 1. Then, characters are printed on the print surface of the print tape 57 by the thermal head 10. Thereafter, the used ink ribbon 60 is peeled off from the printed print tape 57 at the guide wall 38 and is taken up on the ribbon take-up spool 44. On the other hand, the printed print tape 57 is further fed toward the tape discharge aperture 49, discharged from the discharge aperture 49, and cut by the cutting mechanism 17.

As shown in FIGS. 8, 9 and 26, the positional relationships among the respective portions provided in the tape cassette 30 according to the second embodiment are similar to the first embodiment but are different in the following points. Specifically, the first tape spool 40 on which the print tape 57 is wound is rotatably supported by the first tape support hole 65. For that reason, the center of gravity of the print tape 57 is positioned within the first housing area 30C in a plan view. On the other hand, the ribbon spool 42 on which the unused ink ribbon 60 is wound is rotatably supported by the ribbon support hole 68. The ribbon take-up spool 44 on which the used ink ribbon 60 is wound is rotatably supported by the take-up spool support hole 67. For that reason, the center of gravity of the ink ribbon 60 is positioned within the second housing area 30D in a plan view.

With the above positional relationships, in the tape cassette 30 according to the second embodiment, the weights of the first housing area 30C and the second housing area 30D defined by the division line K are close to each other. A user may vertically insert the tape cassette 30 having such a weight distribution in the cassette housing portion 8, while maintaining the top wall 35 and the bottom wall 36 substantially horizontal with the fingers sandwiching the side wall 37 at both the right and left sides. At this time, weight imbalance in the tape cassette 30 is little so that the tape cassette 30 may be prevented from inclining with the division line K as the center of rotation. Although the print tape 57 is generally heavier than the ink ribbon 60, the difference in weight between the first housing area 30C and the second housing area 30D becomes much smaller due to the weight of the ribbon take-up spool 44 housed in the second housing area 30D. In other words, the weight imbalance of the tape cassette 30 is reduced.

The installation/removal modes of the tape cassette 30 with respect to the cassette housing portion 8 according to the second embodiment will be explained with reference to FIGS. 27 and 28. The relationships in the vertical direction among the respective portions standing upward in the cassette housing portion 8 are similar to the first embodiment except for the absence of the auxiliary shaft 110.

When the user installs the tape cassette 30 in the cassette housing portion 8, the user positions the tape cassette 30 such that the relative positions in a plan view of the roller support hole 64 and the guide hole 47 substantially match those of the tape drive shaft 100 and the guide shaft 120, respectively. Then, the user vertically inserts the tape cassette 30 in the cassette housing portion 8, while maintaining the top wall 35 and the bottom wall 36 substantially horizontal, as described above. When the tape cassette 30 is moved down toward the cassette housing portion 8, as shown in FIG. 27, the upper ends of the tape drive shaft 100 and the guide shaft 120 enter the openings 64B and 47B provided at the bottom wall 36 of the tape cassette 30 substantially at the same time, respectively.

When the tape cassette 30 is moved further down from the state shown in FIG. 27, the tape drive shaft 100 and the guide shaft 120 are inserted in the shaft holes 46D and 47C via the openings 64B and 47B from below, respectively. Then, the tape cassette 30 is guided along the standing direction (that is, the vertical direction) of the tape drive shaft 100 and the guide shaft 120 inserted in the shaft holes 46D and 47C, respectively, and moves down due to its own weight. Then, the head holder 74 having the thermal head 10 is inserted in the head insertion portion 39, and the ribbon take-up shaft 95 is inserted in the shaft hole 44C via the opening 67B from below.

Figure 28:
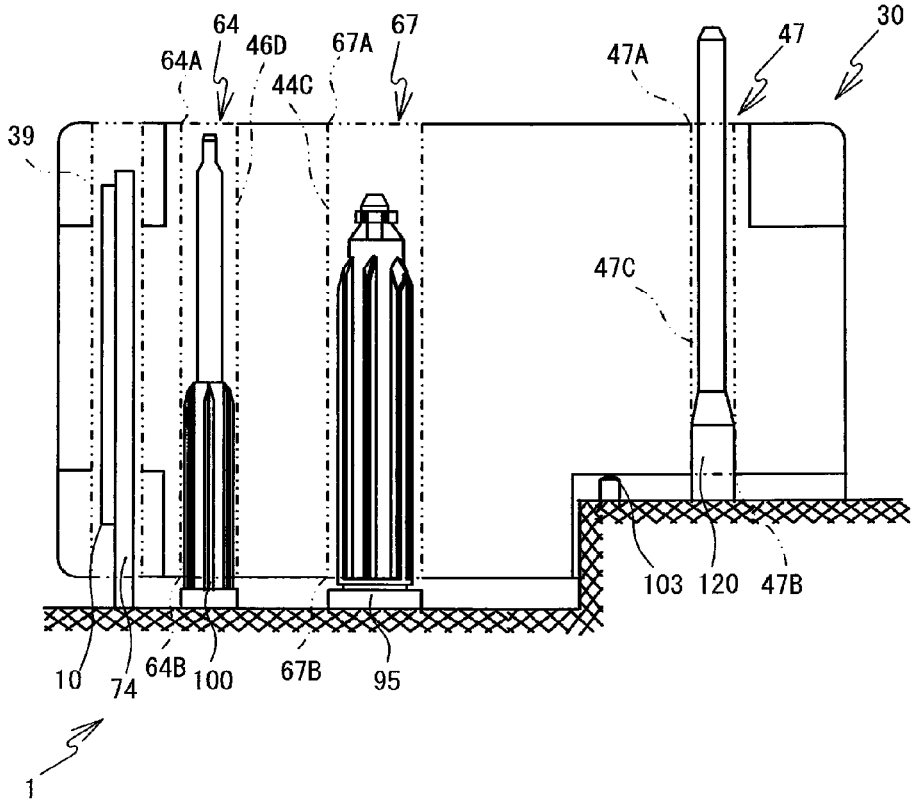
FIG. 28 is a right side view showing a state in which the tape cassette 30 is installed in the cassette housing portion 8 according to the second embodiment.

As shown in FIG. 28, as the tape cassette 30 is moved down along the tape drive shaft 100 and the guide shaft 120, the positioning pin 103 standing upward on the cassette support portion 8B contacts the lower surface of the common portion 32 provided at the rear right portion of the tape cassette 30. At the same time, although not shown in FIG. 28, the positioning pin 102 standing upward on the cassette support portion 8B is inserted in the pin hole 53, and the upper end of the positioning pin 102 contacts the ceiling wall of the interior of the pin hole 53. In this manner, in the second embodiment, the tape cassette 30 is guided to a proper position of the cassette housing portion 8 by the two guide shafts (the tape drive shaft 100 and the guide shaft 120). Then, the tape cassette 30 is positioned at a proper horizontal position by the guide shaft 120 and the positioning pin 102, and is positioned at a proper height position by the positioning pins 102 and 103. Also when the tape cassette 30 is removed from the cassette housing portion 8, the tape cassette 30 is guided upward along the two guide shafts.

The guide hole 47 according to the second embodiment has an ellipse-shaped opening having a long diameter (major axis) in the left-right direction and a short diameter (minor axis) in the front-rear direction in a plan view. The diameters (the major axis and the minor axis) of the guide hole 47 are both larger than the diameter of the small-diameter shaft portion 120B of the guide shaft 120. The opening width of the guide hole 47 in the left-right direction is larger than the opening width in the front-rear direction. Since a length of the minor axis of the guide hole 47 is substantially equal to the diameter of the large-diameter shaft portion 120A of the guide shaft 120, the guide shaft 120 is inserted in the guide hole 47 to be tightly engaged with the large-diameter shaft portion 120A in the front-rear direction while looseness is allowed in the left-right direction of the large-diameter shaft portion 120A. Thus, similar to the first embodiment, the corresponding holes (the roller hole 64 and the guide hole 47) of the tape cassette 30 do not need to be accurately positioned with respect to all the two guide shafts (the tape drive shaft 100 and the guide shaft 120) provided in the cassette housing portion 8. Thus, the user's load may be reduced when the user installs the tape cassette 30. Further, the tape cassette 30 can be smoothly installed and removed while maintaining the print quality.

The tape cassette 30 according to the second embodiment has a weight distribution such that the weights of the first housing area 30C and the second housing area 30D are close to each other. For that reason, an inclination due to the own weight of the tape cassette 30 may be less likely to occur in the process of the installation of the tape cassette 30 in the cassette housing portion 8. Thus, even when the auxiliary shaft 110 is not provided, unlike the first embodiment, the tape cassette 30 may be guided to a proper position in the cassette housing portion 8 by the two guide shafts (the tape drive shaft 100 and the guide shaft 120).

Furthermore, the tape cassette 30 is guided in the vertical direction at the two points, that is, a pair of corner portions on a diagonal of the tape cassette 30 (specifically, the roller support hole 64 and the guide hole 47) in a plan view. In other words, the tape cassette 30 is guided in the installation/removal direction about the division line K that passes between the center of gravity of the print tape 57 and the center of gravity of the ink ribbon 60. For that reason, a positional displacement or an inclination may be appropriately prevented when the tape cassette 30 is installed in the cassette housing portion 8.

In the second embodiment, the receptor type tape cassette 30 formed from a general purpose cassette is used in the general purpose tape printer 1. However, a dedicated tape cassette for the receptor type may be configured, or the tape cassette 30 of the second embodiment may be used in a dedicated tape printer for the receptor type.

Figure 29:
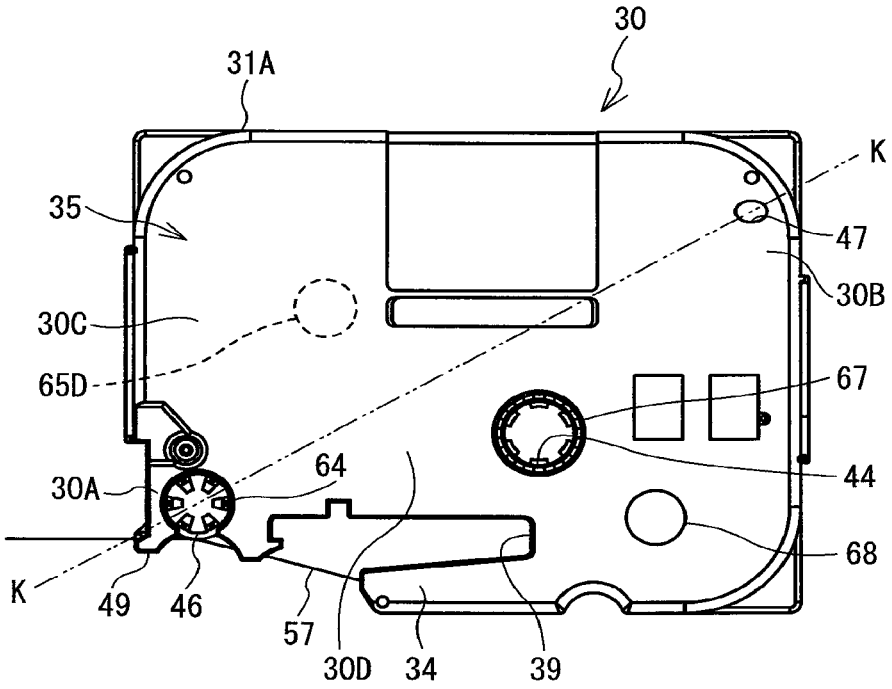
FIG. 29 is a plan view of the cassette housing portion 8 according to a variant of the second embodiment.
Figure 30:
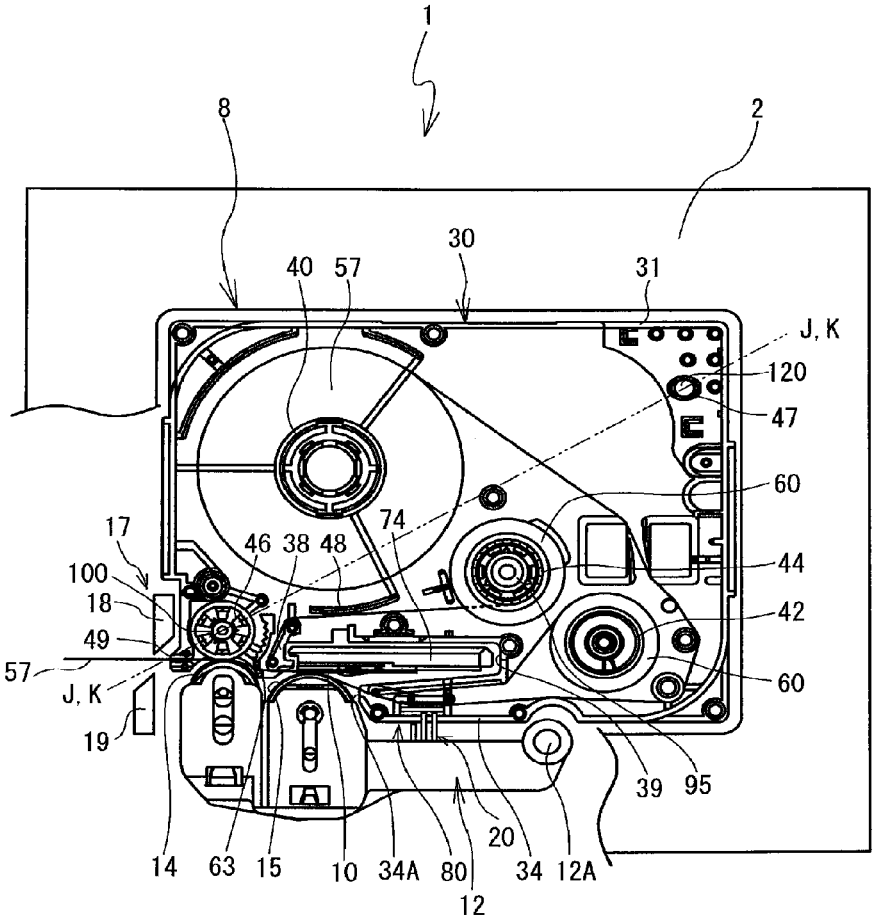
FIG. 30 is a plan view of the cassette housing portion 8 in which the tape cassette 30 is installed according to the variant of the second embodiment.

For example, as shown in FIGS. 29 and 30, a dedicated tape cassette 30 for the receptor type capable of housing only a print tape 57 and an ink ribbon 60. If the tape cassette 30 is dedicated for the receptor type, the tape cassette 30 may not be configured to house other print medium. For that reason, the tape cassette 30 shown in FIGS. 29 and 330 has none of the second tape spool and the second tape support hole 66 for supporting the second tape spool.

Moreover, since the tape printer 1 according to the second embodiment does not include the auxiliary shaft 110, the first tape support hole 65 in which the auxiliary shaft 110 is to be inserted may not be provided in the tape cassette 30. For example, as shown in FIG. 29, a cylindrical wall portion 65D that rotatably supports the first tape spool 40 within the cassette case 31 may be provided between the top wall 35 and the bottom wall 36, instead of the first tape support hole 65.

Also with such a configuration, the tape cassette 30 can be installed in and removed from the tape printer 1 in a similar manner as in the second embodiment. Specifically, the two guide shafts (the tape drive shaft 100 and the guide shaft 120) are inserted in the two corresponding guide holes (the roller support hole 64 and the guide hole 47), respectively, so that the tape cassette 30 is guided to a proper position in the cassette housing portion 8 (refer to FIG. 28).

In the second embodiment, the weight distribution of the tape cassette 30 is adjusted with the configuration in which the center of gravity of the print tape 57 is positioned in the first housing area 30C and the center of gravity of the ink ribbon 60 is positioned in the second housing area 30D. However, the weight of the print tape 57 varies depending on a thickness of the tape or of a material of the tape. For example, when the print tape 57 that is heavy due to its material nature or the like is used, the center of gravity of the tape cassette 30 may not be positioned on the line connecting the two guide holes (the roller support hole 64 and the guide hole 47), and may shift toward the side of the first housing area 30C.

Figure 31:
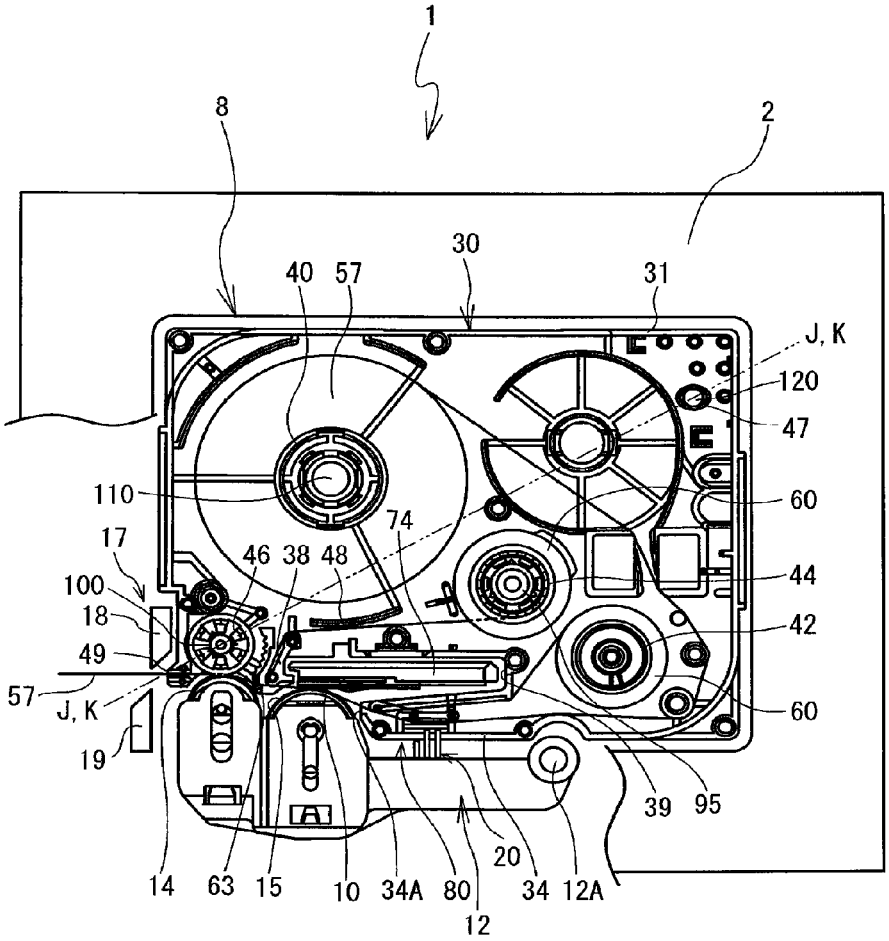
FIG. 31 is a plan view of the cassette housing portion 8 in which the tape cassette 30 is installed according to another variant of the second embodiment.

In this case, as shown in FIG. 31, the tape cassette 30 may be provided with the first tape support hole 65 (refer to FIG. 24) and the tape printer 1 may be provided with the auxiliary shaft 110 (refer to FIGS. 3, 4 and the like) as in the case of the first embodiment. With this configuration, the tape cassette 30 may be guided not only by the two guide shafts (the tape drive shaft 100 and the guide shaft 120) but also by the auxiliary shaft 110 when installed in and removed from the cassette housing portion 8, similar to the first embodiment (refer to FIGS. 14 to 16). In other words, even when the center of gravity of the entire tape cassette 30 is shifted toward the side of the first housing area 30C due to the heavy print tape 57, the tape cassette 30 may be smoothly installed in the cassette housing portion 8 similar to the first embodiment.

Third Embodiment

The tape printer 1 and the tape cassette 30 according to a third embodiment will be explained with reference to FIGS. 32 to 35. The third embodiment describes an example in which the tape cassette 30 houses a tape (specifically, a heat-sensitive paper tape as a print medium) therein, and has two guide holes for guiding the tape cassette 30 when the tape cassette 30 is installed in or removed from the tape printer 1. The third embodiment also describes an example in which the tape printer 1 has two guide shafts for guiding the tape cassette 30 to a proper position corresponding to the two guide holes described above.

Figure 32:
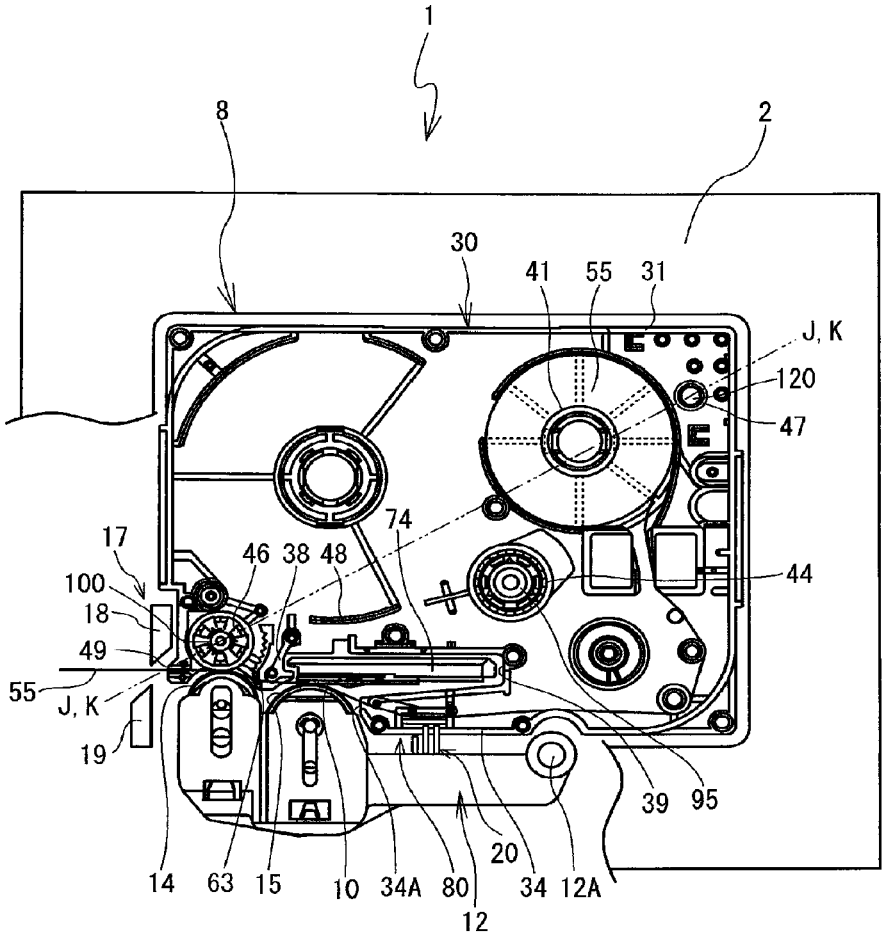
FIG. 32 is a plan view of the cassette housing portion 8 in which the tape cassette 30 is installed according to a third embodiment.

As shown in FIG. 32, the tape printer 1 according to the third embodiment is a general purpose device that can commonly use a plurality of tape cassettes 30 with various tape types. Similar to the tape printer 1 according to the second embodiment (refer to FIGS. 24 to 26), the tape printer 1 according to the third embodiment is not provided with the auxiliary shaft 110 unlike the first embodiment.

The tape cassette 30 according to the third embodiment is a general purpose cassette that can be assembled as various types, similar to the tape cassette 30 according to the first embodiment (refer to FIGS. 3 and 7 to 13). As shown in FIG. 32, in the tape cassette 30 according to the third embodiment, the second tape spool 41 is rotatably supported by the second tape support hole 66, and the heat-sensitive paper tape 55 as the second tape is wound on the second tape spool 41. In other words, the tape cassette 30 according to the third embodiment is assembled as a so-called thermal type tape cassette. Since the thermal type tape cassette 30 does not need to house other print medium and an ink ribbon, the tape cassette 30 does not include the first tape spool on which the first tape is wound and the ribbon spool on which the ink ribbon is wound.

In the tape printer 1 and the tape cassette 30 explained above, printing is performed on the heat-sensitive paper tape 55 similar to the first embodiment. However, the heat-sensitive paper tape 55 is pulled out from the second tape spool 41, unlike the first embodiment.

As shown in FIGS. 8, 9 and 32, the positional relationships among the respective portions provided in the tape cassette 30 according to the third embodiment are similar to those of the first embodiment but are different in the following points. Specifically, the second tape spool 41, on which the heat-sensitive paper tape 55 is wound, is rotatably supported by the second tape support hole 66. For that reason, the center of gravity of the heat-sensitive paper tape 55 is positioned on the division line K in a plan view.

With the above positional relationships, in the tape cassette 30 according to the third embodiment, the center of gravity of the entire tape cassette 30 is positioned on or in the vicinity of the division line K in a plan view. The user may vertically insert the tape cassette 30 having such a weight distribution in the cassette housing portion 8 while maintaining the top wall 35 and the bottom wall 36 substantially horizontal with the fingers sandwiching the side wall 37 at both the right and left sides. At this time, since the center of gravity of the tape cassette 30 is positioned on or in the vicinity of the division line K, the tape cassette 30 may be prevented from inclining with the division line K as the center of rotation.

Figure 27:
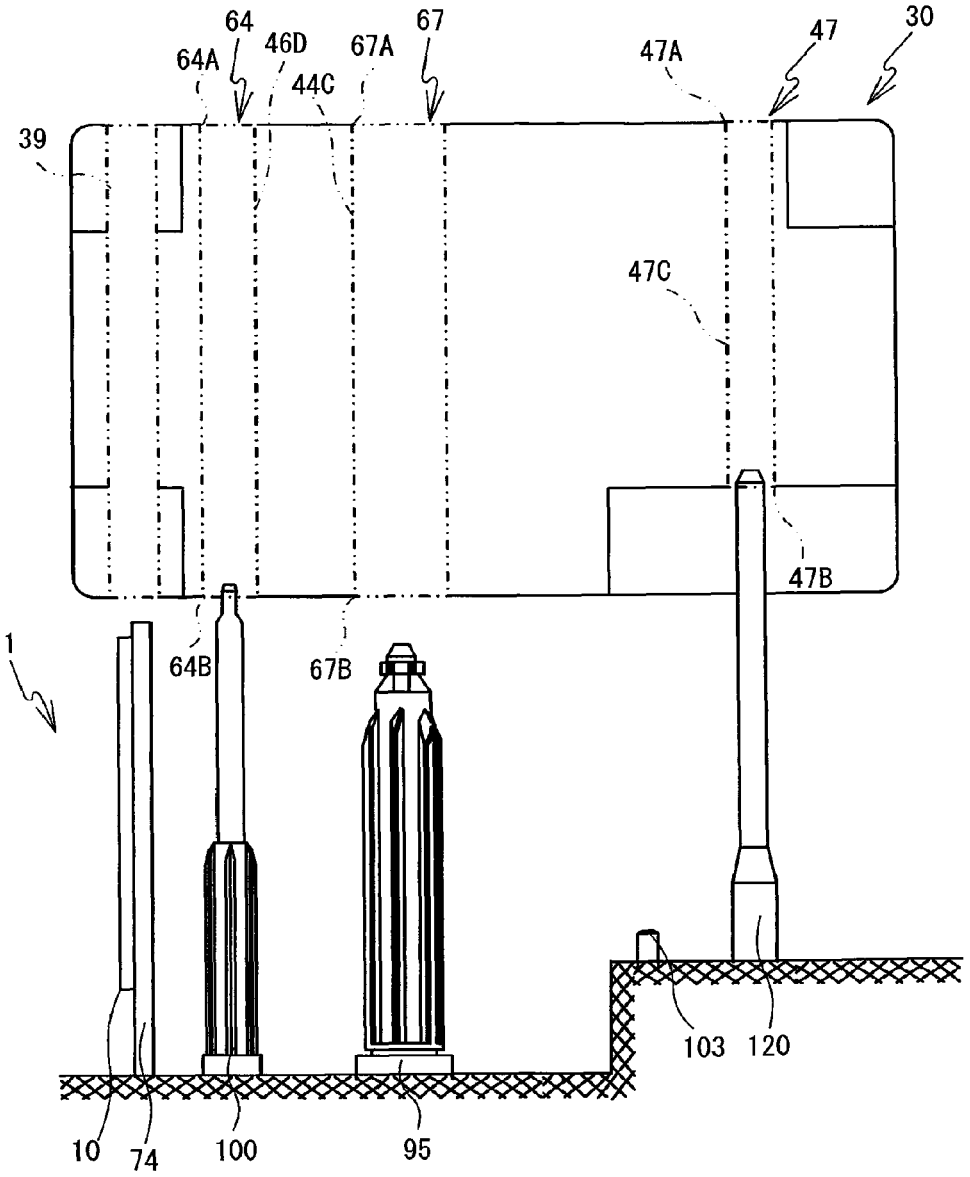
FIG. 27 is a right side view showing an installation process of the tape cassette 30 in the cassette housing portion 8 according to the second embodiment.

The installation/removal modes of the tape cassette 30 with respect to the cassette housing portion 8 according to the third embodiment are similar to those in the second embodiment (refer to FIGS. 27 and 28). Specifically, the tape cassette 30 is guided to a proper position in the cassette housing portion 8 by the two guide shafts (the tape drive shaft 100 and the guide shaft 120). Also when the tape cassette 30 is removed from the cassette housing portion 8, the tape cassette 30 is guided upward along the two guide shafts.

The guide hole 47 according to the third embodiment has a circular opening in a plan view, and its opening width is larger than the diameter of the small-diameter shaft portion 120B of the guide shaft 120. For that reason, similar to the first embodiment, the corresponding holes (the roller support hole 64 and the guide hole 47) of the tape cassette 30 do not need to be accurately positioned with respect to all the two guide shafts (the tape drive shaft 100 and the guide shaft 120) provided in the cassette housing portion 8. Therefore, the user's load may be reduced at the installation of the tape cassette 30. The diameter of the guide hole 47 according to the third embodiment is substantially equal to the diameter of the large-diameter shaft portion 120A of the guide shaft 120. For that reason, when the guide shaft 120 is inserted in the guide hole 47, the large-diameter shaft portion 120A is tightly engaged in all the circumferential directions of the guide hole 47. Therefore, the tape cassette 30 installed in the cassette housing portion 8 may be more accurately positioned at a proper horizontal position.

The tape cassette 30 according to the third embodiment has a weight distribution such that the center of gravity of the tape cassette 30 is on or in the vicinity of the division line K in a plan view. For that reason, an inclination due to the own weight of the tape cassette 30 may be less likely to occur in the process of the installation of the tape cassette 30 in the cassette housing portion 8. Thus, even when the auxiliary shaft 110 is not provided unlike the first embodiment, the tape cassette 30 may be guided to the proper position in the cassette housing portion 8 by the two guide shafts (the tape drive shaft 100 and the guide shaft 120).

Further, the tape cassette 30 is guided in the vertical direction at the two points, that is, a pair of corner portions on a diagonal of the tape cassette 30 (specifically, the roller support hole 64 and the guide hole 47) in a plan view. In other words, the tape cassette 30 is guided in the installation/removal direction about the division line K that passes through or in the vicinity of the center of gravity of the heat-sensitive paper tape 55. For that reason, a positional displacement or an inclination may be appropriately prevented when the tape cassette 30 is installed in the cassette housing portion 8.

In the third embodiment, the thermal type tape cassette 30 formed from a general purpose cassette is used in the general purpose tape printer 1. However, a dedicated tape cassette for the thermal type may be configured, or the tape cassette 30 of the third embodiment may be used in a dedicated tape printer for the thermal type.

Figure 34:
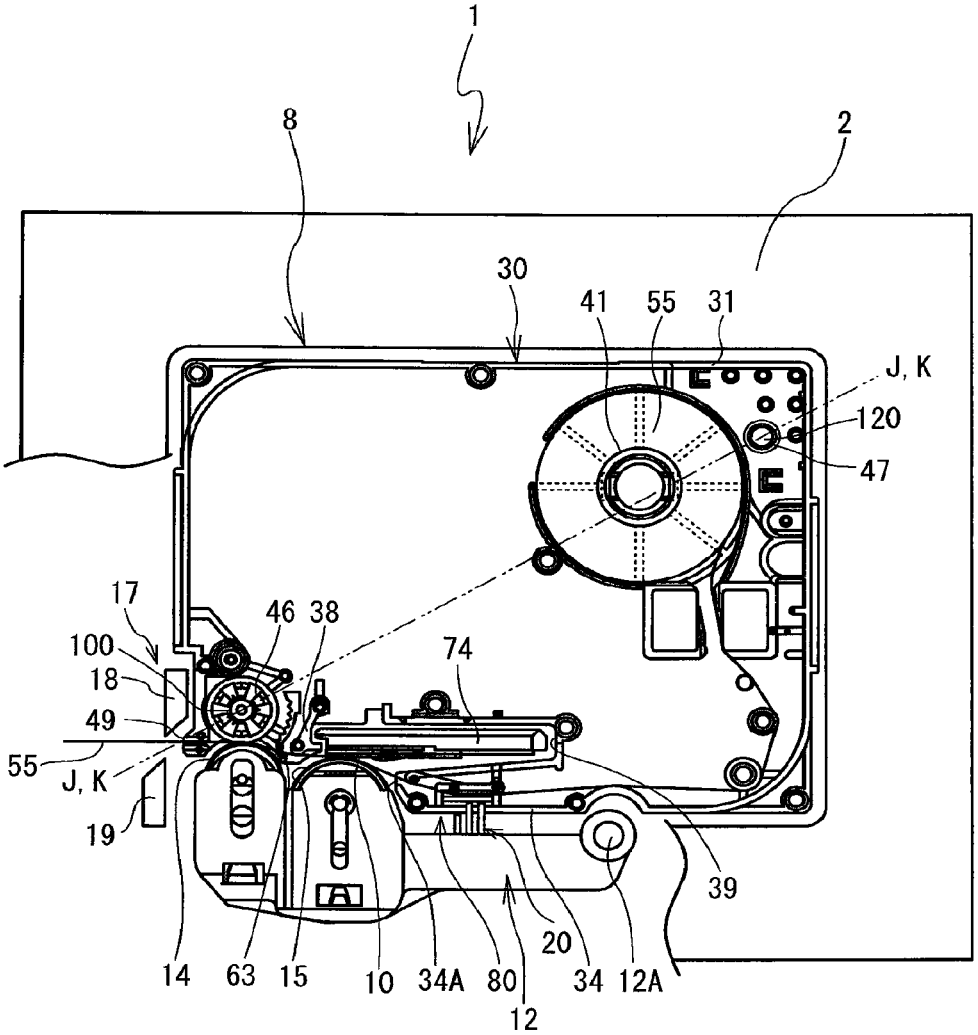
FIG. 34 is a plan view of the cassette housing portion 8 in which the tape cassette 30 is installed according to the variant of the third embodiment.

For example, as shown in FIGS. 19 and 34, a tape printer 1 dedicated for the thermal type may be configured. An ink ribbon is not used for printing on the print medium with the thermal type. Therefore, as described above with reference to FIG. 19, the tape printer 1 dedicated for the thermal type does not include the ribbon take-up shaft 95. Further, the tape printer 1 shown in FIG. 34 does not include the auxiliary shaft 110 unlike the tape printer 1 shown in FIG. 19. (refer to FIG. 34).

Figure 33:
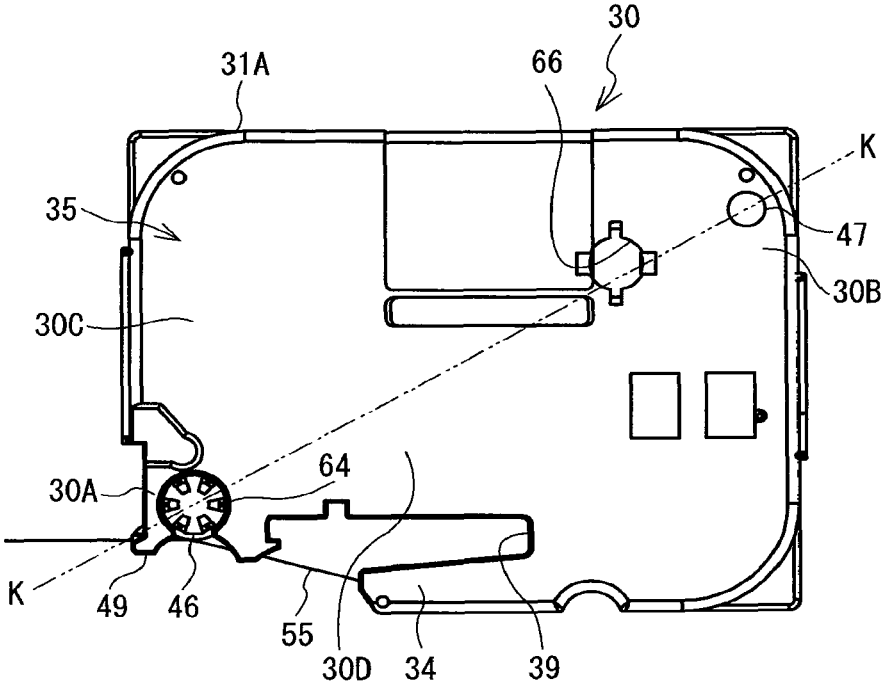
FIG. 33 is a plan view of the tape cassette 30 according to a variant of the third embodiment.

As shown in FIGS. 33 and 34, a dedicated tape cassette 30 for the thermal type capable of housing only the heat-sensitive paper tape may be configured. Unlike the tape cassette 30 dedicated for the thermal type shown in FIGS. 20 and 21, the tape cassette 30 dedicated for the thermal type shown in FIGS. 33 and 34 is configured to house the heat-sensitive paper tape 55 on the division line K. For that reason, the tape cassette 30 shown in FIGS. 33 and 34 has none of the first tape spool and the first tape support hole 65 for supporting the first tape spool, the ribbon take-up spool 44 and the take-up spool support hole 67 for supporting the ribbon take-up spool 44, and the ribbon spool and the ribbon support hole 68 for supporting the ribbon spool.

Figure 35:
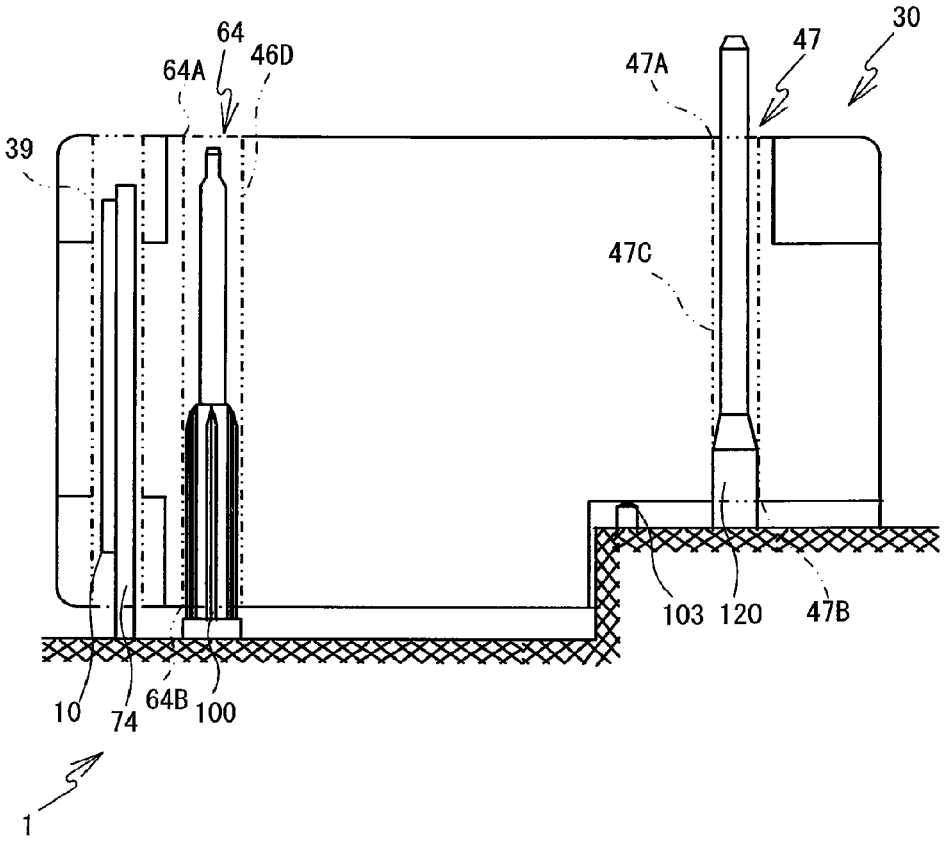
FIG. 35 is a right side view showing a state in which the tape cassette 30 is installed in the cassette housing portion 8 according to the variant of the third embodiment.

Also with such a configuration, the tape cassette 30 may be installed in and removed from the tape printer 1 in a similar manner as above. In other words, as shown in FIG. 35, the two guide shafts (the tape drive shaft 100 and the guide shaft 120) are inserted in the two corresponding guide holes (the roller support hole 64 and the guide hole 47), respectively, so that the tape cassette 30 is guided to the proper position in the cassette housing portion 8.

Fourth Embodiment

The tape printer 1 and the tape cassette 30 according to a fourth embodiment will be explained with reference to FIGS. 36 and 37. The fourth embodiment describes an example in which the tape cassette 30 houses two tapes (specifically, a double-sided adhesive tape and a film tape as a print medium tape) and an ink ribbon, and has two guide holes for guiding the tape cassett 30 when the tape cassette 30 is installed in or removed from the tape printer 1. The fourth embodiment also describes an example in which the tape printer 1 has two guide shafts for guiding the tape cassette 30 to a proper position corresponding to the two guide holes described above.

Figure 36:
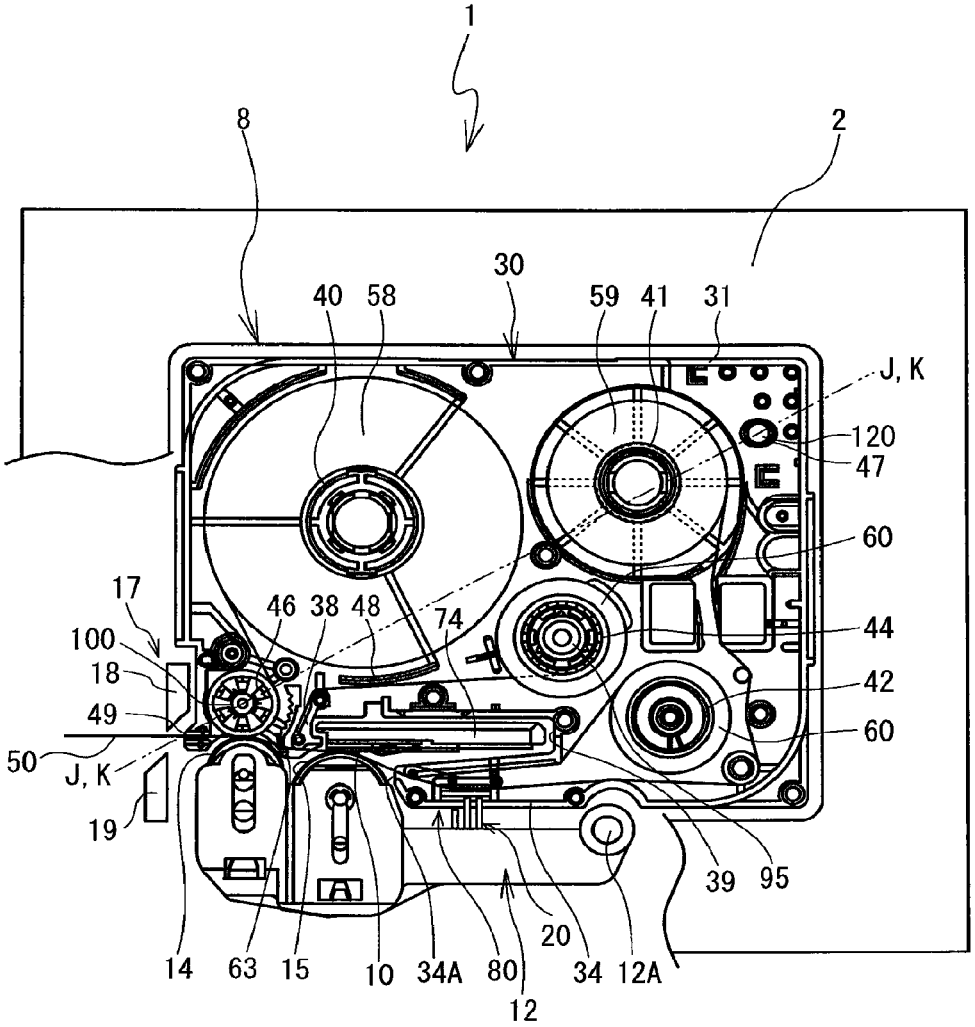
FIG. 36 is a plan view of the cassette housing portion 8 in which the tape cassette 30 is installed according to a fourth embodiment.
Figure 37:
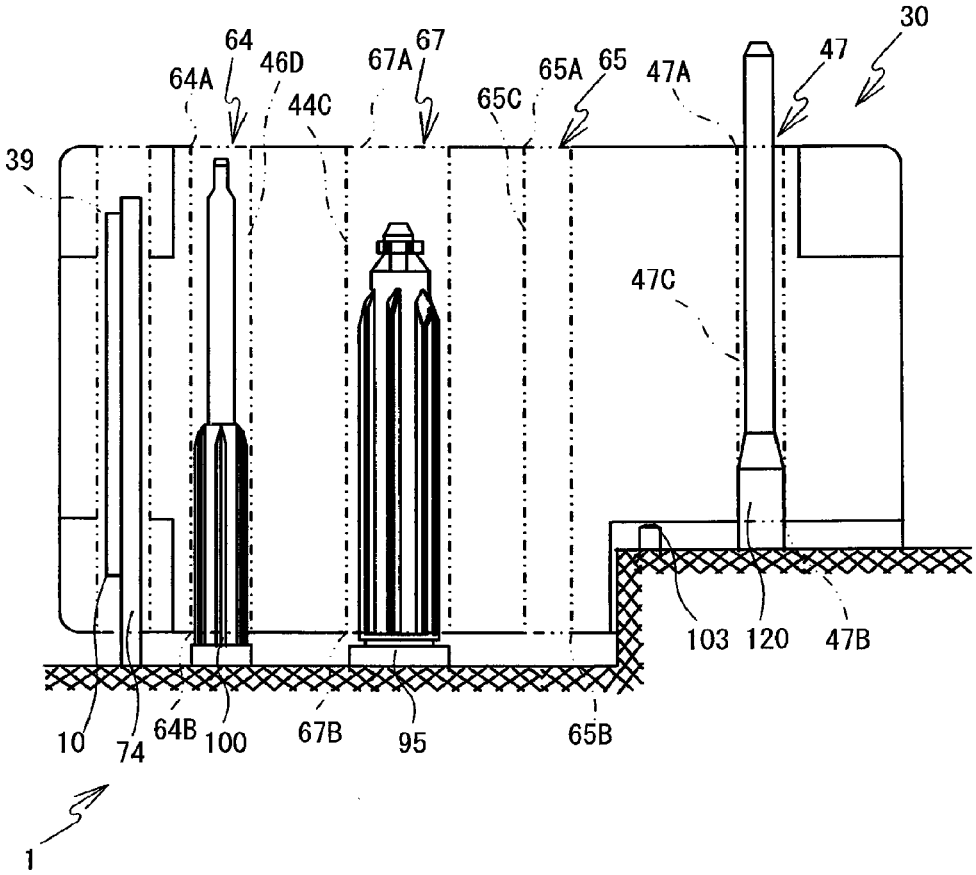
FIG. 37 is a right side view showing a state in which the tape cassette 30 is installed in the cassette housing portion 8 according to the fourth embodiment.
Figure 38:
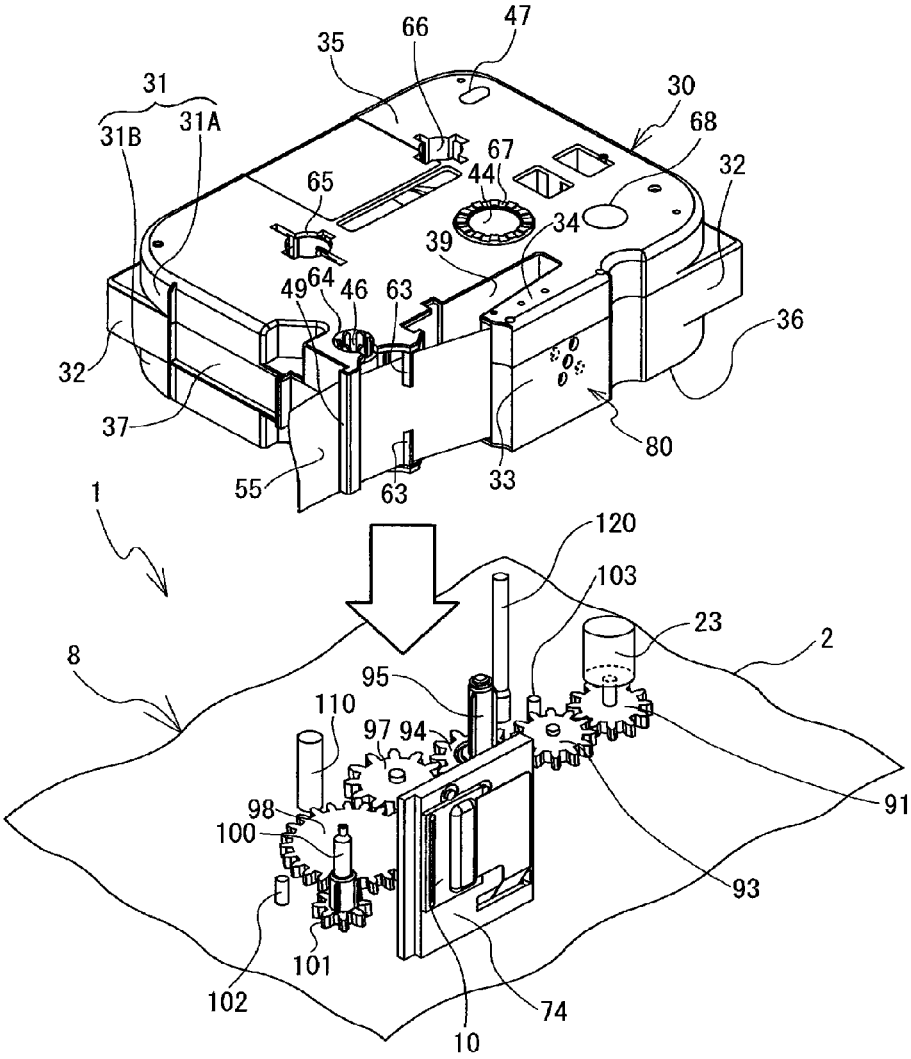
FIG. 38 is a perspective view illustrating the tape cassette 30 and the cassette housing portion 8 according to a first modified embodiment.

As shown in FIGS. 36 and 37, the tape printer 1 according to the fourth embodiment is a general purpose device that can commonly use a plurality of tape cassettes 30 with various tape types, similar to the tape printer 1 according to the second embodiment (refer to FIGS. 24 to 26). Unlike the first embodiment, the tape printer 1 according to the fourth embodiment is not provided with the auxiliary shaft 110.

The tape cassette 30 according to the fourth embodiment is a general purpose cassette that can be assembled as various types, similar to the tape cassette 30 according to the first embodiment (refer to FIGS. 3 and 7 to 13). As shown in FIGS. 36 and 37, in the tape cassette 30 according to the fourth embodiment, the first tape spool 40 is rotatably supported by the first tape support hole 65, and a double-sided adhesive tape 58 as a first tape is wound on the first tape spool 40. The second tape spool 41 is rotatably supported by the second tape support hole 66, and a film tape 59 as a second tape is wound on the second tape spool 41. The ribbon spool 42 is rotatably supported by the ribbon support hole 68, and the ink ribbon 60 is wound on the ribbon spool 42. In other words, the tape cassette 30 according to the fourth embodiment is assembled as a so-called laminated type tape cassette.

In the tape printer 1 and the tape cassette 30 according to the fourth embodiment, when printing is performed in the tape printer 1, the tape feed roller 46 that is driven to rotate via the tape drive shaft 100 pulls out the film tape 59 from the second tape spool 41 in concert with the movable feed roller 14. Further, the ribbon take-up spool 44, which is driven to rotate via the ribbon take-up shaft 95, pulls out the unused ink ribbon 60 from the ribbon spool 42 in synchronization with the print speed.

The film tape 59 that has been pulled out from the second tape spool 41 passes the right side of the ribbon support hole 68 to be fed along the feed path within the arm portion 34. Further, the film tape 59 is supplied from the exit 34A to the head insertion portion 39 in a state in which the ink ribbon 60 is joined to the surface of the film tape 59. The film tape 59 and the ink ribbon 60 are fed between the thermal head 10 and the platen roller 15 of the tape printer 1. Then, characters are printed onto the print surface of the film tape 59 by the thermal head 10. Thereafter, the used ink ribbon 60 is peeled off from the printed film tape 59 at the guide wall 38, and is wound onto the ribbon take-up spool 44.

Meanwhile, the double-sided adhesive tape 58 is pulled out from the first tape spool 40 in concert with the tape feed roller 46 and the movable feed roller 14. While being guided and caught between the tape feed roller 46 and the movable feed roller 14, the double-sided adhesive tape 58 is layered onto and affixed to the print surface of the printed film tape 59. The printed film tape 59 to which the double-sided adhesive tape 58 has been affixed (that is, the printed tape 50) is further fed toward the tape discharge aperture 49, discharged from the discharge aperture 49, and cut by the cutting mechanism 17.

As shown in FIGS. 8, 9 and 36, the positional relationships among the respective portions provided in the tape cassette 30 according to the fourth embodiment are similar to the first embodiment, but are different in the following points. Specifically, the first tape spool 40 on which the double-sided adhesive tape 58 is wound is rotatably supported by the first tape support hole 65. For that reason, the center of gravity of the double-sided adhesive tape 58 is positioned within the first housing area 30C in a plan view.

On the other hand, the ribbon spool 42 on which the unused ink ribbon 60 is wound is rotatably supported by the ribbon support hole 68. The ribbon take-up spool 44 on which the used ink ribbon 60 is wound is rotatably supported by the take-up spool support hole 67. For that reason, the center of gravity of the ink ribbon 60 is positioned within the second housing area 30D in a plan view. The second tape spool 41 on which the film tape 59 is wound is rotatably supported by the second tape support hole 66. For that reason, the center of gravity of the film tape 59 is positioned on the division line K in a plan view.

With the above positional relationships, in the tape cassette 30 according to the fourth embodiment, the weights of the first housing area 30C and the second housing area 30D defined by the division line K are close to each other. Further, the center of gravity of the entire tape cassette 30 is positioned on or in the vicinity of the division line K in a plan view. The user may vertically insert the tape cassette 30 having such a weight distribution in the cassette housing portion 8 while maintaining the top wall 35 and the bottom wall 36 substantially horizontal with the fingers sandwiching the side wall 37 at both the right and left sides.

At this time, since an weight imbalance in the tape cassette 30 is little, and additionally the center of gravity of the tape cassette 30 is positioned on or in the vicinity of the division line K, the tape cassette 30 may be prevented from inclining with the division line K as the center of rotation. Further, although the double-sided adhesive tape 58 is generally heavier than the ink ribbon 60, the difference in weight between the first housing area 30C and the second housing area 30D becomes much smaller due to the weight of the ribbon take-up spool 44 (that is, the weight imbalance of the tape cassette 30 can be reduced with the ribbon take-up spool 44).

The installation/removal modes of the tape cassette 30 with respect to the cassette housing portion 8 according to the fourth embodiment is similar to the second embodiment (refer to FIGS. 27 and 28). Specifically, as shown in FIG. 37, the tape cassette 30 is guided to a proper position in the cassette housing portion 8 by the two guide shafts (the tape drive shaft 100 and the guide shaft 120). Also when the tape cassette 30 is removed from the cassette housing portion 8, the tape cassette 30 is guided upward along the two guide shafts.

The guide hole 47 according to the fourth embodiment has a substantially rectangular opening with rounded four corners in a plan view. The opening width of the guide hole 47 in the left-right direction is larger than the opening width in the front-rear direction in a plan view. The both opening widths of the guide hole 47 in the front-rear direction and the left-right direction are larger than the diameter of the small-diameter shaft portion 120B of the guide shaft 120. The opening width in the left-right direction is larger than the opening width in the front-rear direction. The opening width of the guide hole 47 in the front-rear direction is substantially equal to the diameter of the large-diameter shaft portion 120A of the guide shaft 120. Therefore, the guide shaft 120 is inserted with the large-diameter shaft portion 120A to be tightly engaged in the front-rear direction and looseness is allowed in the left-right direction of the large-diameter shaft portion 120A.

Thus, similar to the first embodiment, the corresponding holes (the roller support hole 64 and the guide hole 47) of the tape cassette 30 do not need to be accurately positioned with respect to all the two guide shafts (the tape drive shaft 100 and the guide shaft 120) provided in the cassette housing portion 8. Therefore, the user's load may be reduced at the installation of the tape cassette 30. Further, the tape cassette 30 can be smoothly installed and removed while maintaining the print quality.

The tape cassette 30 according to the fourth embodiment has a weight distribution such that the weights of the first housing area 30C and the second housing area 30D are close to each other, and the center of gravity of the tape cassette 30 is positioned on or in the vicinity of the division line K in a plan view. For that reason, an inclination due to the own weight of the tape cassette 30 may be less likely to occur in the process of the installation of the tape cassette 30 in the cassette housing portion 8. Thus, even when the auxiliary shaft 110 is not provided, unlike the first embodiment, the tape cassette 30 may be guided to the proper position of the cassette housing portion 8 by the two guide shafts (the tape drive shaft 100 and the guide shaft 120).

Further, the tape cassette 30 is guided in the vertical direction at two points, that is, a pair of corner portions (specifically, the roller support hole 64 and the guide hole 47) on the diagonal of the tape cassette 30 in a plan view. In other words, the tape cassette 30 is guided in the installation/removal direction about the division line K that passes between the center of gravity of the double-sided adhesive tape 58 and the center of gravity of the ink ribbon 60 and that passes through or in the vicinity of the center of gravity of the film tape 59. For that reason, a positional displacement or an inclination may be appropriately prevented when the tape cassette 30 is installed in the cassette housing portion 8.

In the fourth embodiment, the laminated type tape cassette 30 formed from a general purpose cassette is used in the tape printer 1 including the two guide shafts. However, the tape cassette 30 according to the fourth embodiment may be installed in the tape printer 1 including the three guide shafts according to the first embodiment, for example. In this case, similar to the first embodiment, the three guide shafts (the tape drive shaft 100, the auxiliary shaft 110 and the guide shaft 120) are inserted in the three corresponding guide holes (the roller support hole 64, the first tape support hole 65 and the guide hole 47), respectively, so that the tape cassette 30 is guided to the proper position in the cassette housing portion 8 (refer to FIGS. 14 to 16).

<Common Elements in First to Fourth Embodiments>

In the first to fourth embodiments described above, the examples in which the present invention is applied to various types of tape cassettes 30 and tape printers 1 have been individually explained. The elements commonly employed in the tape cassettes 30 and the tape printers 1 exemplified in the first to fourth embodiments are explained below.

Each of the tape cassettes 30 according to the first to fourth embodiment includes a box-shaped housing (the cassette case 31) having a generally rectangular shape. The cassette case 31 includes the top wall 35, the bottom wall 36, and the side wall 37 which define the periphery of the cassette case 31. In the interior of the cassette case 31, at least one tape (at least one of the heat-sensitive paper tape 55, the print tape 57, the double-sided adhesive tape 58 and the film tape) is supported in a tape containing area defined within the periphery. A pair of cavities (the roller support hole 64 and the guide hole 47) extending from the bottom wall 36 is provided between the tape containing area and the periphery at opposite ends of a diagonal connecting a first corner portion (the front left corner portion) and a second corner portion (the rear right corner portion) of the cassette case 31.

The tape printer 1 according to the first to fourth embodiments includes at least two guide shafts (the tape drive shaft 100 and the guide shaft 120) that can be inserted in the pair of cavities (the roller support hole 64 and the guide hole 47), respectively, and that guide the tape cassette 30 in the installation/removal direction when the tape cassette 30 is installed in the tape printer 1.

Due to the common elements described above, the first to fourth embodiments have the common effect in which the tape cassette 30 may be more accurately and smoothly installed in and removed from the tape printer 1 along the two guide shafts to be inserted in the pair of cavities, respectively, regardless of the influence of a heavy tape housed in the tape containing area or the weight distribution of the tape cassette 30. In addition, as described above, the individual configuration and effect may be obtained for each embodiment based on the above common elements and their effects in the first to fourth embodiments.

The present invention is not limited to the first to fourth embodiments described above, and can be modified variously. The tape printer 1 and the tape cassette 30 may be configured to have a combination of various features described in the first to fourth embodiments, for example. Modified embodiments of the tape printer 1 and the tape cassette 30 based on the above embodiments will be explained below.

Figure 39:
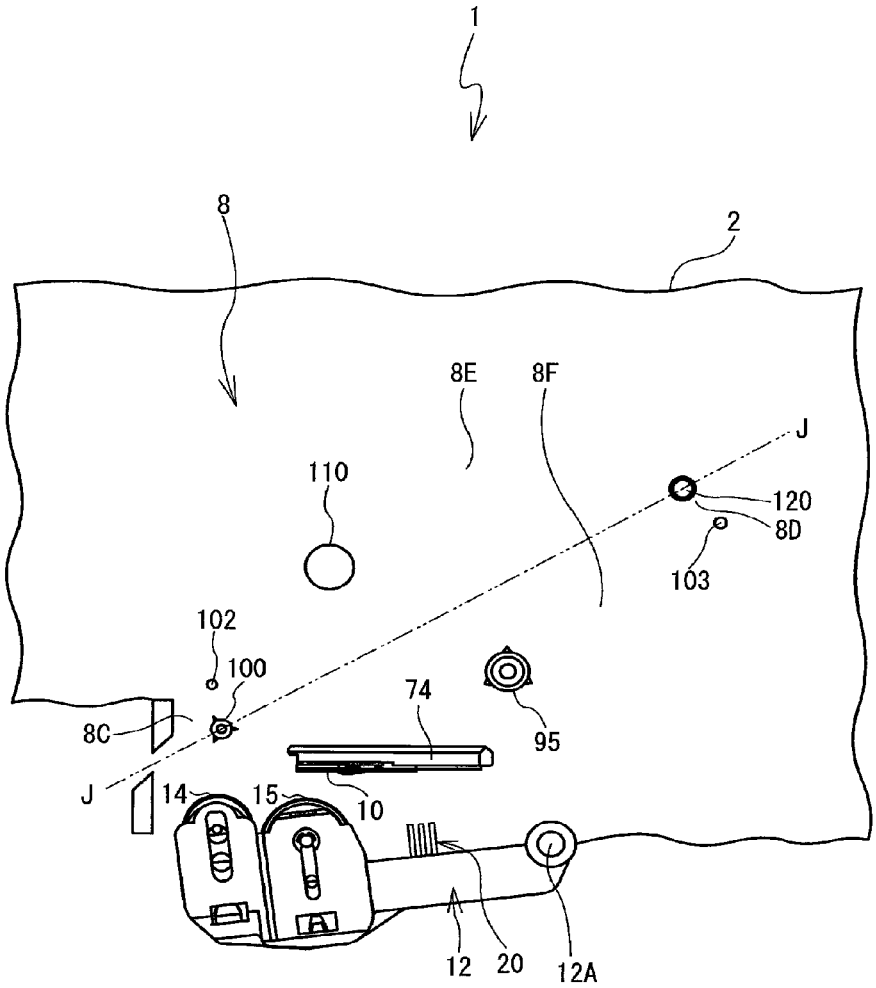
FIG. 39 is a plan view of the cassette housing portion 8 according to the first modified embodiment.

For example, in the above-described embodiments, the cassette housing portion 8 is configured as a housing portion that has a rectangular opening that generally corresponds to the plan shape of the tape cassette 30. However, the cassette housing portion 8 may have a different shape. For example, the cassette support portion 8B that supports the common portion 32 from below may not be provided. Specifically, as shown in a first modified embodiment illustrated in FIGS. 38 and 39, the cassette housing portion 8 may be configured as a planar portion that is larger in a plan view than the plan shape of the tape cassette 30.

Figure 40:
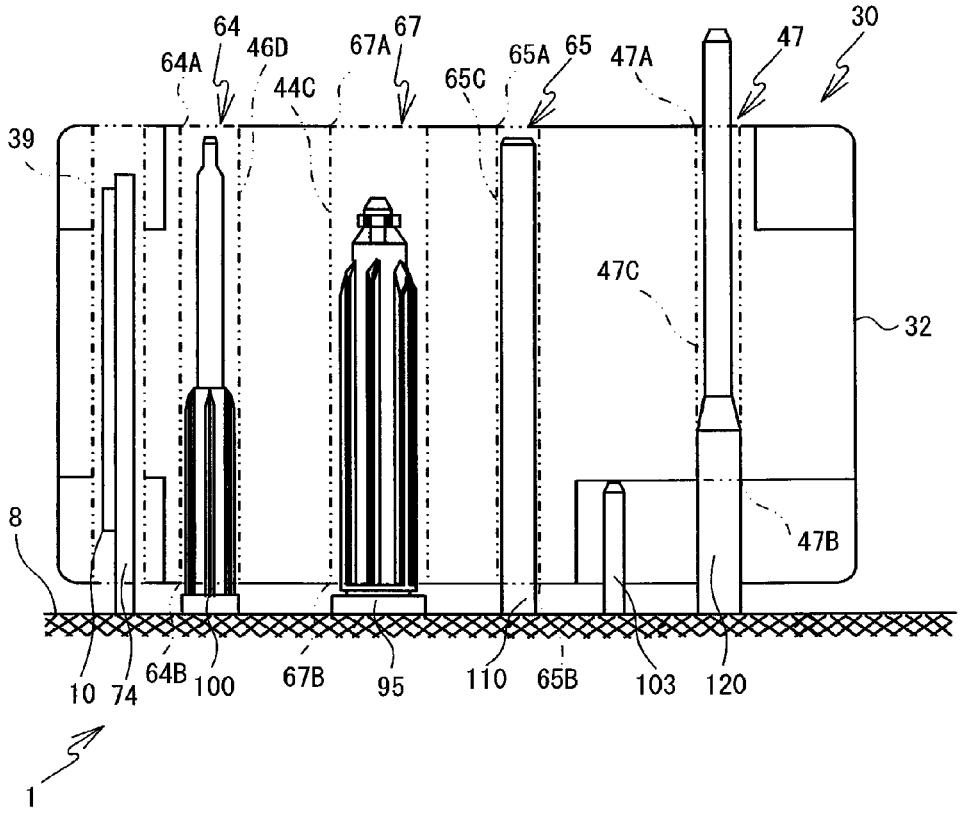
FIG. 40 is a right side view showing a state in which the tape cassette 30 is installed in the cassette housing portion 8 according to the first modified embodiment.

In the first modified embodiment, as shown in FIG. 40, the tape drive shaft 100, the guide shaft 120, the auxiliary shaft 110, the ribbon take-up shaft 95, the positioning pins 102, 103 and the head holder 74 are standing upward from the same height position on the cassette housing portion 8 (in other words, standing upward from the common plane surface). The positional relationships among these members and the height relationships among their upper ends are similar to those in the first embodiment. The positioning pins 102, 103 and the guide shaft 120 in the first modified embodiment are longer than those in the first embodiment by the height of the cassette support portion 8B.

The installation/removal modes of the tape cassette 30 in the first modified embodiment are similar to those of the first embodiment. Specifically, the tape cassette 30 is guided to a proper position in the cassette housing portion 8 by the three guide shafts (the tape drive shaft 100, the auxiliary shaft 110 and the guide shaft 120). Then, the tape cassette 30 is positioned at a proper horizontal position by the guide shaft 120 and the positioning pin 102, and is positioned at a proper height position by the positioning pins 102 and 103. In other words, the proper position in the cassette housing portion 8 is defined by the guide shaft 120 and the positioning pins 102, 103. For that reason, even when the plan shape of the cassette housing portion 8 does not correspond to the plan shape of the tape cassette 30, the tape cassette 30 can be positioned at the proper position.

As described above, it may be preferable that the tape drive shaft 100, the auxiliary shaft 110 and the guide shaft 120 are respectively inserted at the same time in the openings 64B, 65B and 47B of the tape cassette 30 to be installed in the cassette housing portion 8. As shown in FIG. 40, in the tape cassette 30 having a large tape width (such as 36 mm), the common portion 32 forms a step in the thickness direction (that is, in the vertical direction). For that reason, the upper end of the guide shaft 120 to be inserted in the opening 47B formed at the lower surface of the common portion 32 is at the higher position than the tape drive shaft 100 and the auxiliary shaft 110 by the height of the step formed by the common portion 32. In other words, the height positions of the respective upper ends of the tape drive shaft 100, the auxiliary shaft 110 and the guide shaft 120 may be defined by the height positions of the openings 64B, 65B and 47B of the tape cassette 30 to be installed in the cassette housing portion 8.

Figure 41:
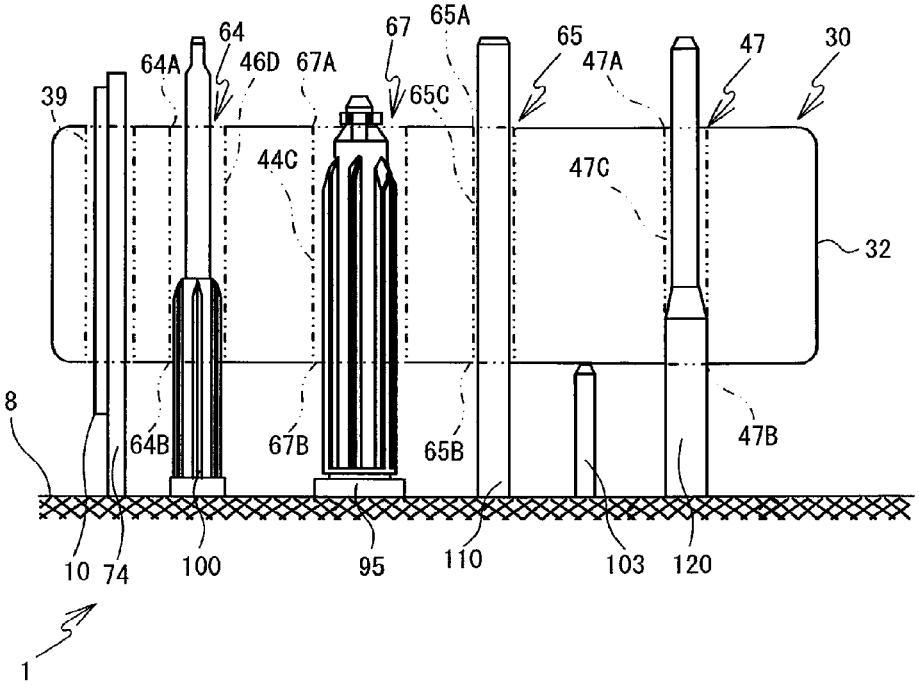
FIG. 41 is a right side view showing a state in which the tape cassette 30 is installed in the cassette housing portion 8 according to the first modified embodiment.

As shown in FIG. 41, in the tape cassette 30 having a small tape width (such as 12 mm), the common portion 32 does not form a step in the thickness direction (that is, in vertical direction). Therefore, the height positions of the openings 64B, 65B and 47B are substantially the same. For that reason, in the tape printer 1 in which the tape cassette 30 having a small tape width is used, the height positions of the upper ends of the tape drive shaft 100, the auxiliary shaft 110 and the guide shaft 120 may preferably be set to be substantially the same. In other words, it may be preferable that the height positions of the respective upper ends of the tape drive shaft 100, the auxiliary shaft 110 and the guide shaft 120 are changed depending on the height positions of the openings MB, 65B and 47B of the tape cassette 30 to be installed in the cassette housing portion 8. Thus, the three guide shafts (the tape drive shaft 100, the auxiliary shaft 110 and the guide shaft 120) may be inserted in the three guide holes (the roller support hole 64, the guide hole 47 and the first tape support hole 65) at the same time, respectively, depending on the thickness (the length in the vertical direction) of the tape cassette 30

Further, the guide shaft 120 may extend to a higher position (for example, the length of the guide shaft 120 may be made larger) corresponding to the tape cassette 30 having a larger tape width (such as 48 mm). However, the length of the guide shaft 120 may be restricted depending on the shape or size of the tape printer 1 (particularly, the cassette housing portion 8). In such a case, when the tape cassette 30 is installed in the cassette housing portion 8, at first, the two guide shafts (the tape drive shaft 100 and the auxiliary shaft 110) may be inserted in the two guide holes (the roller support hole 64 and the first tape support hole 65). Then, the third guide shaft (the guide shaft 120) may be inserted in the third guide hole (the guide hole 47) while the tape cassette 30 is being guided by the two guide shafts and moved down. According to this installation mode, before the guide shaft 120 is inserted in the guide hole 47, the head holder 74 and the ribbon take-up shaft 95 may be inserted in the head insertion portion 39 and the take-up spool support hole 67, respectively.

As described above, the head insertion portion 39 and the take-up spool support hole 67 each have an opening width through which the head holder 74 and the ribbon take-up shaft 95 are loosely inserted, respectively. For that reason, a failure in which the head holder 74 or the ribbon take-up shaft 95 contacts other members to hinder the installation of the tape cassette 30 may be prevented in the process of the installation of the tape cassette 30. Furthermore, even if a positional displacement or an inclination occurs when the head holder 74 is inserted in the head insertion portion 39 while the tape cassette 30 is being guided by the two guide shafts, when the guide shaft 120 is inserted in the guide hole 47, the head holder 74 is corrected to a proper installation state. This also applies to the take-up spool support hole 67 and the ribbon take-up shaft 95. Thus, even when the upper end position of the guide shaft 120 is restricted, the tape cassette 30 may be guided to and positioned at a proper position in the cassette housing portion 8.

Moreover, even when the tape drive shaft 100 and the auxiliary shaft 110 are equal to or lower than the head holder 74 and the ribbon take-up shaft 95, and the guide shaft 120 does not enter the guide hole 47 at the start of the installation of the tape cassette 30, similar effects as the above embodiments may be obtained. An example will be given below in which the head holder 74 and the ribbon take-up shaft 95 are inserted in the head insertion portion 39 and the take-up spool support hole 67, respectively, before the tape drive shaft 100, the auxiliary shaft 110 an the guide shaft 120 are inserted in the roller support hole 64, the first tape support hole 65, and the guide hole 47, respectively, in the process of the installation of the tape cassette 30 in the cassette housing portion 8.

In this case, since the tape cassette 30 has not been guided by any of the three guide shafts (the tape drive shaft 100, the auxiliary shaft 110 an the guide shaft 120) when the head holder 74 and the ribbon take-up shaft 95 are inserted in the head insertion portion 39 and the take-up spool support hole 67, respectively, the tape cassette 30 may be displaced or inclined as described above. However, when the tape cassette 30 is further moved down, the tape drive shaft 100, the auxiliary shaft 110 and the guide shaft 120 are inserted in the first tape support hole 65, the roller support hole 64 and the guide hole 47, respectively. Then, the tape cassette 30 may be corrected to a proper installation state. Thereafter, the tape cassette 30 can be smoothly installed toward the proper position in the cassette housing portion 8 along the three guide shafts.

Further, the tape cassette 30 can be smoothly removed along the three guide shafts from the beginning. In this manner, even when the upper end positions of all the three guide shafts are restricted, the tape cassette 30 may be guided to and positioned at the proper position in the cassette housing portion 8.

Figure 42:
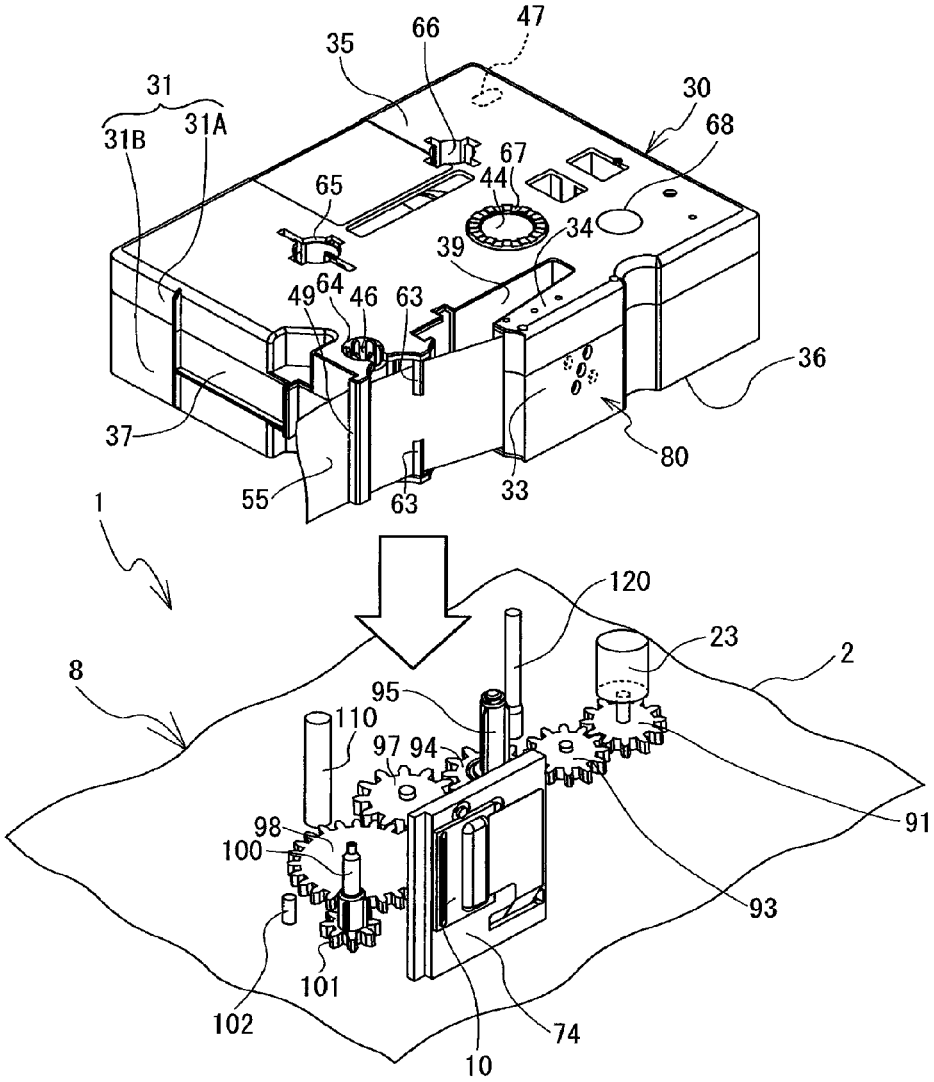
FIG. 42 is a perspective view illustrating the tape cassette 30 and the cassette housing portion 8 according to a second modified embodiment.
Figure 43:
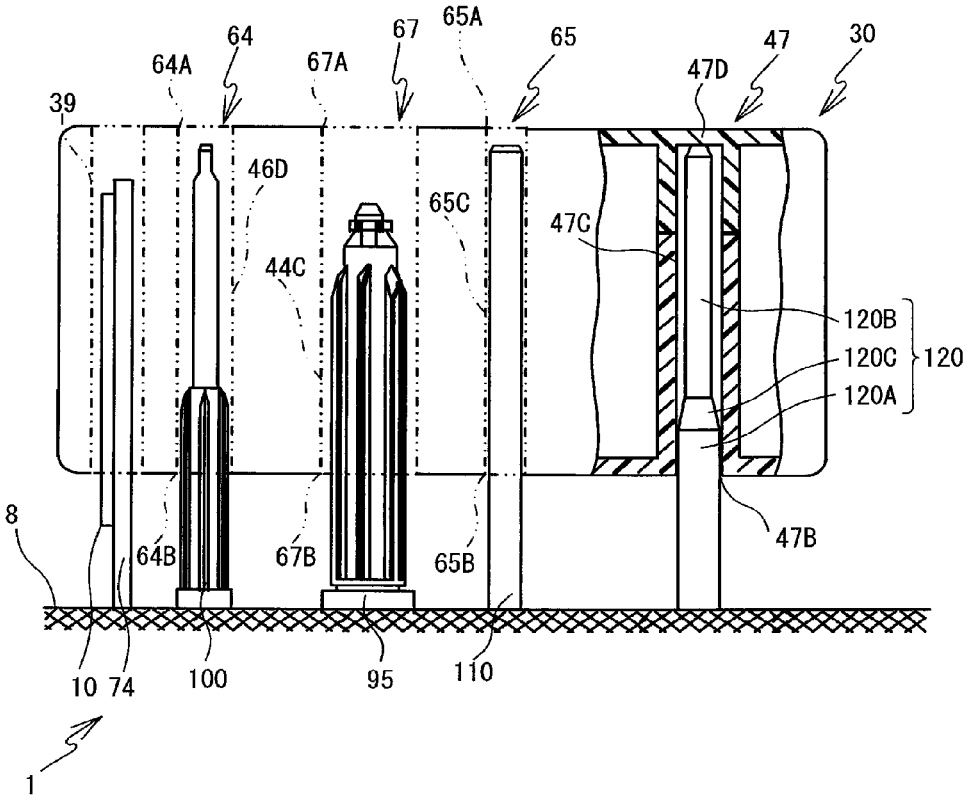
FIG. 43 is a right side view showing a state in which the tape cassette 30 is installed in the cassette housing portion 8 according to the second modified embodiment.
Figure 44:
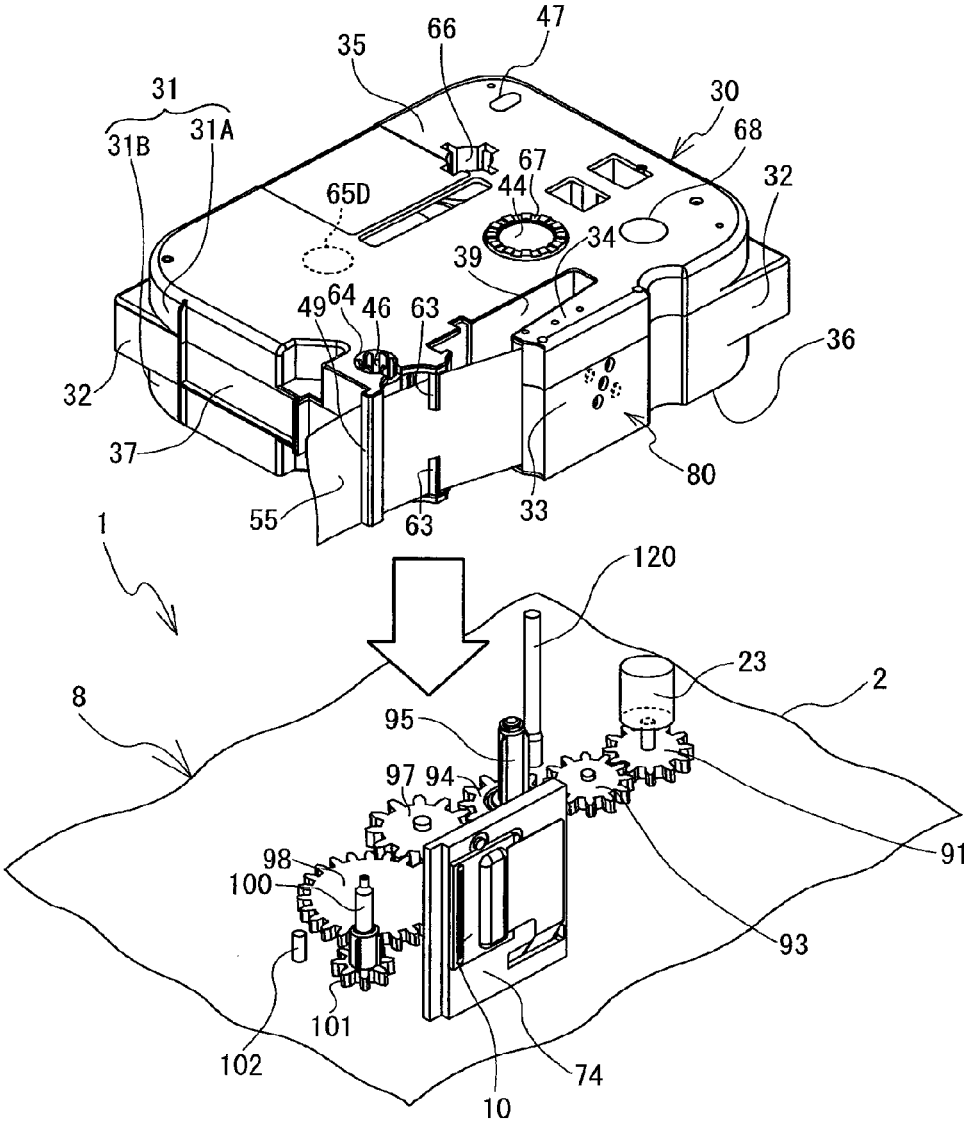
FIG. 44 is a perspective view illustrating the tape cassette 30 and the cassette housing portion 8 according to a third modified embodiment.

The height position of the tape cassette 30 installed in the cassette housing portion 8 may not be defined by the positioning pins 102 and 103, unlike the above-described embodiments. Specifically, as shown in a second modified embodiment illustrated in FIG. 42, the positioning pin 103 may not be provided in the cassette housing portion 8. In this case, as shown in FIG. 43, the guide hole 47 does not have the opening 47A that passes through the top wall 35 of the tape cassette 30, and the upper end of the guide hole 47 is closed by a ceiling wall portion 47D. FIG. 43 is a partly cross sectional view around the guide hole 47 and its vicinity as seen from the right side of the tape cassette 30.

Even with such a configuration, the installation/removal modes of the tape cassette 30 are similar to those in the first embodiments. Specifically, the tape cassette 30 is guided to a proper position in the cassette housing portion 8 by the three guide shafts (the tape drive shaft 100, the auxiliary shaft 110 and the guide shaft 120). Then, the tape cassette 30 is positioned at a proper horizontal position by the guide shaft 120 and the positioning pin 102. The upper end of the guide shaft 120 inserted in the guide hole 47 contacts the ceiling wall portion 47D at the rear right corner portion of the tape cassette 30, so that the tape cassette 30 may be positioned at a proper height position. Moreover, the tape cassette 30 is positioned at the proper height position by the positioning pin 102 inserted in the pin hole 53 at the left side end of the tape cassette 30 in a similar mariner as in the first embodiments.

As described above, the guide shaft 120 is provided adjacent to the positioning pin 103. For that reason, with the configuration in which the upper end of the guide shaft 120 is engaged within the guide hole 47, the guide shaft 120 may also serve to position the tape cassette 30 in the height direction, instead of the positioning pin 103. In this manner, the guide shaft 120 may be utilized as one of positioning members in the height direction so that the positioning pin 103 may not need to be additionally provided, thereby simplifying the configuration of the tape printer 1. If the height position of the tape cassette 30 is not positioned by the common portion 32, as in the above-described second modified embodiment, the cassette case 31 of the tape cassette 30 may not have the common portion 32, as shown in FIG. 42.

Although the first and second modified embodiments (refer to FIGS. 38 to 43) describe examples in which the tape cassette 30 is guided by the three guide shafts, the tape cassette 30 may be guided by the two guide shafts (the tape drive shaft 100 and the guide shaft 120). Specifically, as shown in a third modified embodiment illustrated in FIG. 44, even when the auxiliary shaft 110 is not provided in the cassette housing portion 8, the cassette housing portion 8 may be configured as a planar portion that is larger than the plan shape of the tape cassette 30.

In addition, the height positions of the respective upper ends of the tape drive shaft 100 and the guide shaft 120 may be changed depending on the height positions of the openings 64B and 47B of the tape cassette 30 to be installed in the cassette housing portion 8. Further, the guide shaft 120 may position the tape cassette 30 in the height direction, instead of the positioning pin 103. The tape cassette 30 may not be provided with the first tape support hole 65, similar to the example shown in FIG. 29. In other words, the cylindrical wall portion 65D that rotatably supports the first tape spool 40 within the cassette case 31 may be provided between the top wall 35 and the bottom wall 36, instead of the first tape support hole 65.

Further, in the above-described embodiments, the tape cassette 30 are formed from a general purpose cassette and assembled as the thermal type, receptor type or laminated type. However, the types of the tape cassette 30 are not limited to these examples. For example, as shown in a fourth modified embodiment illustrated in FIG. 45, the tape cassette 30 may be assembled as a so-called heat-sensitive laminated type tape cassette. In the heat-sensitive laminated type cassette, the first tape spool 40, on which the double-sided adhesive tape 58 as the first tape is wound, is rotatably supported by the first tape support hole 65. The second tape spool 41, on which the heat-sensitive paper tape 55 as the second tape is wound, is rotatably supported by the second tape support hole 66. Since an ink ribbon is not used in a so-called heal-sensitive laminated type tape cassette, a ribbon spool is not provided.

Figure 45:
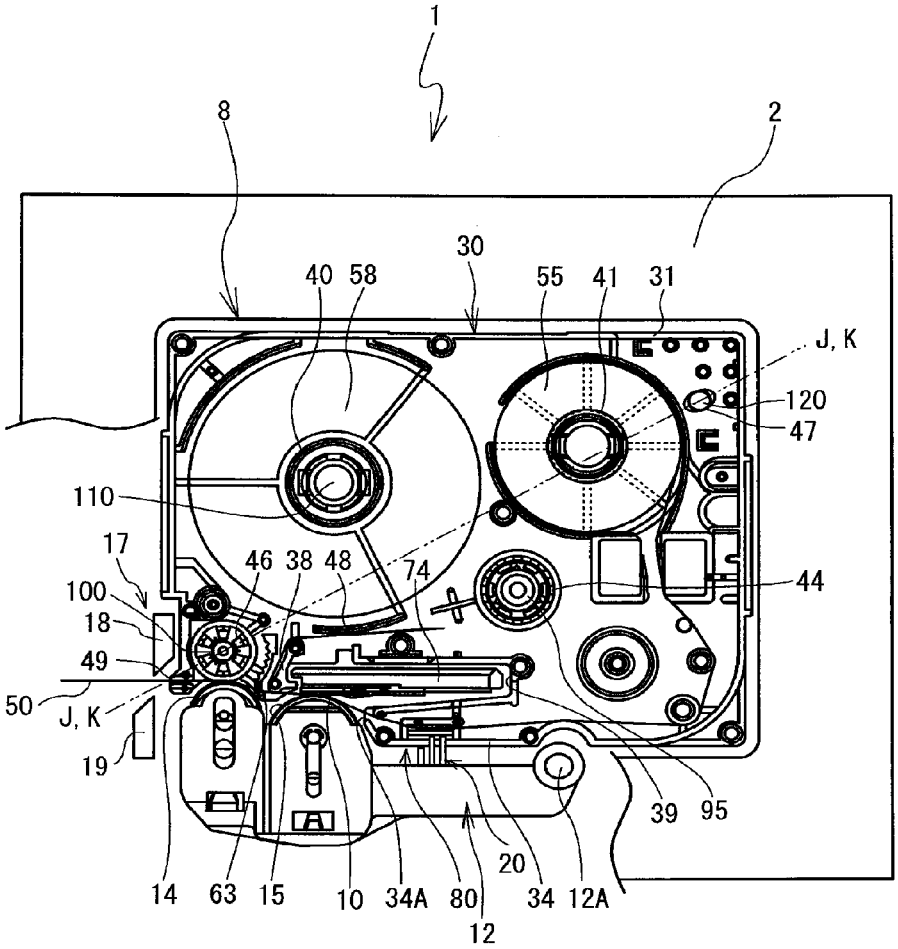
FIG. 45 is a plan view of the cassette housing portion 8 in which the tape cassette 30 is installed according to a fourth modified embodiment.

The tape printer 1 in which the tape cassette shown in FIG. 45 is used may be similar to the tape printer 1 in the first embodiment. When printing is performed in the tape printer 1, the tape feed roller 46 that is driven to rotate via the tape drive shaft 100 pulls out the heat-sensitive paper tape 55 from the second tape spool 41 in concert with the movable feed roller 14. The heat-sensitive paper tape 55 that has been pulled out from the second tape spool 41 passes the right side of the ribbon support hole 68 to be fed along the feed path within the arm portion 34. Further, the heat-sensitive paper tape 55 is supplied from the exit 34A of the arm portion 34 to the head insertion portion 39, and fed between the thermal head 10 and the platen roller 15. Then, characters are printed on the print surface of the print tape 57 by the thermal head 10.

Meanwhile, the double-sided adhesive tape 58 is pulled out from the first tape spool 40 by the tape feed roller 46 in concert with the movable feed roller 14. When being guided and caught between the tape feed roller 46 and the movable feed roller 14, the double-sided adhesive tape 58 is layered onto and affixed to the print surface of the printed heat-sensitive paper tape 55. The printed heat-sensitive paper tape 55 to which the double-sided adhesive tape 58 has been affixed (that is, the printed tape 50) is further fed toward the tape discharge aperture 49, discharged from the discharge aperture 49, and cut by the cutting mechanism 17.

The positional relationships among the respective portions provided in the tape cassette 30 shown in FIG. 45 are similar to those in the first embodiment, but are different in the following points. Specifically, the center of gravity of the double-sided adhesive tape 58 wound on the first tape spool 40 is positioned within the first housing area 30C in a plan view. The center of gravity of the heat-sensitive paper tape 55 wound on the second tape spool 41 is positioned on the division line K in a plan view. With such positional relationships, in the tape cassette 30 shown in FIG. 45, the first housing area 30C in which the center of gravity of the double-sided adhesive tape 58 is positioned is heavier relative to the second housing area 30D. Therefore, the first housing area 30C may be inclined downward with the division line K as the center of rotation due to a weight imbalance of the tape cassette 30.

The installation/removal modes of the tape cassette 30 with respect to the cassette housing portion 8 shown in FIG. 45 are similar to those in the first embodiment (refer to FIGS. 14 to 16). Specifically, the tape cassette 30 is guided to a proper position in the cassette housing portion 8 by the three guide shafts (the tape drive shaft 100, the auxiliary shaft 110 and the guide shall 120). When the tape cassette 30 is removed from the cassette housing portion 8, the tape cassette 30 is guided upward along the three guide shafts. In the fourth modified embodiment, however, the tape cassette 30 may be guided by the two guide shafts (the tape drive shaft 100 and the guide shaft 120).

Similar to the first embodiment, it may be preferable that the center of gravity of the entire tape cassette 30 is positioned within the area defined by connecting the roller support hole 64, the first tape support hole 65 and the guide hole 47 in a plan view. Since the center of gravity of the heat-sensitive paper tape 55 is positioned on the division line K in the tape cassette 30 shown in FIG. 45, the center of gravity of the tape cassette 30 is closer to the division line K than a tape cassette in which the heat-sensitive paper tape 55 is not mounted at this position. For that reason, the tape cassette 30 shown in FIG. 45 has a weight distribution such that the center of gravity of the tape cassette may be positioned within the area defined by connecting the roller support hole 64, the first tape support hole 65 and the guide hole 47 in a plan view.

The guide hole 47 shown in FIG. 45 is an ellipse-shaped hole similar to the guide hole 47 in the second embodiment (refer to FIG. 24 and the like). However, the guide hole 47 shown in FIG. 45 is different in that the guide hole 47 has the major axis along the division line K and the minor axis along a direction perpendicular to the division line K in a plan view. With the guide hole 47 shown in FIG. 45, allowance for the horizontal positioning accuracy of the guide shaft 120 may be made larger along the division line K. Therefore, a load of the user in positioning the tape cassette 30 may be reduced. In this manner, the guide hole 47 may be configured to have an arbitrary opening shape such as a circular hole, an ellipse-shaped hole or an elongated hole.

Figure 46:
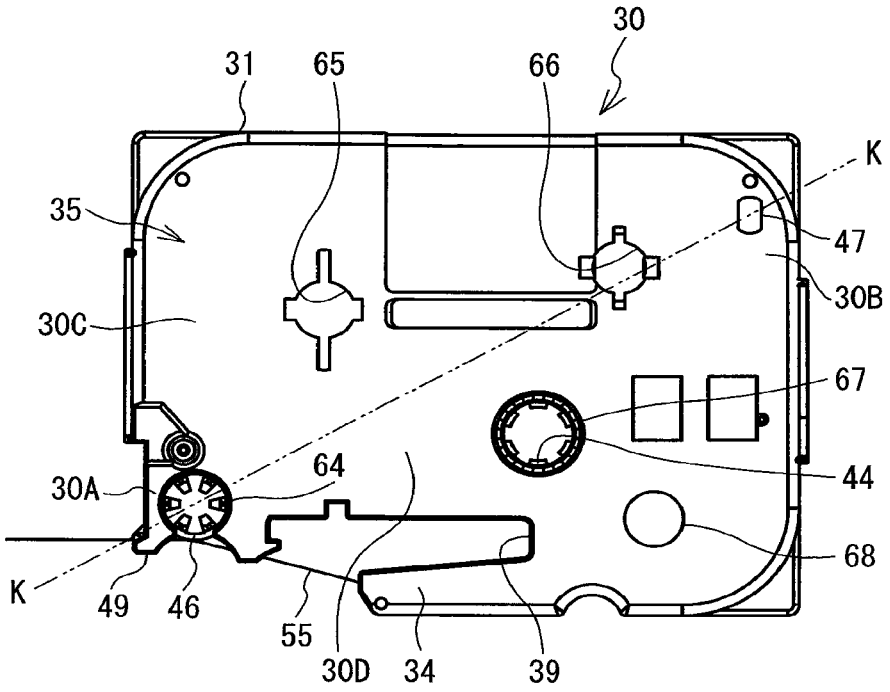
FIG. 46 is a plan view of the tape cassette 30 showing a modified embodiment of a guide hole 47.

For example, a modified embodiment of the guide hole 47 shown in FIG. 46 is an elongated hole similar to the guide hole 47 in the first embodiment (refer to FIG. 8 and the like), but is different in that the guide hole 47 shown in FIG. 46 has the long sides extending in the front-rear direction and the short sides extending in the left-right direction in a plan view. With this guide hole 47, allowance for the horizontal positioning accuracy of the guide shaft 120 may be made larger along the front-rear direction. Therefore, a load of the user in positioning the tape cassette 30 may be reduced. FIG. 46 exemplifies the case in which the guide hole 47 is an elongated hole, but the guide hole 47 may be configured as an ellipse-shaped hole having the major axis in the front-rear direction.

Figure 47:
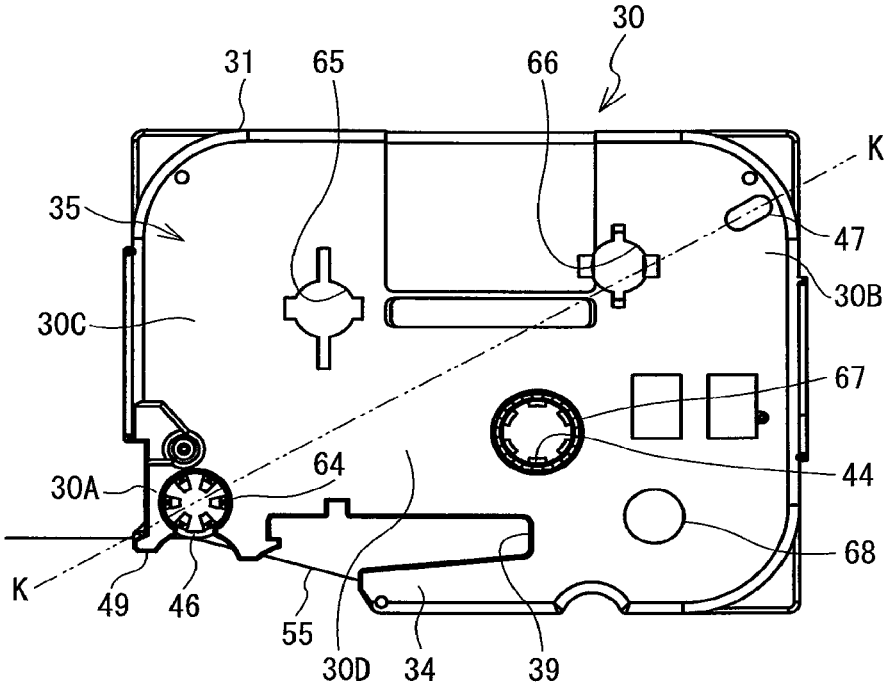
FIG. 47 is a plan view of the tape cassette 30 showing another modified embodiment of the guide hole 47.

Another modified guide hole 47 shown in FIG. 47 is an elongated hole similar to the first embodiment (refer to FIG. 8 and the like), but is different in that the guide hole 47 shown in FIG. 47 has the long sides extending parallel to the division line K and the short sides extending perpendicular to the division line K. With this guide hole 47, similar to the guide hole 47 shown in FIG. 45, allowance for the horizontal positioning accuracy of the guide shaft 120 may be made larger along the division line K. Therefore, a load of the user in positioning the tape cassette 30 may be reduced.

Figure 48:
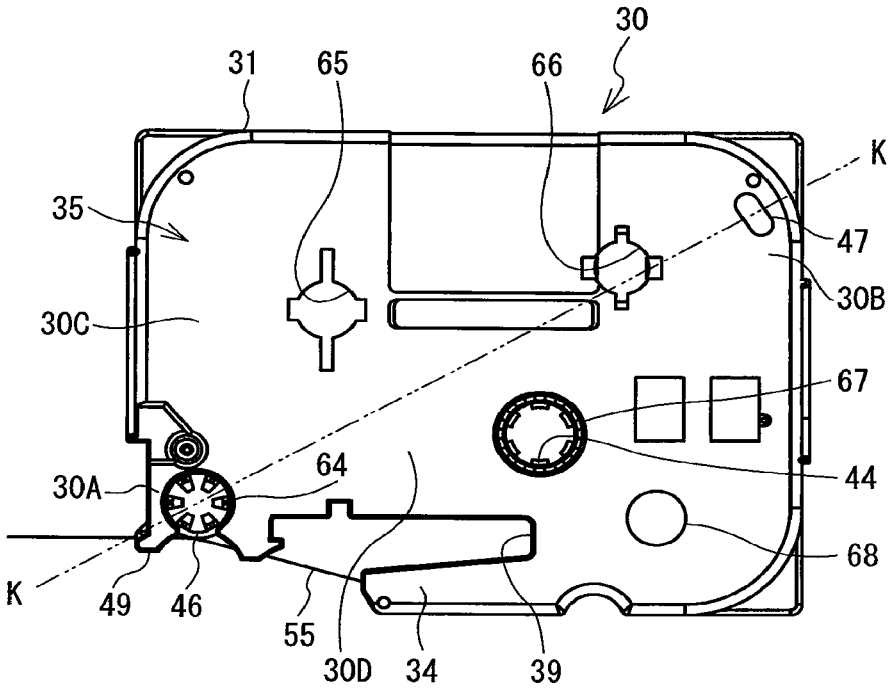
FIG. 48 is a plan view of the tape cassette 30 showing yet another modified embodiment of the guide hole 47.

In addition, yet another modified embodiment of the guide hole 47 shown in FIG. 48 is an elongated hole similar to the first embodiment (refer to FIG. 8 and the like), but is different in that the guide hole 47 shown in FIG. 48 has the long sides extending perpendicular to the division line K and the short sides extending parallel to the division line K. With this guide hole 47, allowance for the horizontal positioning accuracy of the guide shaft 120 may be made larger along the direction perpendicular to the division line K. Therefore, a load of the user in positioning the tape cassette 30 may be reduced. FIG. 48 exemplifies the case in which the guide hole 47 is an elongated hole, but the guide hole 47 may be configured as an ellipse-shaped hole that has the major axis perpendicular to the division line K.

Figure 49:
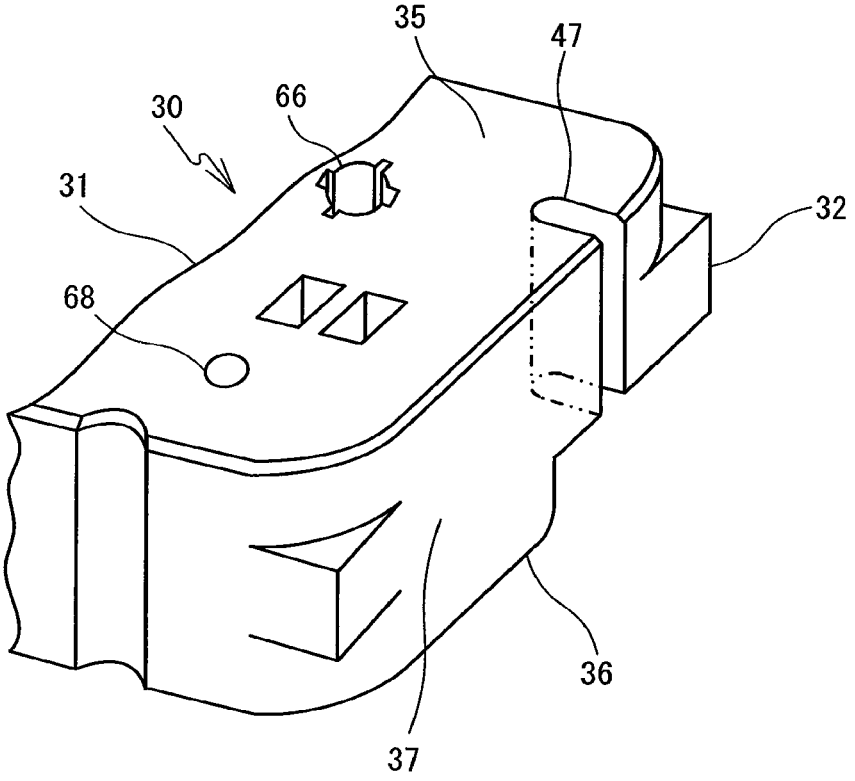
FIG. 49 is a perspective view in which the right side of the tape cassette 30 is enlarged showing yet another modified embodiment of the guide hole 47.
Figure 50:
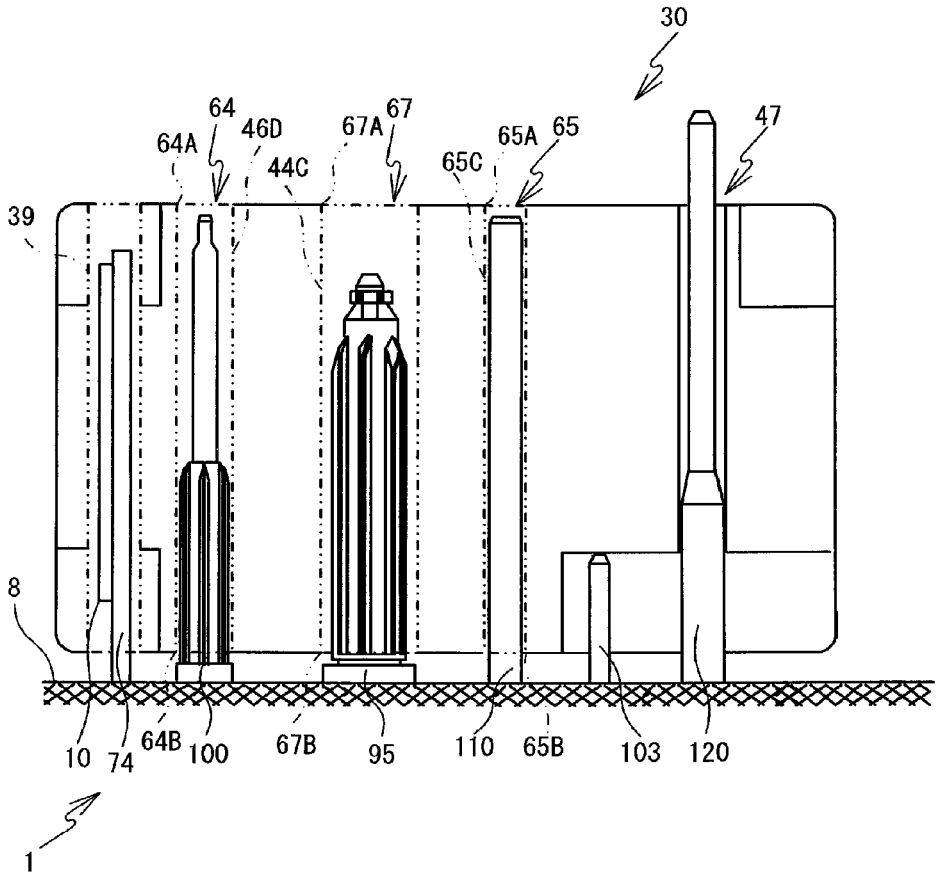
FIG. 50 is a right side view showing a state in which the tape cassette 30 shown in FIG. 49 is installed in the cassette housing portion 8.

In addition, yet another modified embodiment of the guide hole 47 shown in FIGS. 49 and 50 is a groove that is formed in the side wall 37 that forms the right side surface of the tape cassette 30. The groove is concaved toward the left direction in a plan view over the entire height (between the top wall 35 and the lower surface of the common portion 32 at the rear right portion) at the rear right portion of the cassette case 31, and has a U-shaped cross section. The opening width of the U-grooved guide hole 47 is larger than the diameter of the small-diameter shaft portion 120B and substantially equal to the diameter of the large-diameter shaft portion 120A. In this case, when the tape cassette 30 is installed in the cassette housing portion 8, the guide shaft 120 is inserted in the U-grooved guide hole 47 from below and the tape cassette 30 is guided downward along the standing direction of the guide shaft 120 similar to the case in which the guide hole 47 is a through-hole or an indentation. Then, when the large-diameter shaft portion 120A is fitted in the guide hole 47, the tape cassette 30 is positioned.

In the U-grooved guide hole 47 shown in FIGS. 49 and 50, the user's load may be reduced at the installation of the tape cassette 30, and the tape cassette 30 may be smoothly installed and removed similar to the horizontally-long guide hole 47 exemplified in the first embodiment (refer to FIG. 8 and the like). The guide shaft 120 inserted in the U-grooved guide hole 47 is exposed such that it can be seen from the right side of the tape cassette 30. Therefore, the user can see the guide shaft 120 inserted in the guide hole 47 and check the state of the tape cassette 30 being installed or removed with respect to the cassette housing portion 8.

Figure 51:
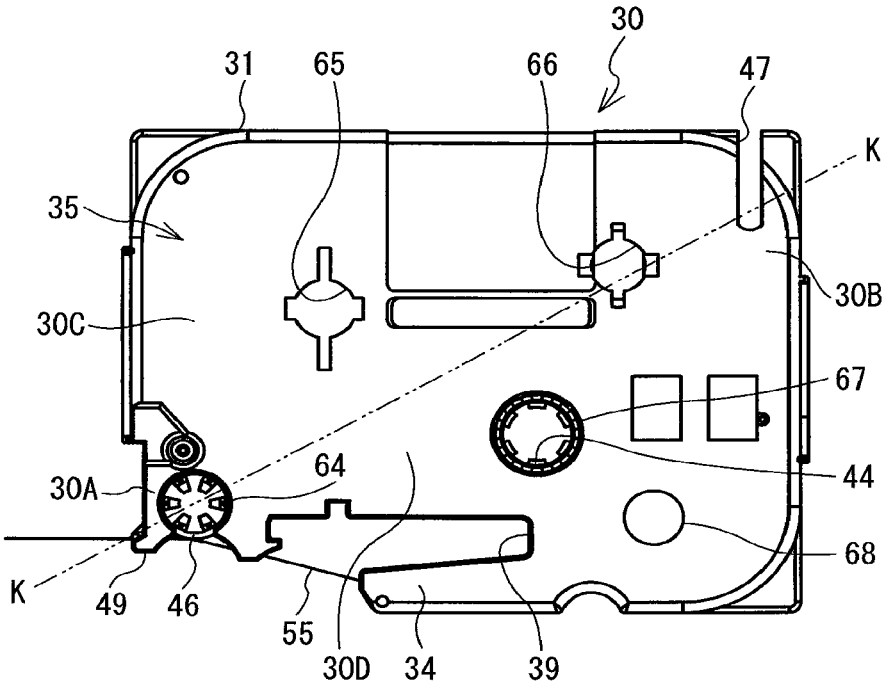
FIG. 51 is a plan view of the tape cassette 30 showing yet another modified embodiment of the guide hole 47.

The U-grooved guide hole 47 shown in FIGS. 49 and 50 may be modified to an arbitrary groove shape. For example, another modified embodiment of the guide hole 47 shown in FIG. 51 is a groove formed in the side wall 37 that forms the rear surface of the tape cassette 30 and is concaved toward the front direction in a plan view. In this case, similar to the guide hole 47 shown in FIG. 46, allowance for the horizontal positioning accuracy of the guide shaft 120 may be made larger along the front-rear direction.

Figure 52:
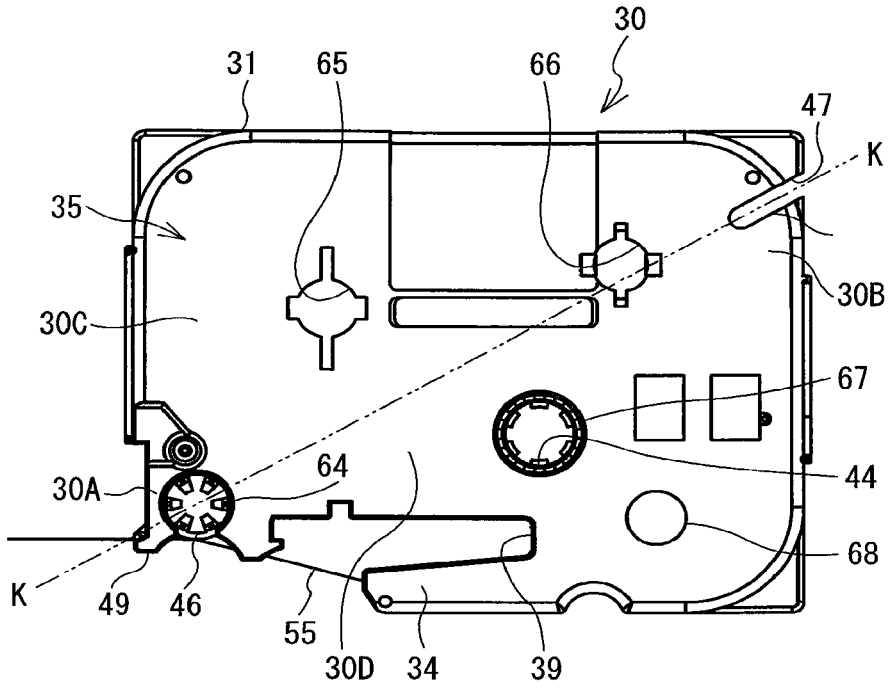
FIG. 52 is a plan view of the tape cassette 30 showing yet another modified embodiment of the guide hole 47.
Figure 53:
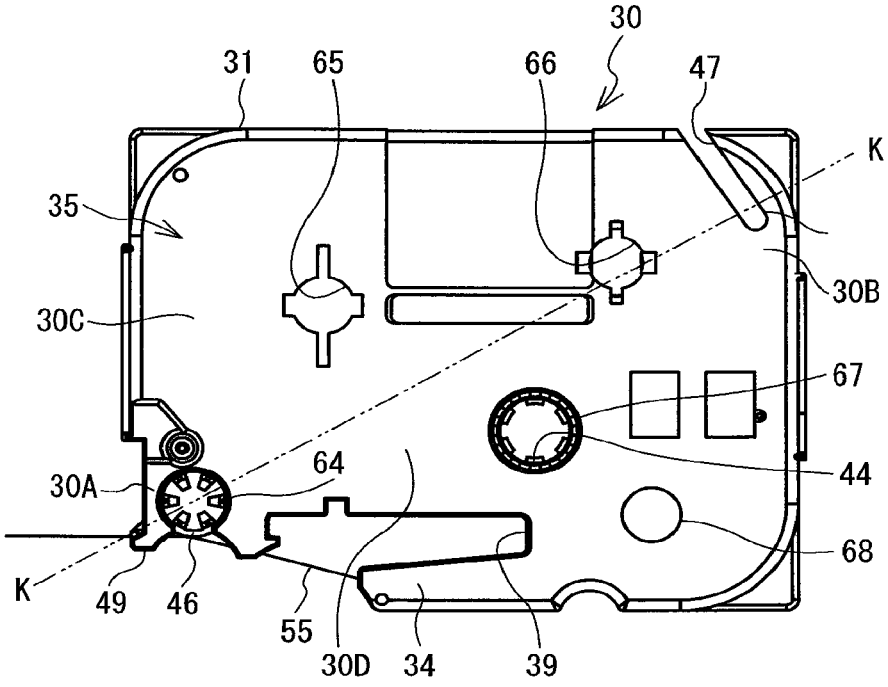
FIG. 53 is a plan view of the tape cassette 30 showing yet another modified embodiment of the guide hole 47.

Another modified embodiment of the guide hole 47 shown in FIG. 52 is a groove formed in the side wall 37 that forms the right side surface of the tape cassette 30 and is concaved along the division line K in a plan view. In this case, similar to the guide hole 47 shown in FIG. 47, allowance for the horizontal positioning accuracy of the guide shaft 120 may be made larger along the division line K. Yet another modified embodiment of the guide hole 47 shown in FIG. 53 is a groove formed in the side wall 37 that forms the rear surface of the tape cassette 30 and is concaved along the direction perpendicular to the division line K in a plan view. In this case, similar to the guide hole 47 shown in FIG. 48, allowance for the horizontal positioning accuracy of the guide shaft 120 may be made larger along the direction perpendicular to the division line K.

Figure 54:
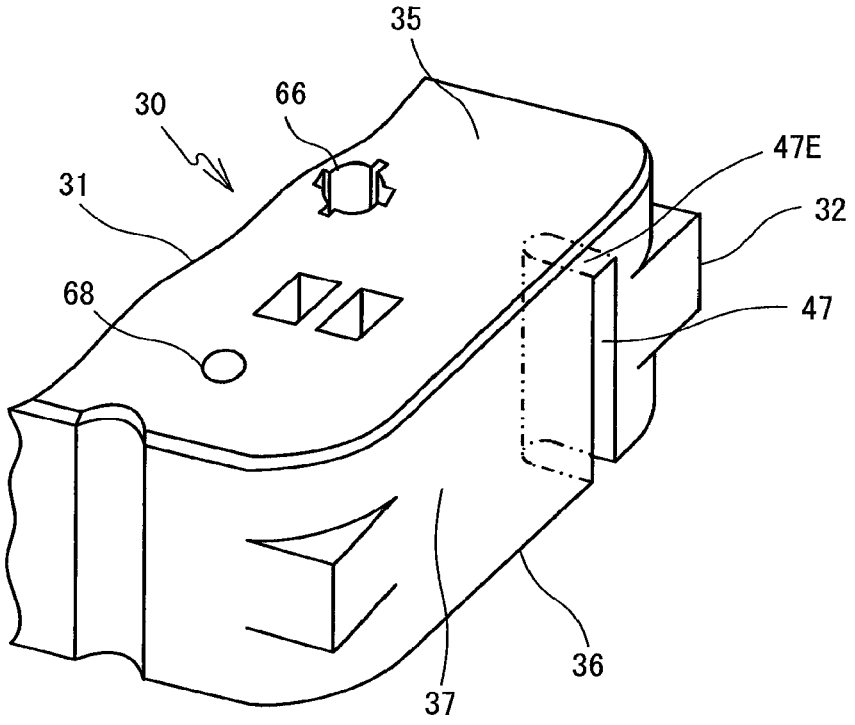
FIG. 54 is a perspective view in which the right side of the tape cassette 30 is enlarged showing yet another modified embodiment of the guide hole 47.
Figure 55:
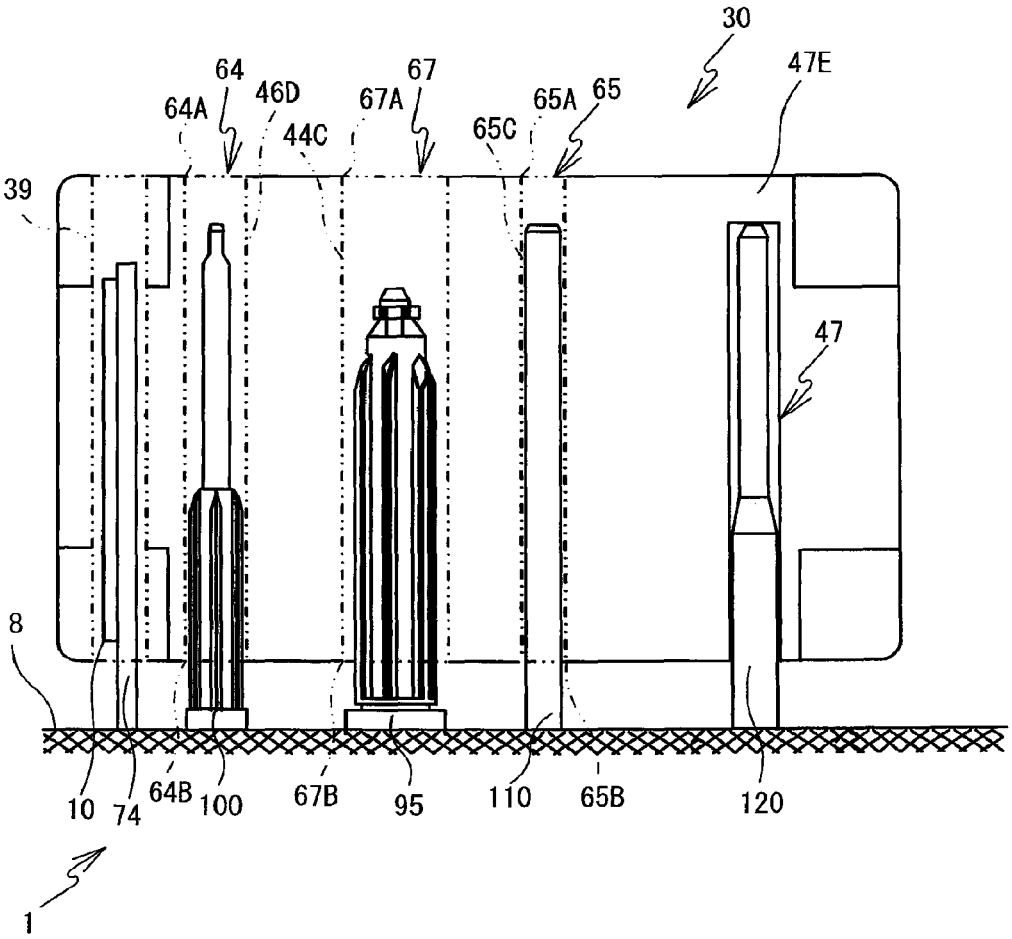
FIG. 55 is a right side view showing a state in which the tape cassette 30 shown in FIG. 54 is installed in the cassette housing portion 8.

In addition, another modified embodiment of the guide hole 47 shown in FIGS. 54 and 55 is a groove that is formed in the side wall 37 that forms the right side surface of the tape cassette 30 and in the bottom wall 36, and forms a U-shaped cross section concaved toward the left direction in a plan view. The U-grooved guide hole 47 extends from the bottom wall 36 to the portion slightly down from the top wall 35 at the rear right portion of the cassette case 31. The upper end of the groove is closed by a ceiling wall portion 47E. In other words, the guide hole 47 does not open upward in the top wall 35. The width of the U-shaped cross section of the guide hole 47 is larger than the diameter of the small-diameter shaft portion 120B and is substantially equal to the diameter of the large-diameter shaft portion 120A.

In this case, when the tape cassette 30 is installed in the cassette housing portion 8, the guide shaft 120 is inserted in the U-grooved guide hole 47 from below and the tape cassette 30 is guided downward along the standing direction of the guide shaft 120, similar to the case in which the guide hole 47 is a through-hole or an indentation. Then, when the large-diameter shaft portion 120A is fitted in the guide hole 47, the tape cassette 30 is positioned. Particularly, at the right side end of the tape cassette 30, the upper end of the guide shaft 120 inserted in the guide hole 47 contacts the ceiling wall portion 47E, so that the tape cassette 30 is positioned at a proper height position.

In the guide hole 47 shown in FIGS. 54 and 55, similar to the U-grooved guide hole 47 shown in FIGS. 49 and 50, the user's load may be reduced at the installation of the tape cassette 30, and the tape cassette 30 may be smoothly installed and removed. In addition, the user can see the guide shaft 120 inserted in the guide hole 47 and check the states of the tape cassette 30 being installed in or removed with respect to the cassette housing portion 8. Further, since the guide shaft 120 is utilized as one of positioning members in the height direction, the positioning pin 103 may not need to be additionally provided, thereby simplifying the configuration of the tape printer 1.

Figure 56:
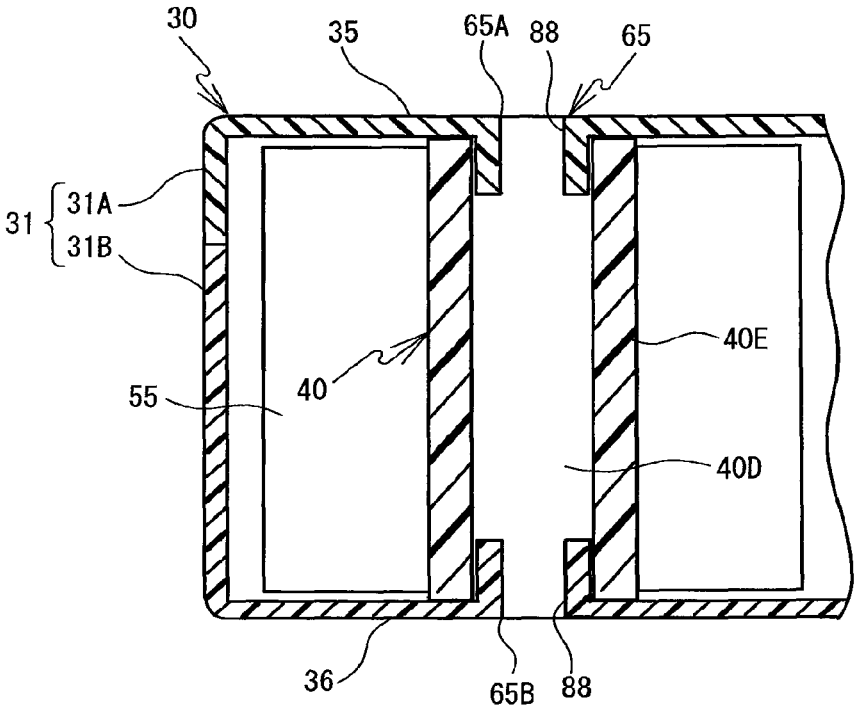
FIG. 56 is a front sectional view of the tape cassette 30 about the first tape support hole 65 and the first tape spool 40 according to a modified embodiment.

In the first embodiment, the first tape spool 40 is rotatably supported by the cylindrical wall portion 85 that extends through the shaft hole 40D of the first tape spool 40, and the auxiliary shaft 110 that is inserted in and removed from the first tape support hole 65 is also inserted in and removed from the shaft hole 40D at the installation and removal of the tape cassette 30. However, as shown in FIG. 56, in place of the cylindrical wall portion 85, the first tape support hole 65 may be provided with a pair of short cylinders 88. The short cylinders 88 extend from the peripheries of the opening edges of the openings 65A and 65B to the interior of the cassette case 31 toward each other.

In this case, the first tape spool 40 may have a single-wall configuration in which the heat-sensitive paper tape 55 is wound on the spool main body 40E that is a cylinder member having substantially the same height as the tape width of the print medium (similar to the print tape 57 and the film tape 59). The pair of short cylinders 88 is inserted in the openings at both ends of the spool main body 40E within the cassette case 31. Even with such a configuration, the first tape spool 40 may be rotatably supported by the pair of short cylinders 88 inserted in the shaft hole 40D, and the auxiliary shaft 110 may be inserted in and removed from the first tape support hole 65 at the installation and removal of the tape cassette 30 is also inserted in and removed from the shaft hole 40D.

The opening 65B of the first tape support hole 65 may be disposed to face the shaft hole 40D such that the auxiliary shaft 110 can be inserted in and removed from the shaft hole 40D of the first tape spool 40 when the tape printer 1 has the auxiliary shaft 110. In other words, the opening 65B provided in the bottom wall 36 and the shaft hole 40D may be connected. In the first embodiment shown in FIG. 10, the opening 65B through which the auxiliary shaft 110 is inserted and removed is indirectly connected with the shaft hole 40D via the cylindrical wall portion 85, and the shaft hole 65C of the first tape support hole 65 extends through the shaft hole 40D of the first tape spool 40. In the above modified embodiment shown in FIG. 56, the opening 65B through which the auxiliary shaft 110 is inserted and removed is directly connected with the shaft hole 40D via the short cylinder 88, and the shaft hole 65C of the first tape support hole 65 extends through the shaft hole 40D of the first tape spool 40.

In either case, the opening 65B of the first tape support hole 65 faces the shaft hole 40D of the first tape spool 40 so that the auxiliary shaft 110 that is inserted in and removed from the first tape support hole 65 is also inserted in and removed from the shaft hole 40D. Consequently, the center of gravity of the tape spool 40 on which the heat-sensitive paper tape 55 or the like is wound is guided along the auxiliary shaft 110 at the installation and removal of the tape cassette 30.

Similar to the first tape support hole 65, the opening 64B of the roller support hole 64 may be disposed to face the shaft hole 46D such that the tape drive shaft 100 can be inserted in and removed from the shaft hole 46D of the tape feed roller 46. In other words, the opening 64B of the roller support hole 64 may be connected with the shaft hole 46D such that the tape drive shaft 100 can also be inserted in and removed from the shaft hole 46D when the tape drive shaft 100 is inserted in and removed from the roller support hole 64.

In the first to fourth embodiments, various tapes and an ink ribbon (specifically, the heat-sensitive paper tape 55, the print tape 57, the double-sided adhesive tape 58, the film tape 59 and the ink ribbon 60) are wound on the spools (specifically, the first tape spool 40, the second tape spool 41 and the ribbon spool 42), respectively. However, the tapes and the ink ribbon may not be wound on spools. For example, a tape or an ink ribbon may be wound so as to form a hole about the center of winding without the spools to be configured as a so-called, coreless type.

In the first to fourth embodiments, examples in which the two guide holes (the roller support hole 64 and the guide hole 47) provided in the tape cassette 30 are used so that the tape cassette 30 is guided along the two guide shafts (the tape drive shaft 100 and the guide shaft 120) to be installed in the cassette housing portion 8. However, a member that is inserted in the guide holes of the tape cassette 30 is not limited to the guide shafts provided in the tape printer 1.

Figure 57:
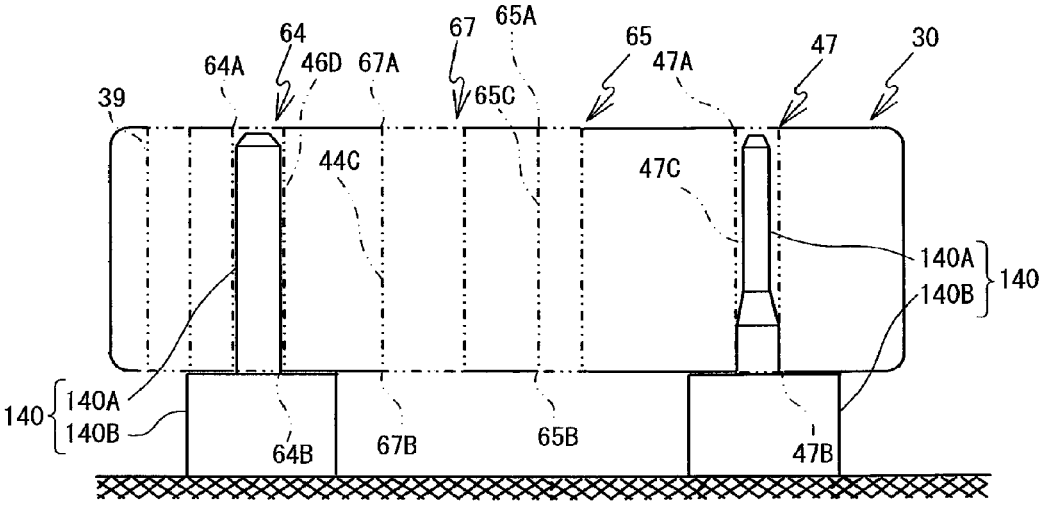
FIG. 57 is a right side view exemplifying a state in which the tape cassette 30 is exhibited.

For example, as shown in FIG. 57, a pair of shafts 140 corresponding to the roller support hole 64 and the guide hole 47 may be provided in advance to stand upward at a position where the tape cassette 30 is to be exhibited. Each of the shafts 140 has a shaft 140A and a base 140B. The shaft 140A has a diameter that can be inserted in and removed from the roller support hole 64 and the guide hole 47. The base 140B has a predetermined height, and the shafts 140A are standing upward form the upper surface of the base 140B. When the tape cassette 30 is exhibited, the user may insert the shafts 140A in the roller support hole 64 and the guide hole 47, respectively. Then, as the tape cassette 30 is moved down along the shafts 140A, the tape cassette 30 is eventually placed on the base 140B positioned at the lower end of the shafts 140A. Thus, the tape cassette 30 may be held by the pair of shafts 140 at a predetermined height position where it can be visually seen with ease.

If the position of the upper ends of the shafts 140 shown in FIG. 57 may be made higher (for example, the length of each shaft 140A is made larger), a plurality of tape cassettes 30 may be sequentially stacked on the base 140B along the shafts 140A. Thus, the plurality of tape cassettes 30 can be collectively stored, collected, carried and the like. In addition, if one tape cassette 30 is positioned at the upper ends of the shafts 140, the tape cassette 30 can be exhibited at a height position where it can, be visually seen with more ease. The usage can be employed by using a set (three) of shafts 140 for the tape cassette 30 provided with the three guide holes (the roller support hole 64, the guide hole 47 and the first tape support hole 65).

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette comprising:

a generally rectangular box-like housing having a top wall, a bottom wall, a front wall, and a side wall defining a periphery of the housing;

at least one tape wound and mounted within the housing in a tape containing area defined within the periphery;

first and second openings disposed between the tape containing area and the periphery at opposite ends of a diagonal of the housing, the diagonal connecting a first corner portion and a second corner portion of the housing, the first opening being formed in the bottom wall and the second opening being formed in the top wall, the first opening being disposed in the first corner portion and the second opening being disposed in the second corner portion, the second opening being an elongated opening in the top wall, the second opening having a length greater than a width, the length being a maximum dimension of the second opening and the width being a minimum dimension of the second opening, the length extending perpendicular to the diagonal; and a cylindrical shaped tape feed roller rotatably disposed between the top wall and the bottom wall to draw out the at least one tape and having an insert hole opening in the bottom wall via the first opening.

2. The tape cassette according to claim 1, further comprising:

an ink ribbon wound and rotatably supported by the housing in a first area to be used for printing on a print medium tape, the print medium tape being one of the at least one tape, the first area being one of two areas formed by dividing the housing with respect to a line connecting the first and second openings; and a ribbon take-up spool rotatably supported by the housing in the first area to draw out and take up the ink ribbon, wherein:

a first tape is rotatably supported by the housing in a second area, the first tape being one of the at least one tape, the second area being the other of the two areas.

3. The tape cassette according to claim 1, wherein the second opening is a groove formed in the side wall, the side wall being opposite of the front wall in a front-rear direction which is perpendicular to the front wall, the second opening being concaved from the side wall along a direction perpendicular to the diagonal.

4. A tape printer comprising:

a tape cassette that includes:

a generally rectangular box-like housing having a top wall, a bottom wall, a front wall, and a side wall defining a periphery of the housing;

at least one tape wound and mounted within the housing in a tape containing area defined within the periphery;

first and second openings disposed between the tape containing area and the periphery at opposite ends of a diagonal of the housing, the diagonal connecting a first corner portion and a second corner portion of the housing, the first opening being formed in the bottom wall and the second opening being formed in the top wall, the first opening being disposed in the first corner portion and the second opening being disposed in the second corner portion, the second opening being an elongated opening in the top wall, the second opening having a length greater than a width, the length being a maximum dimension of the second opening and the width being a minimum dimension of the second opening, the length extending perpendicular to the diagonal; and a cylindrically shaped tape feed roller rotatably disposed between the top wall and the bottom wall and having an insert hole opening in the bottom wall via the first opening;

a cassette housing portion in which or from which the tape cassette is installable or removable in an installation/removal direction, the installation/removal direction being a direction in which the top wall and the bottom wall are opposing each other;

a tape feeding device configured to draw out the at least one tape of the tape cassette installed in the cassette housing portion along a predetermined feed path;

a printing device configured to perform printing on a print medium tape of the at least one tape fed by the tape feeding device at a print position on the predetermined feed path;

two guide shafts configured to be inserted in the first and second openings and guide the tape cassette when the tape cassette is installed in or removed from the cassette housing portion in the installation/removal direction, the two guide shafts including:

a first guide shaft disposed at a first position that opposes the first opening when the tape cassette is installed in the cassette housing portion, the first guide shaft being configured to be inserted in the tape feed roller to rotatably support the tape feed roller via the first opening and transmit a rotational drive force caused by the tape feeding device to the tape feed roller, thereby causing the tape feed roller to draw out the at least one tape; and a second guide shaft disposed at a second position that opposes the second opening when the tape cassette is installed in the cassette housing portion, the second guide shaft having a length that is greater than a length of the second opening extending from the bottom wall to the top wall.

5. The tape cassette according to claim 1, wherein:

the bottom wall is stepped toward the top wall, and a length of the second opening is smaller than a maximum distance between the top wall and the bottom wall.

6. The tape cassette according to claim 1, wherein the housing has a third opening, the third opening is formed in the bottom wall and disposed in the second corner portion, and at least a portion of the second opening and at least a portion of the third opening are connected by a wall extending from the bottom wall to the top wall.

7. The tape cassette according to claim 1, wherein the second opening is configured to be guided by a guide pin of a tape printer when the tape cassette is inserted in the tape printer.

8. The tape cassette according to claim 1, wherein the second opening is a hole having a closed contour.

9. The tape cassette according to claim 1, wherein the second opening is defined by a first edge, second edge and a third edge, the first edge and the second edge are perpendicular to the diagonal, and the third edge connects the first edge with the second edge.

* * * * *